US009993987B2

(12) United States Patent
Suzuki et al.

(10) Patent No.: US 9,993,987 B2
(45) Date of Patent: Jun. 12, 2018

(54) SHEET PROCESSING DEVICE, IMAGE FORMING SYSTEM, AND SHEET PROCESSING METHOD

(71) Applicants: Michitaka Suzuki, Kanagawa (JP); Tomohiro Furuhashi, Kanagawa (JP); Tomomichi Hoshino, Kanagawa (JP); Akira Kunieda, Tokyo (JP); Takahiro Watanabe, Kanagawa (JP); Yuji Suzuki, Kanagawa (JP); Satoshi Saito, Kanagawa (JP); Koki Sakano, Kanagawa (JP); Takao Watanabe, Kanagawa (JP)

(72) Inventors: Michitaka Suzuki, Kanagawa (JP); Tomohiro Furuhashi, Kanagawa (JP); Tomomichi Hoshino, Kanagawa (JP); Akira Kunieda, Tokyo (JP); Takahiro Watanabe, Kanagawa (JP); Yuji Suzuki, Kanagawa (JP); Satoshi Saito, Kanagawa (JP); Koki Sakano, Kanagawa (JP); Takao Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days. days.

(21) Appl. No.: 14/882,986

(22) Filed: Oct. 14, 2015

(65) Prior Publication Data

US 2016/0114999 A1 Apr. 28, 2016

(30) Foreign Application Priority Data

Oct. 28, 2014 (JP) ..... 2014-219689
Oct. 30, 2014 (JP) ..... 2014-221883

(51) Int. Cl.
*B65H 37/06* (2006.01)
*B31F 1/00* (2006.01)
(Continued)

(52) U.S. Cl.
CPC ..... *B31F 1/0025* (2013.01); *B65H 45/14* (2013.01); *B65H 45/30* (2013.01); *B65H 2801/27* (2013.01)

(58) Field of Classification Search
CPC ..... B65H 45/30; B65H 45/14; B65H 37/06
See application file for complete search history.

(56) References Cited

U.S. PATENT DOCUMENTS 5,377,965 A * 1/1995 Mandel ..... B41L 43/12 270/37
8,191,882 B2 6/2012 Kikkawa et al.
(Continued)

FOREIGN PATENT DOCUMENTS

CN 101234717 A 8/2008
CN 202208562 U 5/2012
(Continued)

OTHER PUBLICATIONS

Combined Chinese Office Action and Search Report dated Nov. 28, 2016 in Patent Application No. 201510708650.6 (with English language translation).

*Primary Examiner* — Patrick H Mackey
(74) *Attorney, Agent, or Firm* — Oblon, McClelland, Maier & Neustadt, L.L.P.

(57) ABSTRACT

A sheet processing device includes: a conveying module that conveys a folded sheet; and a pressing module that presses a folded part of the folded sheet by rotating about a direction orthogonal to a sheet conveying direction of the conveying module as a rotation axis. The pressing module includes a projecting part arranged in a certain range in a direction of the rotation axis along a circumferential surface about the rotation axis. The projecting part is formed to be symmetric with respect to a middle part of the rotation axis in the direction of the rotation axis, and the projecting part arranged on one side from the middle part along the direc-
(Continued)

tion of the rotation axis are formed such that a position of the projecting part in a rotational direction of the circumferential surface varies along the direction of the rotation axis.

24 Claims, 63 Drawing Sheets

(51) Int. Cl.
*B65H 45/14* (2006.01)
*B65H 45/30* (2006.01)

(56) References Cited

U.S. PATENT DOCUMENTS 8,366,095 B2 * 2/2013 Urano ..... B65H 29/6609 270/32
9,199,822 B1 * 12/2015 Pegg ..... B65H 5/062
2005/0189689 A1 9/2005 Kushida et al.
2009/0137374 A1 5/2009 Kobayashi et al.
2009/0200724 A1 8/2009 Iguchi et al.
2010/0007071 A1 * 1/2010 Hayashi ..... B65H 45/18 270/21.1
2010/0221052 A1 * 9/2010 Mizuno ..... B65H 29/125 399/406
2012/0028781 A1 2/2012 Iguchi et al.
2014/0141956 A1 5/2014 Suzuki et al.
2014/0147184 A1 5/2014 Kunieda et al.
2014/0171283 A1 6/2014 Furuhashi et al.
2014/0179504 A1 6/2014 Nakada et al.
2014/0336031 A1 11/2014 Suzuki et al.
2014/0364295 A1 12/2014 Watanabe et al.
2015/0031520 A1 1/2015 Nakada et al.
2015/0183612 A1 * 7/2015 Awano ..... B65H 45/18 493/454
2015/0225201 A1 * 8/2015 Watanabe ..... B65H 9/006 493/442

FOREIGN PATENT DOCUMENTS

JP 47-38312 A 12/1972
JP 2007-045531 2/2007
JP 2009-149435 7/2009
JP 2011-156828 8/2011
JP 5150528 12/2012
JP 2015-117134 6/2015

* cited by examiner

SHEET PROCESSING DEVICE, IMAGE FORMING SYSTEM, AND SHEET PROCESSING METHOD

CROSS-REFERENCE TO RELATED APPLICATIONS

The present application claims priority to and incorporates by reference the entire contents of Japanese Patent Application No. 2014-219689 filed in Japan on Oct. 28, 2014 and Japanese Patent Application No. 2014-221883 filed in Japan on Oct. 30, 2014.

BACKGROUND OF THE INVENTION

1. Field of the Invention

The present invention relates to a sheet processing device, an image forming system, and a sheet processing method.

2. Description of the Related Art

Recent digitization of information requires image processing devices such as a printer and a facsimile used for outputting digitized information and a scanner used for digitizing documents. Such an image processing device is often configured as a multifunction peripheral that can be utilized as a printer, a facsimile, a scanner, and a copying machine, having an imaging function, an image forming function, and a communication function, for example.

Among such multifunction peripherals, known is a multifunction peripheral on which a folding processing device is mounted. The folding processing device forms an image on a fed sheet to draw the image and performs folding processing on the sheet on which the image is formed. When such a folding processing device performs folding processing on the sheet, a fold is weak and incomplete, and a folding height is high. Accordingly, among such multifunction peripherals, known is a multifunction peripheral on which a fold-enhancing device is mounted in addition to the folding processing device. The fold-enhancing device performs fold-enhancing processing for enhancing the fold by pressing the fold formed through the folding processing to enhance the fold and reduce the folding height (for example, refer to Japanese Laid-open Patent Publication No. 2007-045531 and Japanese Laid-open Patent Publication No. 2009-149435).

When the folding processing device as described above performs folding processing on the sheet, a fold is generally formed in a direction (hereinafter, also referred to as a "main scanning direction") perpendicular to a conveying direction of the sheet (hereinafter, also referred to as a "sub-scanning direction").

Examples of a method for performing fold-enhancing processing by the fold-enhancing device as described above include a method for pressing the fold formed on the sheet while conveying the sheet with a fold-enhancing roller having a length corresponding to a sheet width that is laterally bridged in a direction (main scanning direction) parallel to the fold formed through the folding processing.

Examples of another method for performing fold-enhancing processing by the above-described fold-enhancing device include a method for sequentially pressing a fold formed on a sheet in a main scanning direction by temporarily stopping conveyance of the sheet at a position where fold-enhancing processing is performed, and moving the fold-enhancing roller rotating about a direction (sub-scanning direction) perpendicular to the fold formed through the folding processing as a rotation axis, in the main scanning direction on the stopped sheet.

In the former method for performing fold-enhancing processing described above, a plurality of fold-enhancing rollers need to be arranged in the conveying direction of the sheet. This is because a pressing force is dispersed across the entire fold by pressing the entire fold with one fold-enhancing roller at one time and a pressing force per unit area becomes small, and a sufficient fold-enhancing effect cannot be obtained with one fold-enhancing roller. Accordingly, with the method of pressing the fold formed on the sheet while conveying the sheet with the fold-enhancing roller having a length corresponding to a sheet width that is laterally bridged in the main scanning direction, a space is required to arrange a plurality of fold-enhancing rollers. Thus, the size of a multifunction peripheral is increased and the number of driving systems and control systems for driving the fold-enhancing rollers is increased, which increases initial costs and running costs.

On the other hand, in the latter method for performing fold-enhancing processing described above, the entire fold is successively pressed in the main scanning direction with one fold-enhancing roller, so that a pressing force is not dispersed because the pressing force can be intensively applied to the entire fold. However, during the fold-enhancing processing, the fold-enhancing roller needs to be moved from one end to the other end of the sheet width direction while the sheet is stopped. Accordingly, with the method for successively pressing the fold formed on the sheet in the main scanning direction by moving the fold-enhancing roller rotatable about the sub-scanning direction as a rotation axis, in the main scanning direction on the stopped sheet, time is required for moving the fold-enhancing roller from one end to the other end of the sheet width direction, and thus productivity is reduced. The problem described above occurs not only with the sheet for image formation output, but also with a sheet-like object in some cases. The problem described above is caused not only in a case of enhancing the fold of the sheet in a folded state, but also in a case of pressing the sheet.

In view of the above, there is a need to provide a small, low-cost, highly productive sheet processing device for pressing a sheet.

SUMMARY OF THE INVENTION

It is an object of the present invention to at least partially solve the problems in the conventional technology.

A sheet processing device includes: a conveying module that conveys a folded sheet; and a pressing module that presses a folded part of the folded sheet by rotating about a direction orthogonal to a sheet conveying direction of the conveying module as a rotation axis. The pressing module includes a projecting part arranged in a certain range in a direction of the rotation axis along a circumferential surface about the rotation axis. The projecting part is formed to be symmetric with respect to a middle part of the rotation axis in the direction of the rotation axis, and the projecting part arranged on one side from the middle part along the direction of the rotation axis are formed such that a position of the projecting part in a rotational direction of the circumferential surface varies along the direction of the rotation axis.

A sheet processing device includes: a conveying module that conveys a folded sheet; and a pressing module that presses a folded part of the folded sheet by rotating about a direction orthogonal to a sheet conveying direction of the conveying module as a rotation axis. The pressing module comprises a projecting part that is linearly and continuously formed in a direction of the rotation axis along a circumferential surface about the rotation axis. The projecting part is formed such that a position of the projecting part in a rotational direction of the circumferential surface varies along the direction of the rotation axis.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 61A to 601 are explanatory schematic diagrams illustrating the displacement of the pressed position in the fold-enhancing operation by an fold-enhancing roller part according to the second example viewed from the top;

DETAILED DESCRIPTION OF THE PREFERRED EMBODIMENTS

First Embodiment

The following describes each embodiment of the present invention in detail with reference to the drawings. In the embodiment, exemplified is an image forming apparatus that performs, after forming an image on a fed sheet, folding processing on the sheet on which the image is formed to form a fold in a direction (hereinafter, also referred to as a "main scanning direction") perpendicular to a sheet conveying direction (hereinafter, also referred to as a "sub-scanning direction"), and performs fold-enhancing processing by pressing the fold formed through the folding processing with an fold-enhancing roller to enhance the fold and reduce a folding height.

In such an image forming apparatus, one of the main points according to the embodiment is that the fold-enhancing roller is configured to successively press the fold in the main scanning direction while being rotated about a shaft parallel to the main scanning direction as a rotation axis.

Accordingly, the image forming apparatus according to the embodiment can apply a concentrated pressing force to the entire fold in a short time. Due to this, the image forming apparatus according to the embodiment can apply a sufficient pressing force to the fold without lowering productivity while reducing a load on the rotation axis of the fold-enhancing roller. Accordingly, a small, low-cost, highly productive fold-enhancing device can be provided.

Figure 1:
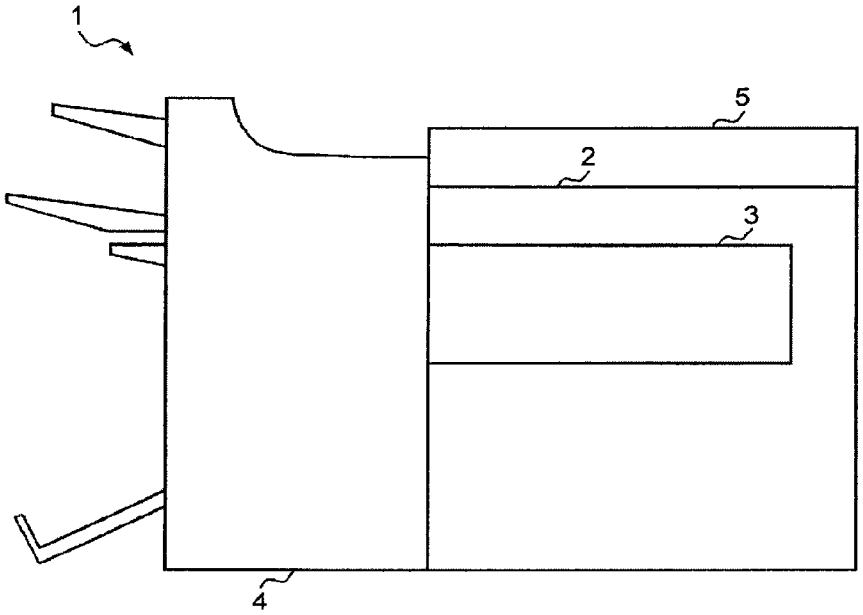
FIG. 1 is a diagram simply illustrating the entire configuration of an image forming apparatus according to an embodiment.

First, the following describes the entire configuration of an image forming apparatus 1 according to the embodiment with reference to FIG. 1. FIG. 1 is a diagram simply illustrating the entire configuration of the image forming apparatus 1 according to the embodiment. As illustrated in FIG. 1, the image forming apparatus 1 according to the embodiment includes an image forming unit 2, a folding processing unit 3, an fold-enhancing processing unit 4, and a scanner unit 5.

The image forming unit 2 generates drawing information of CMYK (Cyan Magenta Yellow Key Plate) based on input image data, and performs image formation output on a fed sheet based on the generated drawing information. The folding processing unit 3 performs folding processing on the sheet on which the image is formed that is conveyed from the image forming unit 2. The fold-enhancing processing unit 4 performs fold-enhancing processing on a fold formed on the folded sheet conveyed from the folding processing unit 3. That is, in the embodiment, the fold-enhancing processing unit 4 functions as a sheet processing device.

The scanner unit 5 digitizes an original by reading the original with a linear image sensor in which a plurality of photodiodes are arranged in a line and a light receiving element such as a charge coupled device (CCD) image sensor or a complementary metal oxide semiconductor (CMOS) image sensor is arranged in parallel with the photodiodes. The image forming apparatus 1 according to the embodiment is a multifunction peripheral (MFP) having an imaging function, an image forming function, a communication function, and the like to be utilized as a printer, a facsimile, a scanner, and a copying machine.

Figure 2:
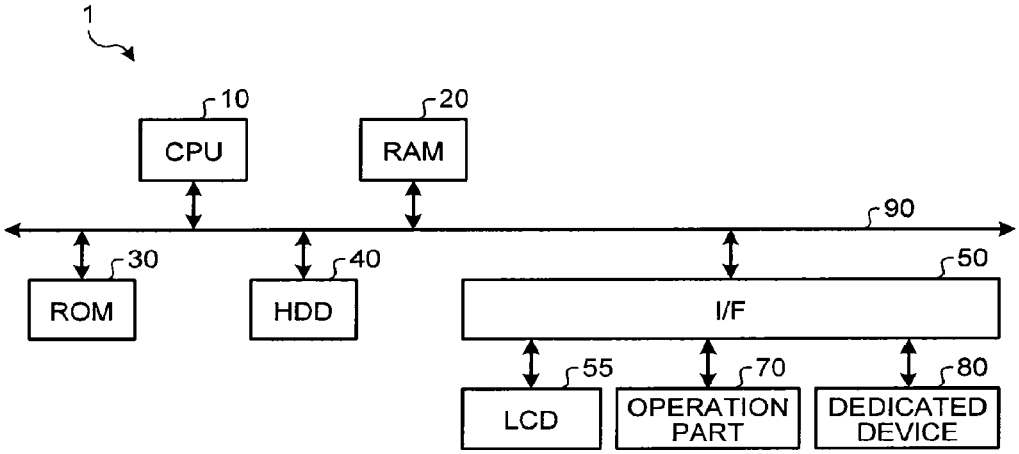
FIG. 2 is a block diagram schematically illustrating a hardware configuration of the image forming apparatus according to the embodiment.

Next, the following describes a hardware configuration of the image forming apparatus 1 according to the embodiment with reference to FIG. 2. FIG. 2 is a block diagram schematically illustrating the hardware configuration of the image forming apparatus 1 according to the embodiment. The image forming apparatus 1 includes an engine for implementing a scanner, a printer, folding processing, fold-enhancing processing, and the like in addition to the hardware configuration illustrated in FIG. 2.

As illustrated in FIG. 2, the image forming apparatus 1 according to the embodiment has a configuration similar to that of a general server, a personal computer (PC), or the like. That is, in the image forming apparatus 1 according to the embodiment, a central processing unit (CPU) 10, a random access memory (RAM) 20, a read only memory (ROM) 30, a hard disk drive (HDD) 40, and an I/F 50 are connected with each other via a bus 90. A liquid crystal display (LCD) 55, an operation part 70, and a dedicated device 80 are connected to the I/F 50.

The CPU 10 is a computing module that controls the entire operation of the image forming apparatus 1. The RAM 20 is a volatile storage medium that can read and write information at high speed, and used as a working area when the CPU 10 processes information. The ROM 30 is a read-only non-volatile storage medium in which a computer program such as firmware is stored. The HDD 40 is a non-volatile storage medium that can read and write information in which an operating system (OS), various control programs, application programs, and the like are stored.

The I/F 50 connects the bus 90 with various hardware or network to be controlled. The LCD 55 is a visual user interface by which a user checks a state of the image forming apparatus 1. The operation part 70 is a user interface such as a keyboard or a mouse by which the user inputs information to the image forming apparatus 1.

The dedicated device 80 is hardware for implementing dedicated functions in the image forming unit 2, the folding processing unit 3, the fold-enhancing processing unit 4, and the scanner unit 5, and implements a plotter device for performing image formation output on a sheet in the image forming unit 2. In the folding processing unit 3, the dedicated device 80 implements a conveying mechanism for conveying a sheet and a folding processing mechanism for folding the conveyed sheet.

In the fold-enhancing processing unit 4, the dedicated device 80 implements an fold-enhancing processing mechanism for enhancing a fold of the sheet that is folded by the folding processing unit 3 to be conveyed. In the scanner unit 5, the dedicated device 80 implements a reading device for reading an image displayed on the sheet. One of the main points of the embodiment is the configuration of the fold-enhancing processing mechanism included in the fold-enhancing processing unit 4.

In such a hardware configuration, the RAM 20 reads a computer program stored in a storage medium such as the ROM 30, the HDD 40, or an optical disc (not illustrated), and the CPU 10 performs computation according to the computer program loaded on the RAM 20 to configure a software control part. A functional block that implements the functions of the image forming apparatus 1 according to the embodiment is configured by combining the software control part configured as described above and hardware.

Figure 3:
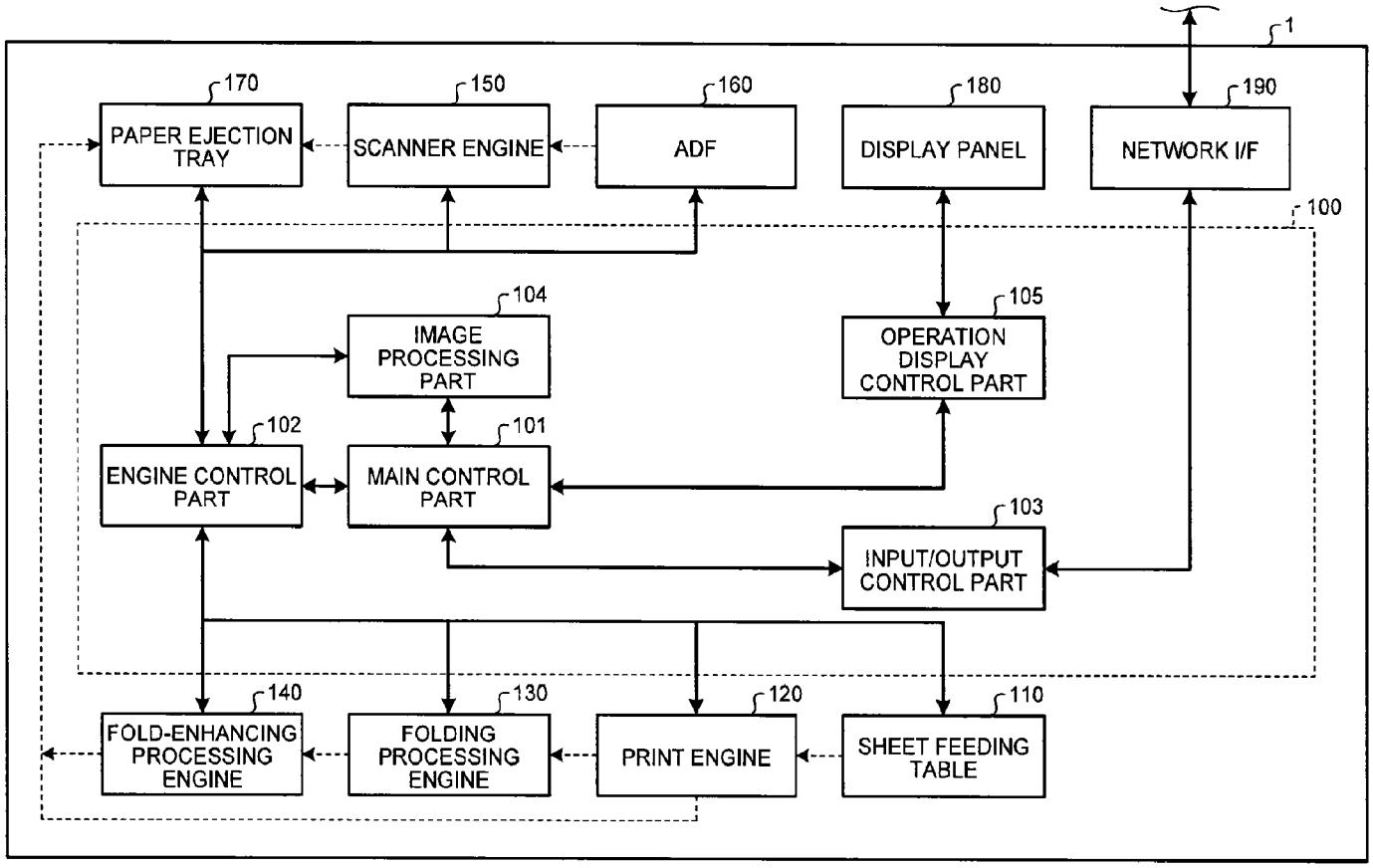
FIG. 3 is a block diagram schematically illustrating a functional configuration of the image forming apparatus according to the embodiment.

The following describes a functional configuration of the image forming apparatus 1 according to the embodiment with reference to FIG. 3. FIG. 3 is a block diagram schematically illustrating the functional configuration of the image forming apparatus 1 according to the embodiment. In FIG. 3, a solid line arrow indicates electrical connection, and a dashed line arrow indicates a flow of a sheet or a document bundle.

As illustrated in FIG. 3, the image forming apparatus 1 according to the embodiment includes a controller 100, a sheet feeding table 110, a print engine 120, a folding processing engine 130, an fold-enhancing processing engine 140, a scanner engine 150, an auto document feeder (ADF) 160, a paper ejection tray 170, a display panel 180, and a network I/F 190. The controller 100 includes a main control part 101, an engine control part 102, an input/output control part 103, an image processing part 104, and an operation display control part 105.

The sheet feeding table 110 feeds the sheet to the print engine 120 serving as an image forming part. The print engine 120 is an image forming part included in the image forming unit 2, and draws an image by performing image formation output on the sheet conveyed from the sheet feeding table 110. As a specific mode of the print engine 120, an ink jet image forming mechanism, an electrophotographic type image forming mechanism, and the like can be used. The sheet on which the image is drawn by the print engine 120 is conveyed to the folding processing unit 3, or ejected to the paper ejection tray 170.

The folding processing engine 130 is included in the folding processing unit 3, and performs folding processing on the sheet on which the image is formed that is conveyed from the image forming unit 2. The folded sheet on which folding processing is performed by the folding processing engine 130 is conveyed to the fold-enhancing processing unit 4. The fold-enhancing processing engine 140 is included in the fold-enhancing processing unit 4, and performs fold-enhancing processing on the fold formed on the folded sheet conveyed from the folding processing engine 130. The fold-enhanced sheet on which fold-enhancing processing is performed by the fold-enhancing processing engine 140 is ejected to the paper ejection tray 170, or conveyed to a postprocessing unit (not illustrated) that performs postprocessing such as stapling, punching, and bookbinding processing.

The ADF 160 is included in the scanner unit 5, and automatically conveys the original to the scanner engine 150 serving as an original reading part. The scanner engine 150 is an original reading part that is included in the scanner unit 5 and includes a photoelectric conversion element for converting optical information into an electric signal, and optically scans and reads the original automatically conveyed by the ADF 160 or the original set on an original platen glass (not illustrated) to generate image information. The original that is automatically conveyed by the ADF 160 and read by the scanner engine 150 is ejected to the paper ejection tray 170.

The display panel 180 serves as an output interface that visually displays the state of the image forming apparatus 1, and also serves as an input interface that is a touch panel through which the user directly operates the image forming apparatus 1 or inputs information to the image forming apparatus 1. That is, the display panel 180 has a function for displaying an image for receiving the operation by the user. The display panel 180 is implemented with the LCD 55 and the operation part 70 illustrated in FIG. 2.

The network I/F 190 is an interface through which the image forming apparatus 1 communicates with other equipment such as an administrator terminal via a network. As the network I/F 190, used are Ethernet (registered trademark), a universal serial bus (USB) interface, Bluetooth (registered trademark), Wireless Fidelity (Wi-Fi), FeliCa (registered trademark), and the like. The network I/F 190 is implemented with the I/F 50 illustrated in FIG. 2.

The controller 100 is configured by combining software and hardware. Specifically, the controller 100 includes hardware such as an integrated circuit and a software control part configured in such a way that a control program such as firmware stored in a non-volatile storage medium such as the ROM 30 or the HDD 40 is loaded on the RAM 20 and the CPU 10 performs computation according to the control program. The controller 100 functions as a control part that controls the entire image forming apparatus 1.

The main control part 101 plays a role of controlling each component included in the controller 100, and gives a command to each component of the controller 100. The main control part 101 controls the input/output control part 103, and accesses another device via the network I/F 190 and the network. The engine control part 102 controls or drive a driving unit such as the print engine 120, the folding processing engine 130, the fold-enhancing processing engine 140, and the scanner engine 150. The input/output control part 103 inputs, to the main control part 101, a signal or a command that is input via the network I/F 190 and the network.

The image processing part 104 generates drawing information based on document data or image data included in an input print job according to the control by the main control part 101. The drawing information is data such as CMYK bit map data, and is used by the print engine 120 serving as the image forming part to draw an image to be formed in an image forming operation. The image processing part 104 processes imaging data input from the scanner engine 150 to generate image data. The image data is information to be stored in the image forming apparatus 1 or transmitted to other equipment via the network I/F 190 and the network as a result of a scanner operation. The operation display control part 105 displays information on the display panel 180, or notifies the main control part 101 of information input via the display panel 180.

The following describes an operation example when the folding processing unit 3 and the fold-enhancing processing unit 4 according to the embodiment perform folding processing and fold-enhancing processing, respectively, with reference to FIGS. 4A to 6C. FIGS. 4A to 6C are sectional views of the folding processing unit 3 and the fold-enhancing processing unit 4 according to the embodiment viewed from the main scanning direction when the folding processing unit 3 and the fold-enhancing processing unit 4 perform folding processing and fold-enhancing processing, respectively. An operation of each operation part described below is controlled by the main control part 101 and the engine control part 102.

Figure 4A:
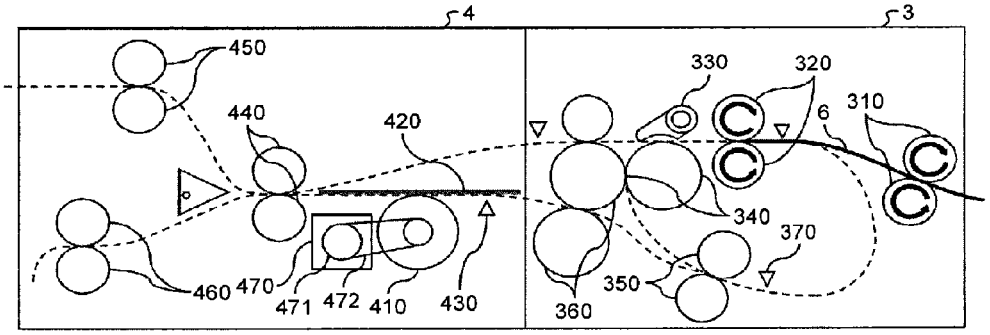
FIGS. 4A to 4C are sectional views of a folding processing unit and a fold-enhancing processing unit according to the embodiment viewed from a main scanning direction when the folding processing unit and the fold-enhancing processing unit perform folding processing and fold-enhancing processing, respectively.

When the image forming apparatus 1 according to the embodiment performs a folding processing operation with the folding processing unit 3, as illustrated in FIG. 4A, the folding processing unit 3 first corrects, with a registration roller pair 320, registration in the main scanning direction of a sheet 6 on which an image is formed that is conveyed from the image forming unit 2 to the folding processing unit 3 by an inlet roller pair 310, and conveys the sheet 6 toward a conveying path switching claw 330 while adjusting timing of the conveyance.

Figure 4B:
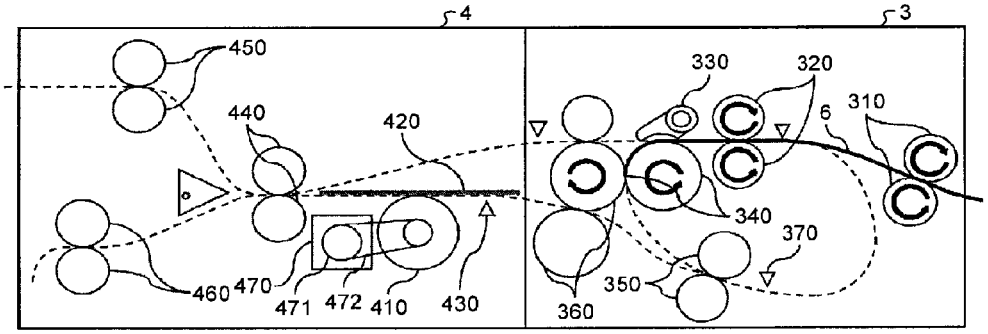
Figure 4C:
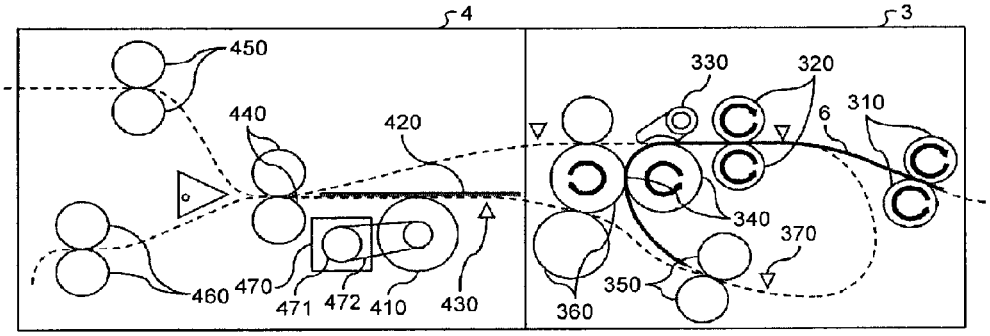

As illustrated in FIG. 4B, the folding processing unit 3 guides, to a first folding processing conveyance roller pair 340, the sheet 6 conveyed through the registration roller pair 320 to the conveying path switching claw 330, using the conveying path switching claw 330. As illustrated in FIG. 4C, the folding processing unit 3 conveys, toward a second folding processing conveyance roller pair 350, the sheet 6 guided by the conveying path switching claw 330 to the first folding processing conveyance roller pair 340, using the first folding processing conveyance roller pair 340.

Figure 5A:
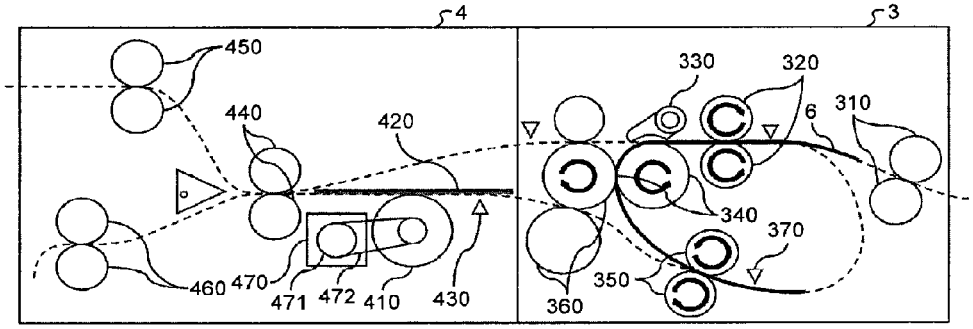
FIGS. 5A to 5C are sectional views of the folding processing unit and the fold-enhancing processing unit according to the embodiment viewed from the main scanning direction when the folding processing unit and the fold-enhancing processing unit perform folding processing and fold-enhancing processing, respectively.
Figure 5B:
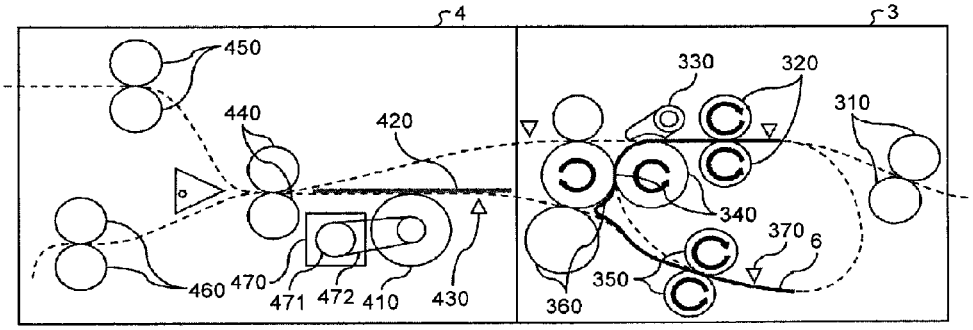

As illustrated in FIG. 5A, in the folding processing unit 3, the first folding processing conveyance roller pair 340 and the second folding processing conveyance roller pair 350 further conveys the sheet 6 conveyed through the first folding processing conveyance roller pair 340 to the second folding processing conveyance roller pair 350. As illustrated in 5B, the folding processing unit 3 creates a distortion at a certain position of the sheet 6 by reversing a rotational direction of the second folding processing conveyance roller pair 350 while adjusting timing of folding the sheet 6 at the certain position, and conveys the sheet 6 toward a fold-applying conveyance roller pair 360 using the first folding processing conveyance roller pair 340 and the second folding processing conveyance roller pair 350 while the position of the distortion is kept unchanged.

In this process, in the folding processing unit 3, the main control part 101 and the engine control part 102 control each part based on the conveying speed of the sheet 6 and sensor information input from a sensor 370 to adjust the timing.

Figure 5C:
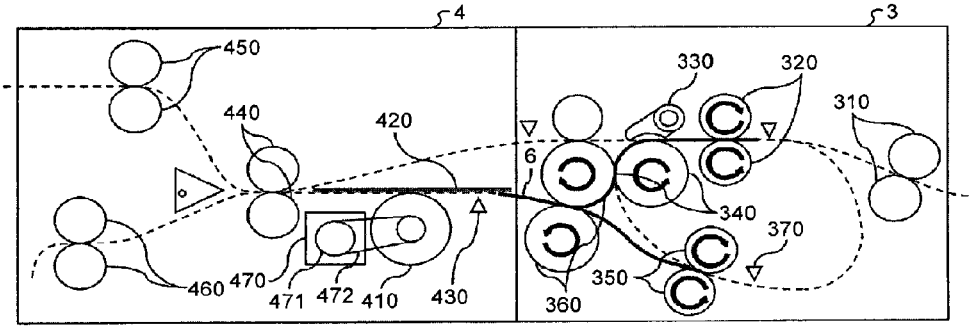

As illustrated in FIG. 5C, the folding processing unit 3 applies a fold at the certain position of the sheet 6 conveyed through the second folding processing conveyance roller pair 350 to the fold-applying conveyance roller pair 360 by pinching the distortion of the sheet 6 with the fold-applying conveyance roller pair 360 being rotated in the conveying direction, and conveys the sheet 6 toward a gap between an fold-enhancing roller 410 and a sheet supporting plate 420 in the fold-enhancing processing unit 4. As illustrated in FIGS. 4A to 5C, in the embodiment, one of the first folding processing conveyance roller pair 340 also serves as one of the fold-applying conveyance roller pair 360.

Figure 7:
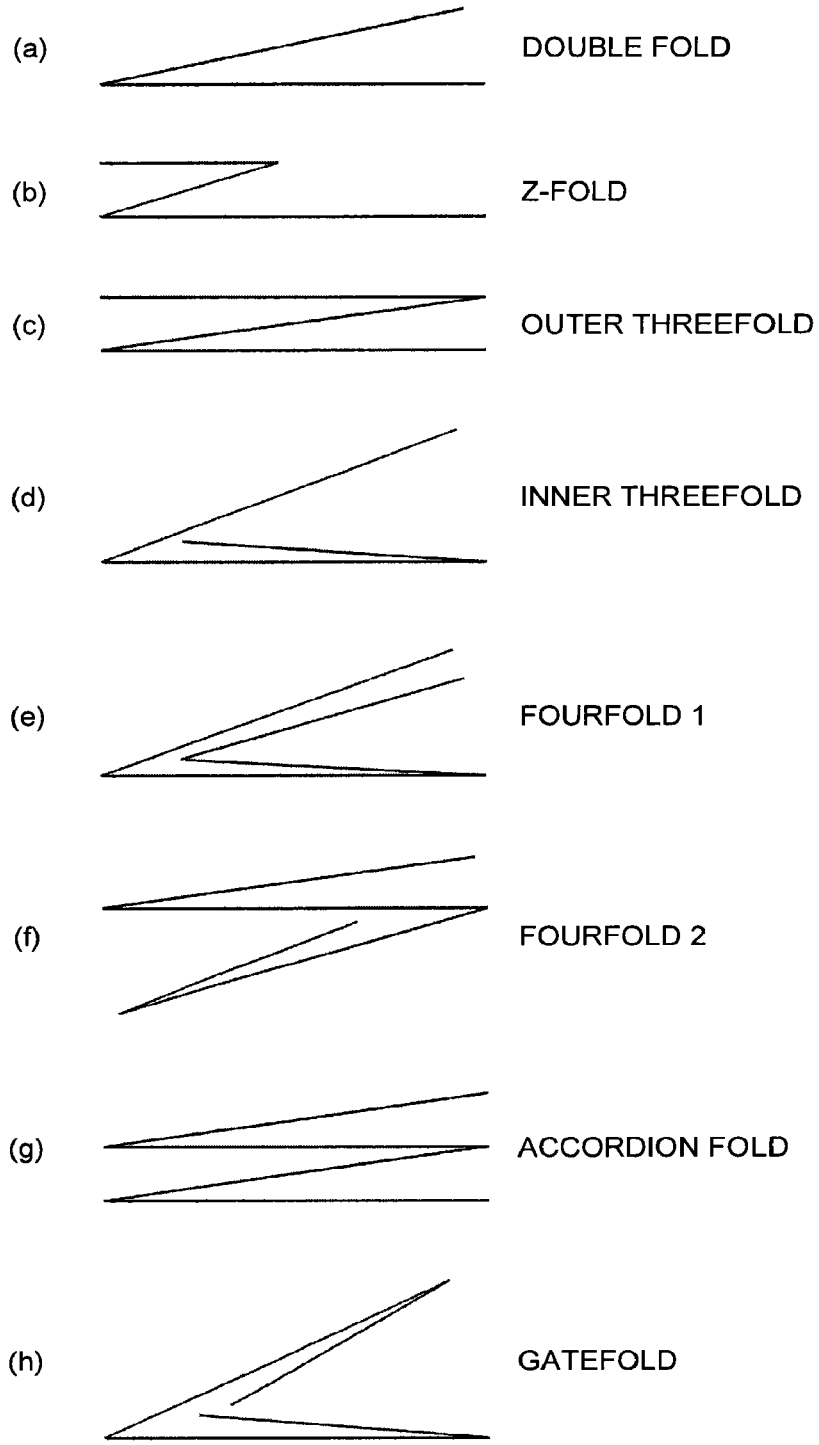
FIG. 7 is a diagram illustrating examples of the shape of a folded sheet on which folding processing is performed by the folding processing unit according to the embodiment.

Examples of the shape of the sheet 6 on which folding processing is performed as described above are illustrated at (a) to (h) in FIG. 7. FIG. 7 is a diagram illustrating examples of the shape of the folded sheet 6 on which folding processing is performed by the folding processing unit 3 according to the embodiment at (a) to (h).

Figure 6A:
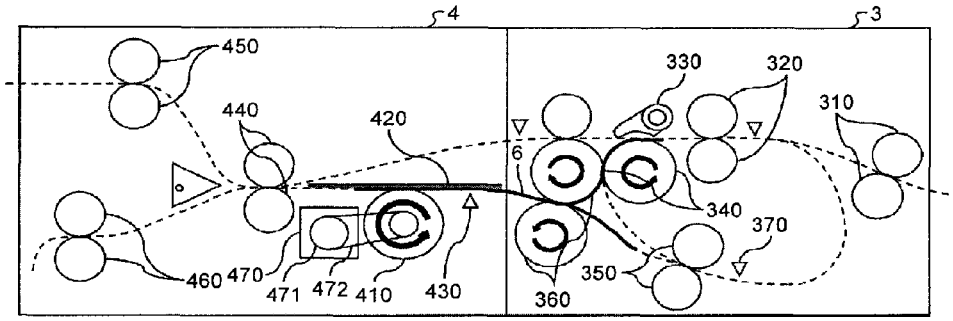
FIGS. 6A to 6C are sectional views of the folding processing unit and the fold-enhancing processing unit according to the embodiment viewed from the main scanning direction when the folding processing unit and the fold-enhancing processing unit perform folding processing and fold-enhancing processing, respectively.

As illustrated in FIG. 6A, the fold-enhancing processing unit 4 supports in a pressing direction, with the sheet supporting plate 420, the sheet 6 conveyed through the fold-applying conveyance roller pair 360 to the gap between the fold-enhancing roller 410 and the sheet supporting plate 420, and presses the fold formed on the sheet 6 by rotating the fold-enhancing roller 410 in the conveying direction to perform fold-enhancing processing. That is, in the embodiment, the fold-enhancing roller 410 functions as a pressing part, and the sheet supporting plate 420 functions as a sheet supporting part.

In this process, in the fold-enhancing processing unit 4, the main control part 101 and the engine control part 102 adjust timing of pressing the sheet 6 by controlling each part based on folding information about a folding method in the folding processing unit 3, sheet information about the size of the sheet 6, the conveying speed of the sheet 6, and the rotational speed of the fold-enhancing roller 410. Alternatively in this process, in the fold-enhancing processing unit 4, the main control part 101 and the engine control part 102 adjust the timing of pressing the sheet 6 by controlling each part based on the conveying speed of the sheet 6, the rotational speed of the fold-enhancing roller 410, and sensor information input from a sensor 430.

As illustrated in FIGS. 4A to 6C, the fold-enhancing roller 410 is driven by a driving force of an fold-enhancing roller driving motor 471 transmitted from an fold-enhancing roller driving device 470 via a timing belt 472, and the fold-applying conveyance roller pair 360 is driven by a fold-applying conveyance roller driving motor (not illustrated). The driving of the fold-enhancing roller driving motor 471 and the fold-applying conveyance roller driving motor is controlled by the engine control part 102. That is, in the embodiment, the fold-enhancing roller driving motor 471 functions as a rotation drive braking part, and the engine control part 102 functions as a rotation control part and a conveyance control part.

As described above, the fold-enhancing processing unit 4 performs fold-enhancing processing by pressing the fold formed on the sheet 6 with the fold-enhancing roller 410, and conveys the fold-enhanced sheet 6 toward an fold-enhancing processing conveyance roller pair 440.

Figure 6B:
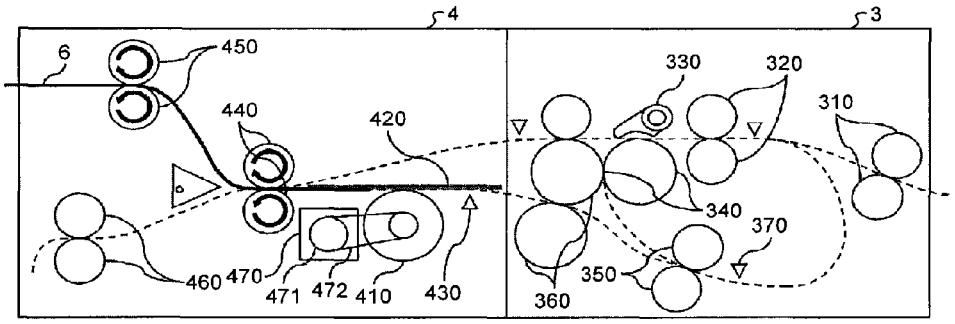

As illustrated in FIG. 6B, to directly eject the fold-enhanced sheet 6 conveyed from the gap between the fold-enhancing roller 410 and the sheet supporting plate 420, the fold-enhancing processing unit 4 conveys the sheet 6 toward a paper ejection roller pair 450 with the fold-enhancing processing conveyance roller pair 440. The fold-enhancing processing unit 4 then ejects, to the paper ejection tray 170 with the paper ejection roller pair 450, the fold-enhanced sheet 6 conveyed through the fold-enhancing processing conveyance roller pair 440 to the paper ejection roller pair 450. The folding processing operation and the fold-enhancing processing operation are then ended in the folding image forming apparatus 1 according to the embodiment.

Figure 6C:
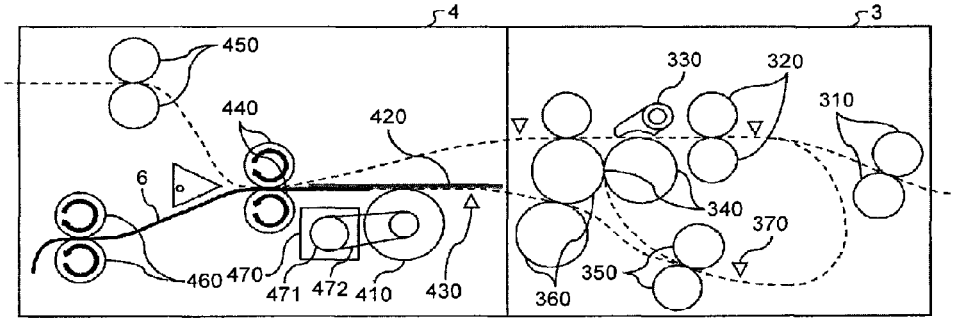

On the other hand, as illustrated in FIG. 6C, to perform postprocessing such as stapling, punching, and bookbinding processing on the fold-enhanced sheet 6 conveyed from the gap between the fold-enhancing roller 410 and the sheet supporting plate 420, the fold-enhancing processing unit 4 conveys the sheet 6 toward a postprocessing conveyance roller pair 460 with the fold-enhancing processing conveyance roller pair 440. The fold-enhancing processing unit 4 then conveys, to a postprocessing unit (not illustrated) with the postprocessing conveyance roller pair 460, the fold-enhanced sheet 6 conveyed through the fold-enhancing processing conveyance roller pair 440 to the postprocessing conveyance roller pair 460. The folding processing operation and the fold-enhancing processing operation are then ended in the folding image forming apparatus 1 according to the embodiment.

The following describes an example of the structure of the fold-enhancing roller 410 according to the embodiment with reference to FIGS. 8 to 10, FIGS. 11 to 13, FIGS. 14 to 16, and FIGS. 17 to 19.

Figure 8:
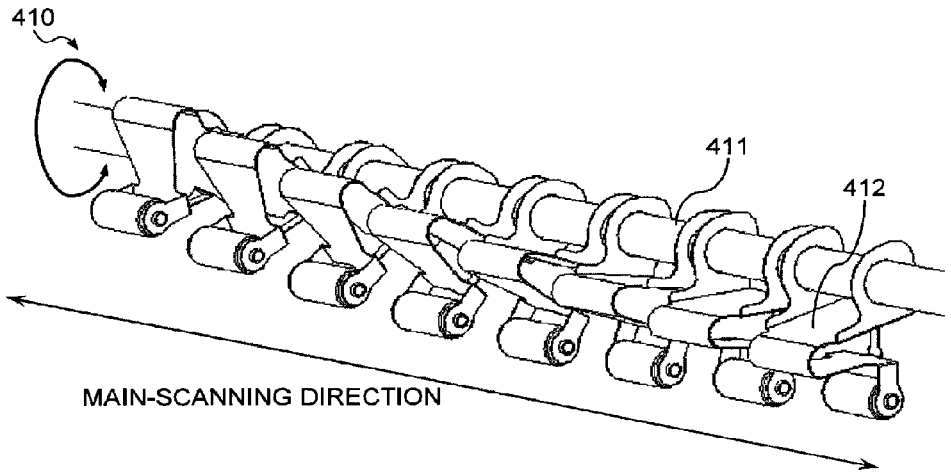
FIG. 8 is a perspective view of a fold-enhancing roller according to the embodiment viewed from an obliquely upward side of the main scanning direction.
Figure 9:
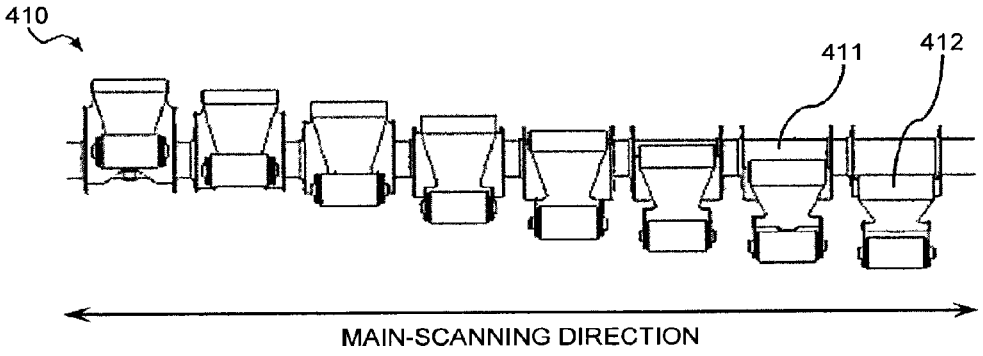
FIG. 9 is a front view of the fold-enhancing roller according to the embodiment viewed from a sub-scanning direction.
Figure 10:
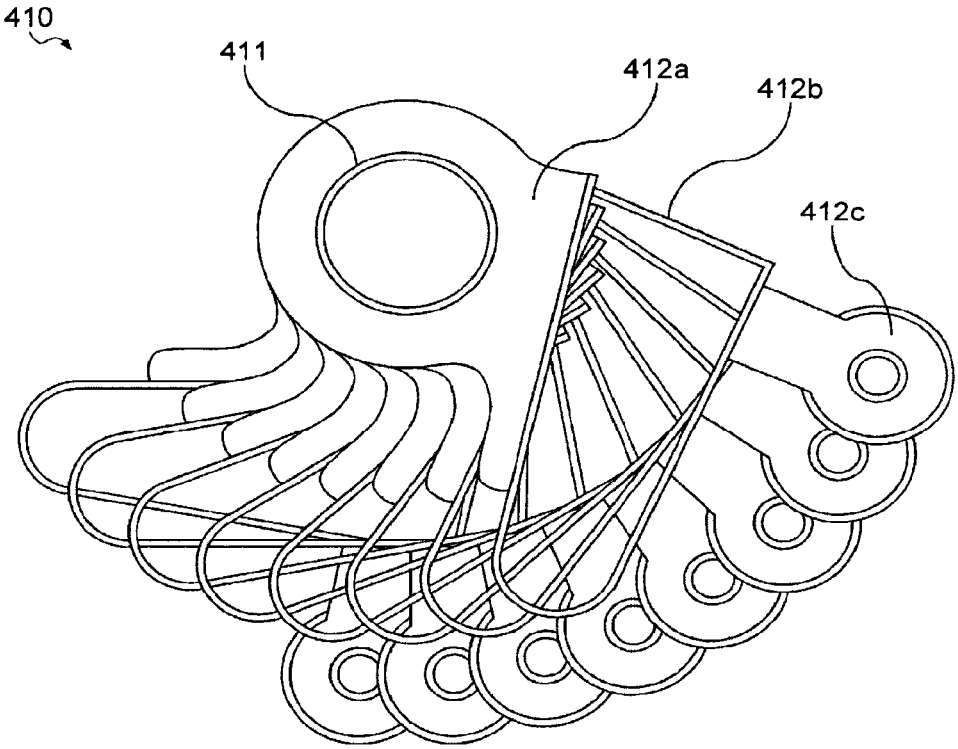
FIG. 10 is a side view of the fold-enhancing roller according to the embodiment viewed from the main scanning direction.

The following describes a first example of the structure of the fold-enhancing roller 410 according to the embodiment with reference to FIGS. 8 to 10. FIG. 8 is a perspective view of the fold-enhancing roller 410 according to the embodiment viewed from an obliquely upward side of the main scanning direction. FIG. 9 is a front view of the fold-enhancing roller 410 according to the embodiment viewed from the sub-scanning direction. FIG. 10 is a side view of the fold-enhancing roller 410 according to the embodiment viewed from the main scanning direction.

As the first example of the structure of the fold-enhancing roller 410 according to the embodiment, as illustrated in FIGS. 8 to 10, a plurality of pressing force transmitting parts 412 are arranged at regular intervals around an fold-enhancing roller rotating shaft 411 in the main scanning direction with certain angle differences from each other in the rotational direction of the fold-enhancing roller rotating shaft 411.

In this case, the fold-enhancing roller rotating shaft 411 is a rotating shaft of the fold-enhancing roller 410 that is laterally bridged in the main scanning direction of the fold-enhancing processing unit 4 and rotates about an axis parallel to the main scanning direction. Each pressing force transmitting part 412 is a pressing member that expands and contracts in a certain direction to transmit the pressing force to the fold formed on the sheet 6 using an elastic force caused by expansion or contraction.

When the fold-enhancing roller 410 according to the embodiment is configured as illustrated in FIGS. 8 to 10, the fold-enhancing roller 410 can successively press the fold from one end toward the other end, so that a folding wrinkle can be prevented from being formed.

Figure 11:
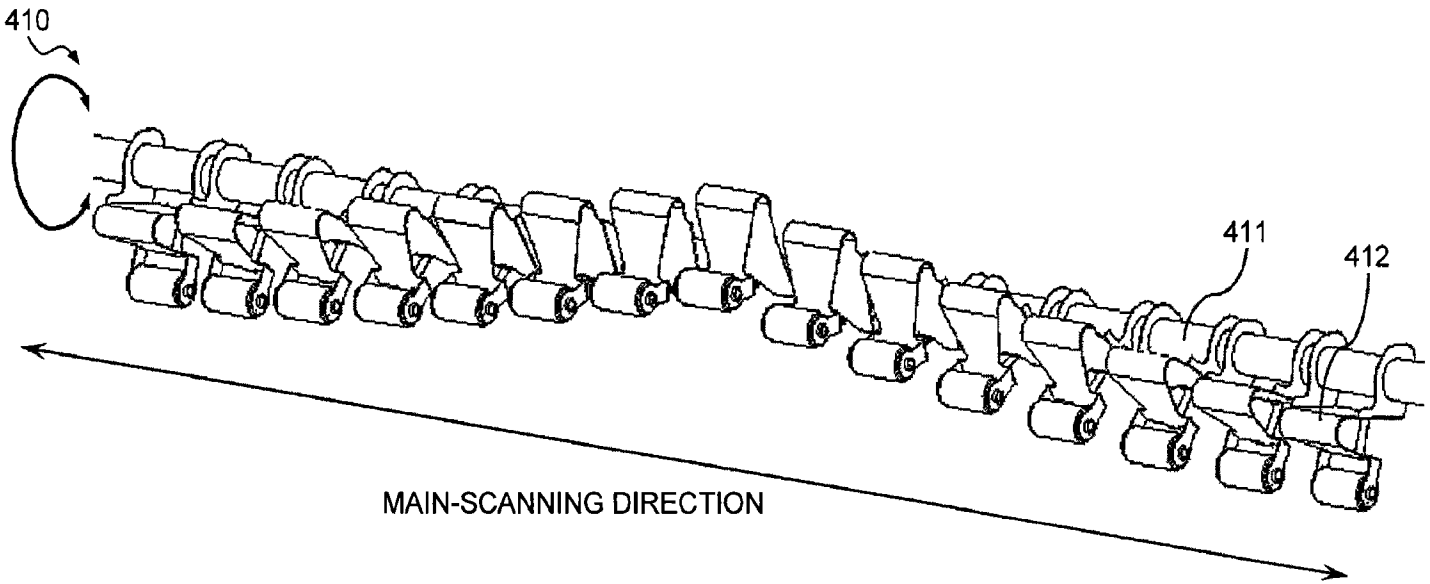
FIG. 11 is a perspective view of the fold-enhancing roller according to the embodiment viewed from the obliquely upward side of the main scanning direction.
Figure 12:
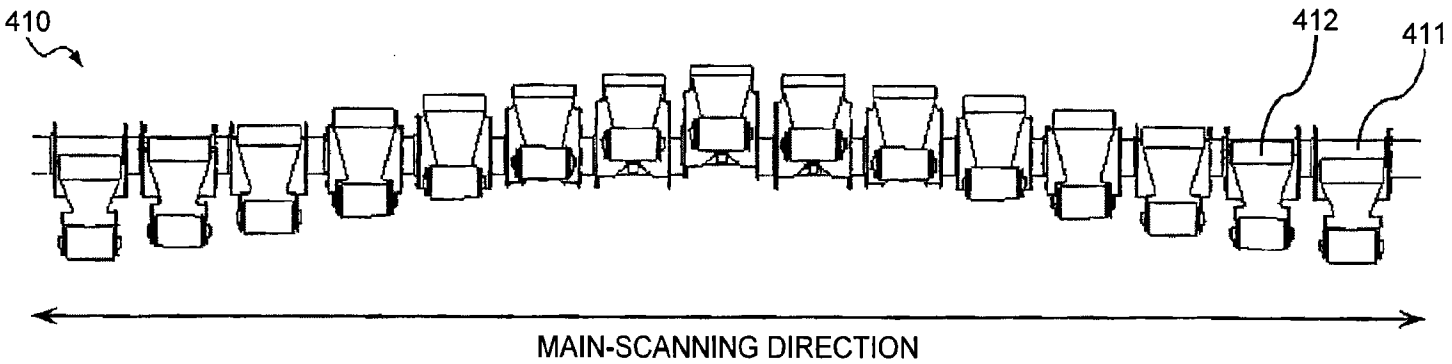
FIG. 12 is a front view of the fold-enhancing roller according to the embodiment viewed from the sub-scanning direction.
Figure 13:
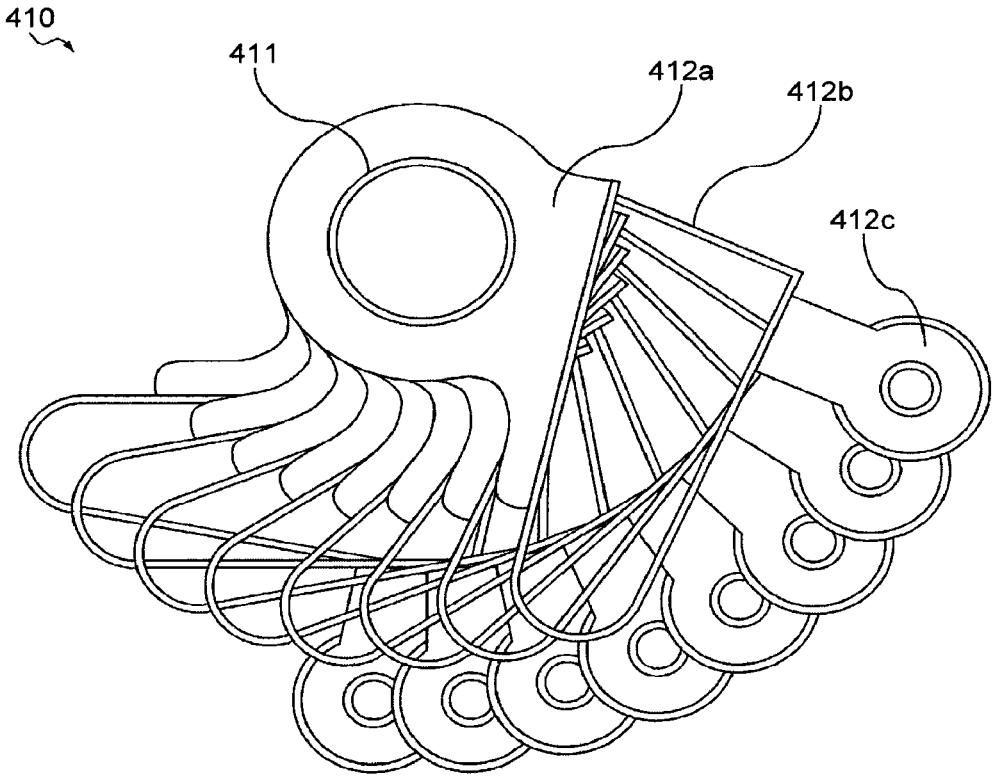
FIG. 13 is a side view of the fold-enhancing roller according to the embodiment viewed from the main scanning direction.

The following describes a second example of the structure of the fold-enhancing roller 410 according to the embodiment with reference to FIGS. 11 to 13. FIG. 11 is a perspective view of the fold-enhancing roller 410 according to the embodiment viewed from the obliquely upward side of the main scanning direction. FIG. 12 is a front view of the fold-enhancing roller 410 according to the embodiment viewed from the sub-scanning direction. FIG. 13 is a side view of the fold-enhancing roller 410 according to the embodiment viewed from the main scanning direction.

As the second example of the structure of the fold-enhancing roller 410 according to the embodiment, as illustrated in FIGS. 11 to 13, an odd number of pressing force transmitting parts 412 are arranged at regular intervals around the fold-enhancing roller rotating shaft 411 in the main scanning direction with certain angle differences from each other in the rotational direction of the fold-enhancing roller rotating shaft 411 so that the pressing force transmitting parts 412 are symmetrically arranged with respect to the center of the fold-enhancing roller rotating shaft 411 in the main scanning direction.

Figure 14:
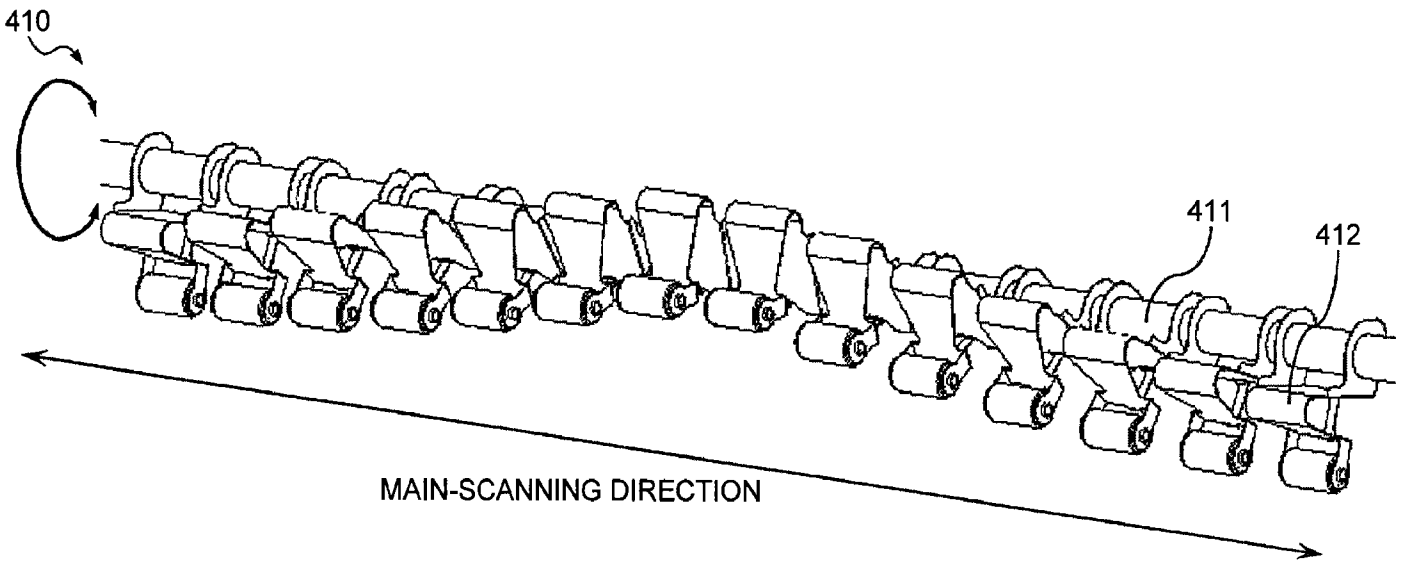
FIG. 14 is a perspective view of the fold-enhancing roller according to the embodiment viewed from the obliquely upward side of the main scanning direction.
Figure 15:
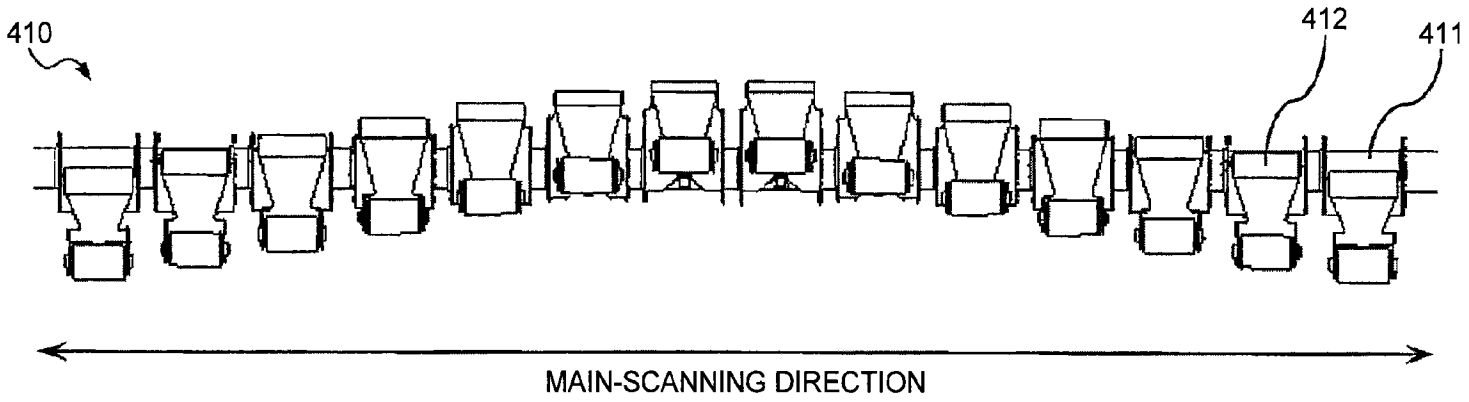
FIG. 15 is a front view of the fold-enhancing roller according to the embodiment viewed from the sub-scanning direction.
Figure 16:
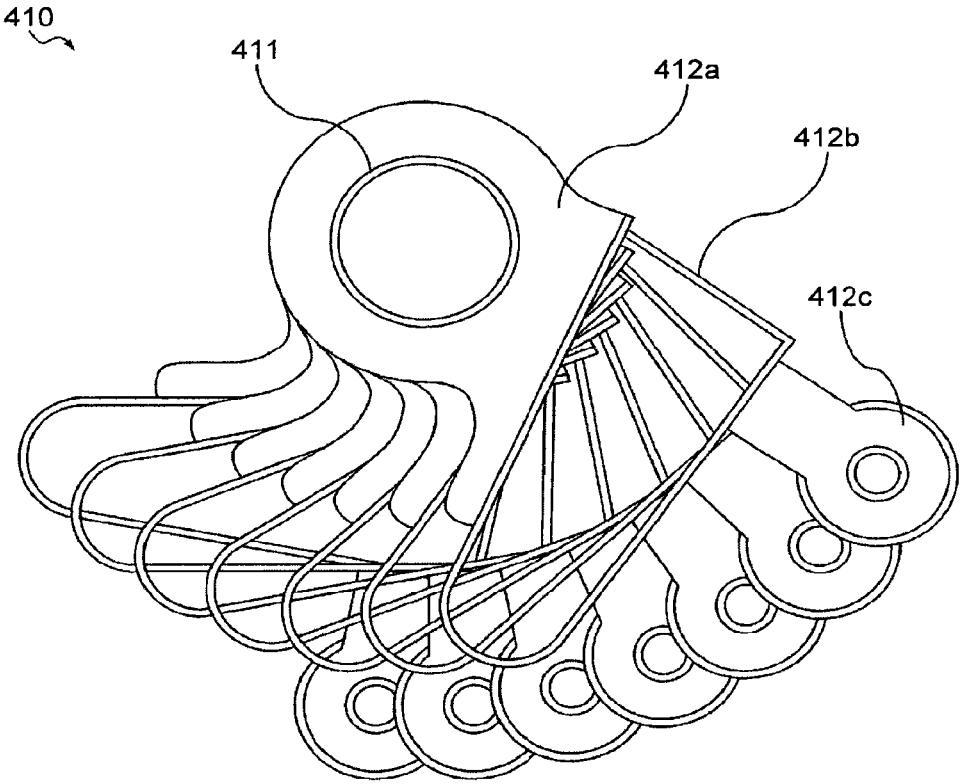
FIG. 16 is a side view of the fold-enhancing roller according to the embodiment viewed from the main scanning direction.

The following describes a third example of the structure of the fold-enhancing roller 410 according to the embodiment with reference to FIGS. 14 to 16. FIG. 14 is a perspective view of the fold-enhancing roller 410 according to the embodiment viewed from the obliquely upward side of the main scanning direction. FIG. 15 is a front view of the fold-enhancing roller 410 according to the embodiment viewed from the sub-scanning direction. FIG. 16 is a side view of the fold-enhancing roller 410 according to the embodiment viewed from the main scanning direction.

As the third example of the structure of the fold-enhancing roller 410 according to the embodiment, as illustrated in FIGS. 14 to 16, an even number of pressing force transmitting parts 412 are arranged at regular intervals around the fold-enhancing roller rotating shaft 411 in the main scanning direction with certain angle differences from each other in the rotational direction of the fold-enhancing roller rotating shaft 411 so that the pressing force transmitting parts 412 are symmetrically arranged with respect to the center of the fold-enhancing roller 410 in the main scanning direction.

Figure 17:
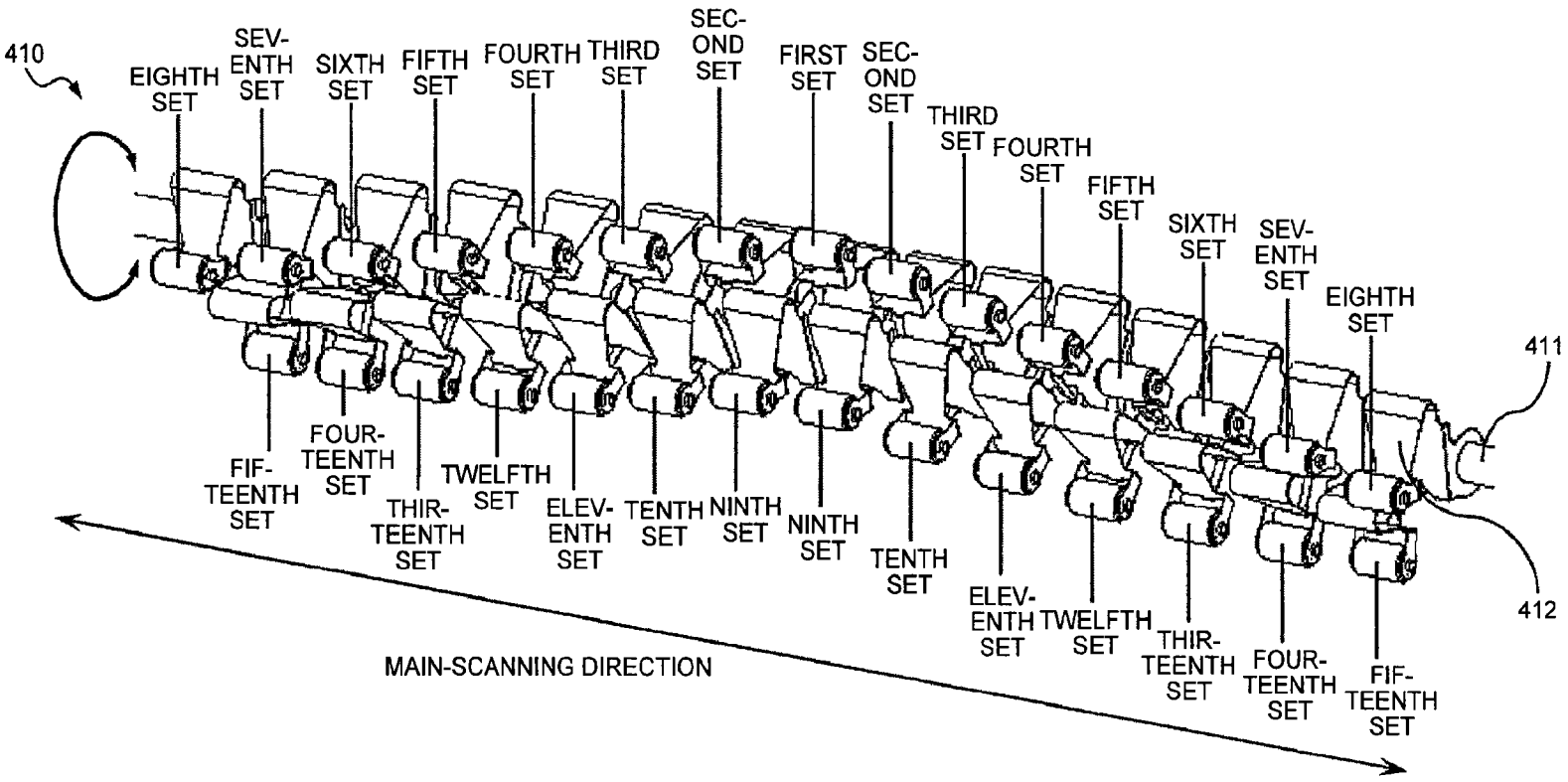
FIG. 17 is a perspective view of the fold-enhancing roller according to the embodiment viewed from the obliquely upward side of the main scanning direction.
Figure 18:
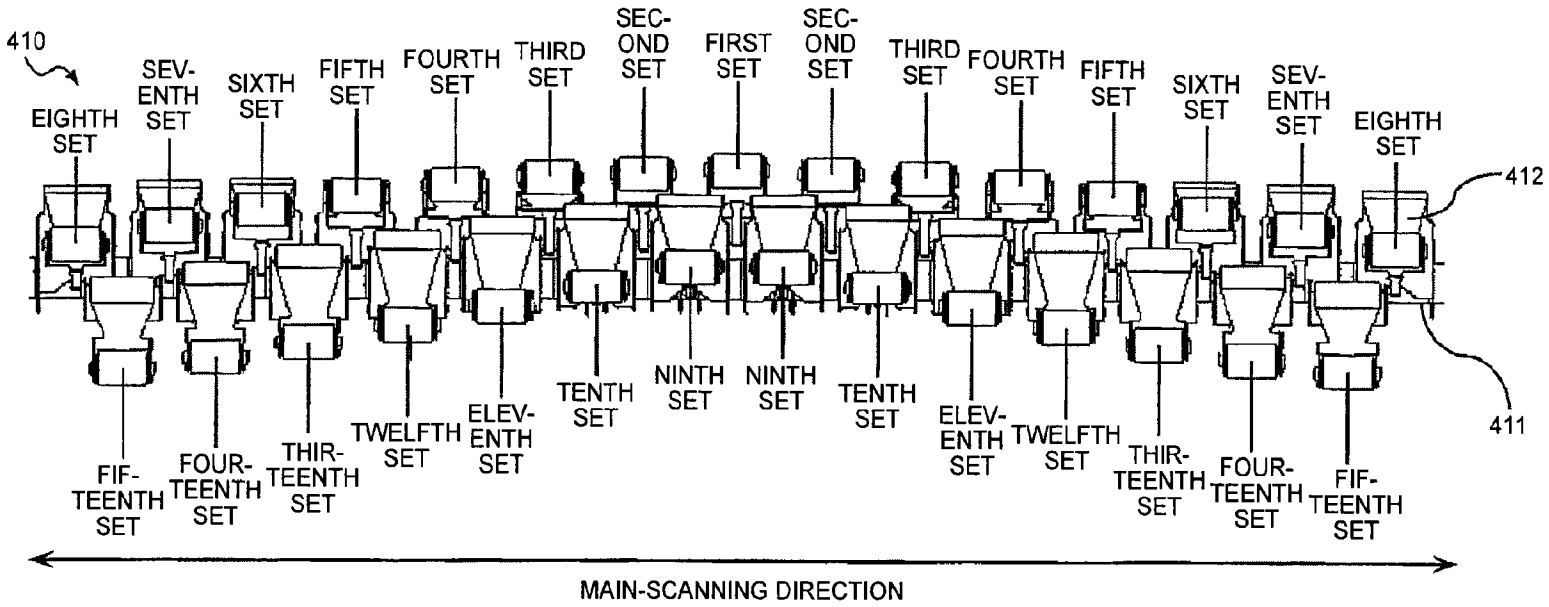
FIG. 18 is a front view of the fold-enhancing roller according to the embodiment viewed from the sub-scanning direction.
Figure 19:
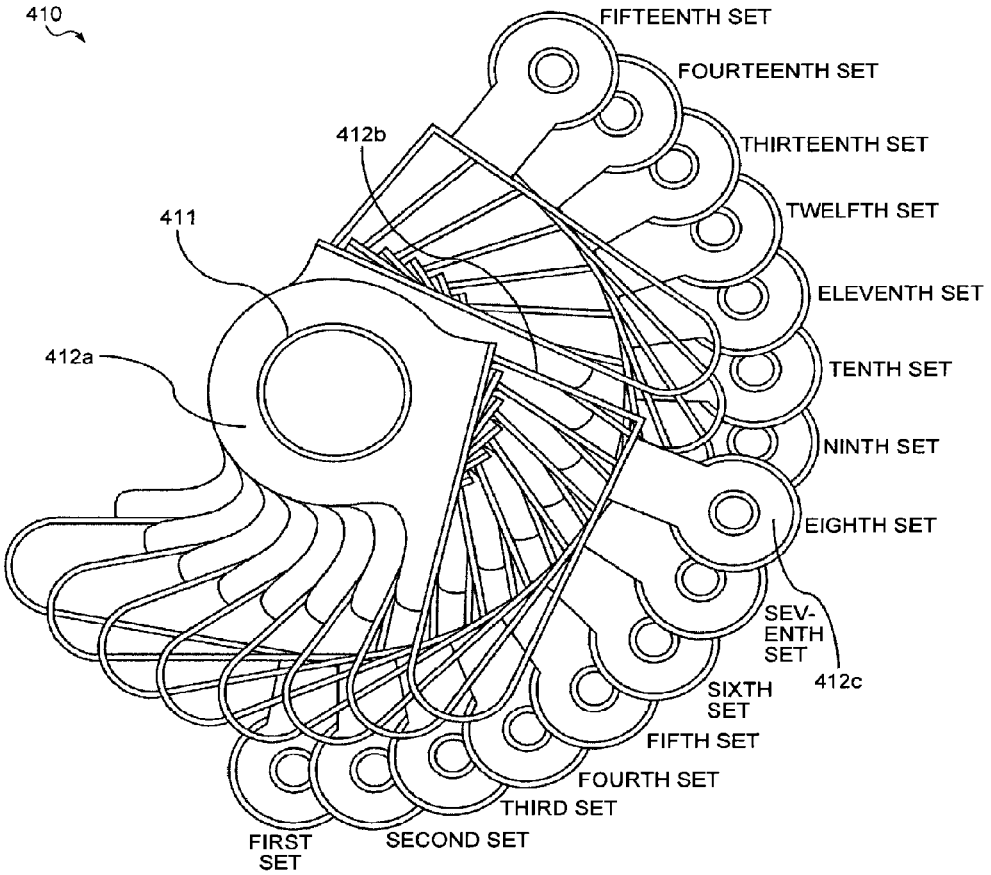
FIG. 19 is a side view of the fold-enhancing roller according to the embodiment viewed from the main scanning direction.

The following describes a fourth example of the structure of the fold-enhancing roller 410 according to the embodiment with reference to FIGS. 17 to 19. FIG. 17 is a perspective view of the fold-enhancing roller 410 according to the embodiment viewed from the obliquely upward side of the main scanning direction. FIG. 18 is a front view of the fold-enhancing roller 410 according to the embodiment viewed from the sub-scanning direction. FIG. 19 is a side view of the fold-enhancing roller 410 according to the embodiment viewed from the main scanning direction.

As the fourth example of the structure of the fold-enhancing roller 410 according to the embodiment, as illustrated in FIGS. 17 to 19, the arrangement mode of the pressing force transmitting parts 412 on the fold-enhancing roller rotating shaft illustrated in FIGS. 11 to 13 and the arrangement mode of the pressing force transmitting parts 412 on the fold-enhancing roller rotating shaft illustrated in FIGS. 14 to 16 are combined in a spiral manner with certain angle differences in the rotational direction of the fold-enhancing roller rotating shaft 411. When the fold-enhancing roller 410 according to the embodiment is configured as illustrated in FIGS. 17 to 19, the fold-enhancing roller 410 can press the fold without a gap in the main scanning direction, that is, press the entire fold formed on the sheet 6 without a gap.

When the fold-enhancing roller 410 according to the embodiment is configured as illustrated in FIGS. 11 to 13, FIGS. 14 to 16, and FIGS. 17 to 19, the fold-enhancing roller 410 can successively press the fold from the center toward both ends, so that a folding wrinkle can be prevented from being formed.

FIGS. 17 and 18 each illustrate two rows. Each of these rows is non-linear. Further, it is seen that based on the curvature and orientation of the rows, only one of these two rows contacts the sheet at any time.

Figure 20A:
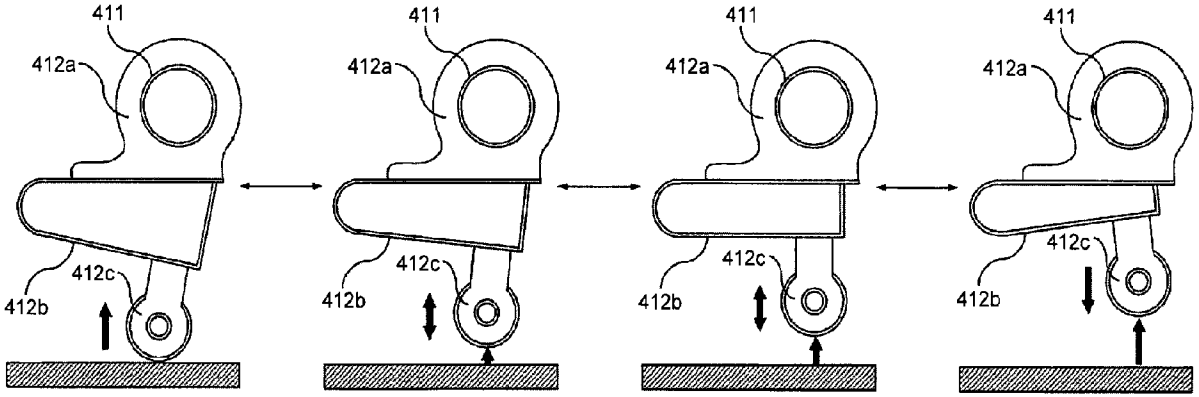
FIGS. 20A and 20B are diagrams illustrating a pressing force transmitting part according to the embodiment viewed from the main scanning direction in a state of being arranged on a fold-enhancing roller rotating shaft.
Figure 20B:
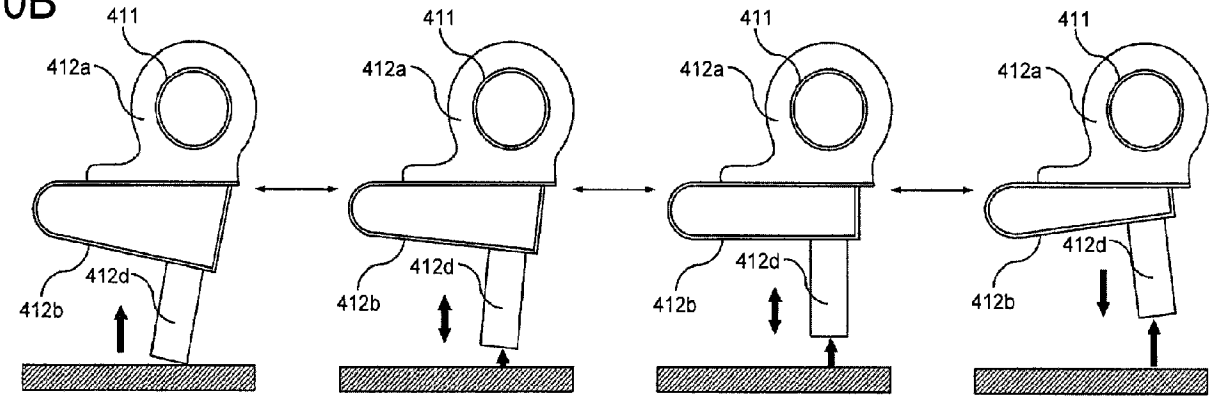

The following describes an example of the structure of the pressing force transmitting part 412 with reference to FIGS. 20A and 20B. FIGS. 20A and 20B are diagrams illustrating the pressing force transmitting part 412 according to the embodiment viewed from the main scanning direction in a state of being arranged on the fold-enhancing roller rotating shaft 411. As illustrated in FIG. 20A, the pressing force transmitting part 412 according to the embodiment includes a fixing part 412*a* for fixing the pressing force transmitting part 412 around the fold-enhancing roller rotating shaft 411, an elastic body 412*b* that is attached to the fixing part 412*a* and expands/contracts to generate an elastic force in an expanding/contracting direction, and a pressing roller 412*c* that is a rotating body that is attached to the elastic body 412*b* and rotates about an axis parallel to the main scanning direction.

The pressing force transmitting part 412 includes the elastic body 412*b* as described above because, if the elastic body 412*b* is a rigid body, the fold-enhancing roller 410 cannot rotate when any of the pressing force transmitting parts 412 abuts on the sheet supporting plate 420. That is, in the embodiment, the elastic body 412*b* functions as an elastic body, a physical shape of which is changed to generate an elastic force corresponding to the amount of the change.

FIG. 20A illustrates an example in which the elastic body 412*b* is a leaf spring. Alternatively, the elastic body 412*b* may be configured by utilizing elasticity of a compression spring, rubber, a sponge, plastic resin, and the like.

In fold-enhancing processing, the fold-enhancing processing unit 4 according to the embodiment causes the fold-enhancing roller 410 configured as described above to rotate about the fold-enhancing roller rotating shaft 411 as a rotation axis to successively press the fold formed on the sheet in the main scanning direction using each pressing force transmitting part 412 toward a direction in which the fold extends.

This is because, in the fold-enhancing roller 410 according to the embodiment, the pressing force transmitting parts 412 are arranged at regular intervals in the main scanning direction around the fold-enhancing roller rotating shaft 411 with certain angle differences from each other in the rotational direction of the fold-enhancing roller rotating shaft 411.

Accordingly, the pressing force of the fold-enhancing processing unit 4 according to the embodiment is not dispersed across the entire main scanning direction in fold-enhancing processing, and an intensive pressing force from each pressing force transmitting part 412 can be applied to the entire fold.

As illustrated in FIG. 20B, a simple pressing rod 412*d* may be attached to the elastic body 412*b* instead of the pressing roller 412*c* that is a rotating body. If the pressing force transmitting part 412 is thus configured, the pressing rod 412*d* may damage the sheet 6 in a pressing process, and an abutment part of the pressing rod 412*d* abutting on the sheet 6 may be severely worn. However, the above problem is relieved when the abutment part of the pressing rod 412*d* abutting on the sheet 6 is made smooth and is configured so that a frictional force of the abutment part abutting on the sheet 6 is made small.

The fold-enhancing processing unit 4 according to the embodiment causes the fold-enhancing roller 410 configured as described above to rotate about the fold-enhancing roller rotating shaft 411 as a rotation axis to successively press the fold formed in the main scanning direction using each pressing force transmitting part 412 in a direction in which the fold extends.

Accordingly, the fold-enhancing processing unit 4 according to the embodiment can intensively apply the pressing force of each pressing force transmitting part 412 to the entire fold in a short time. Due to this processing, the fold-enhancing processing unit 4 according to the embodiment can apply a sufficient pressing force to the fold while reducing a load on the fold-enhancing roller rotating shaft 411 without lowering productivity. Accordingly, a small, low-cost, highly productive fold-enhancing device can be provided.

Figure 21A:
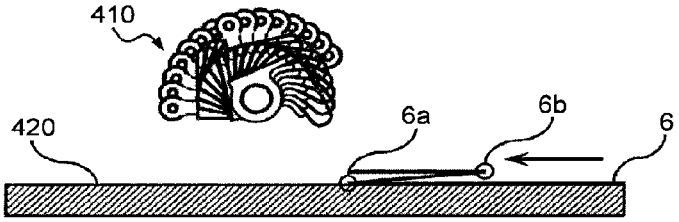
FIGS. 21A to 21E are sectional views illustrating only a mechanism related to fold-enhancing processing in the fold-enhancing processing unit viewed from the main scanning direction when the fold-enhancing processing unit according to the embodiment performs fold-enhancing processing.
Figure 21B:
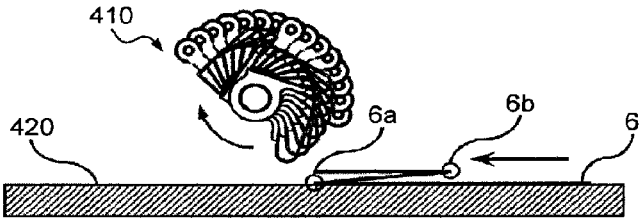
Figure 21C:
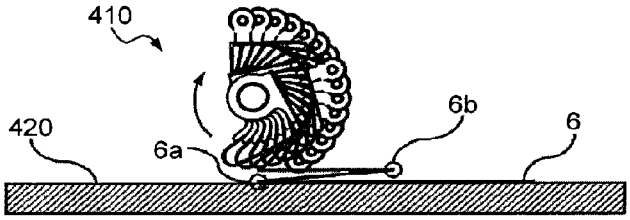
Figure 21D:
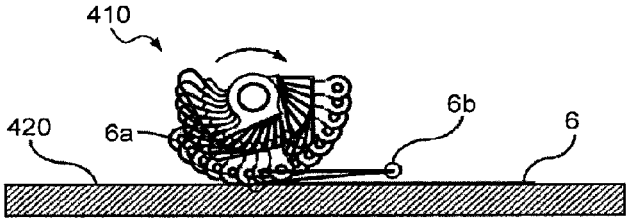
Figure 21E:
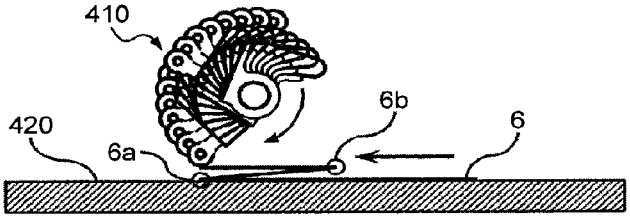
Figure 22A:
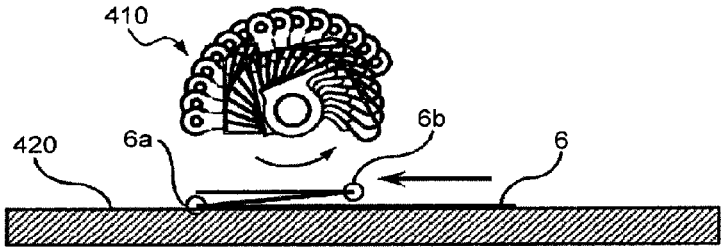
FIGS. 22A to 22D are sectional views illustrating only the mechanism related to fold-enhancing processing in the fold-enhancing processing unit viewed from the main scanning direction when the fold-enhancing processing unit according to the embodiment performs fold-enhancing processing.
Figure 22B:
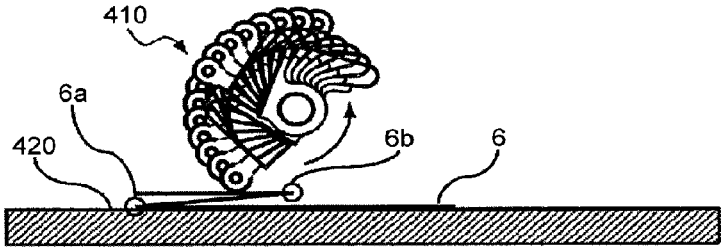
Figure 22C:
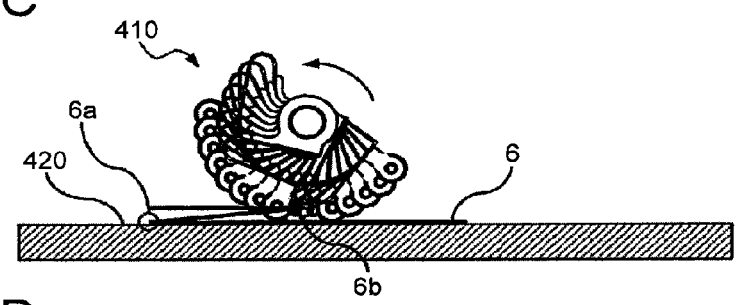
Figure 22D:
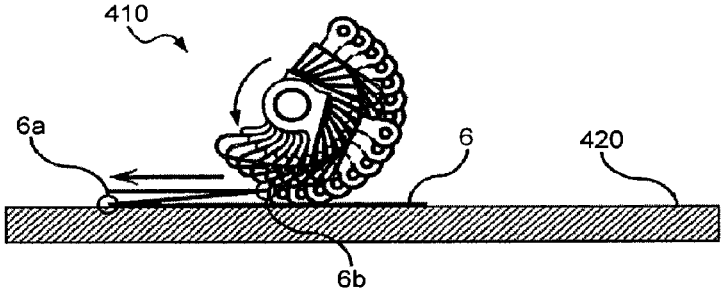
Figure 23:
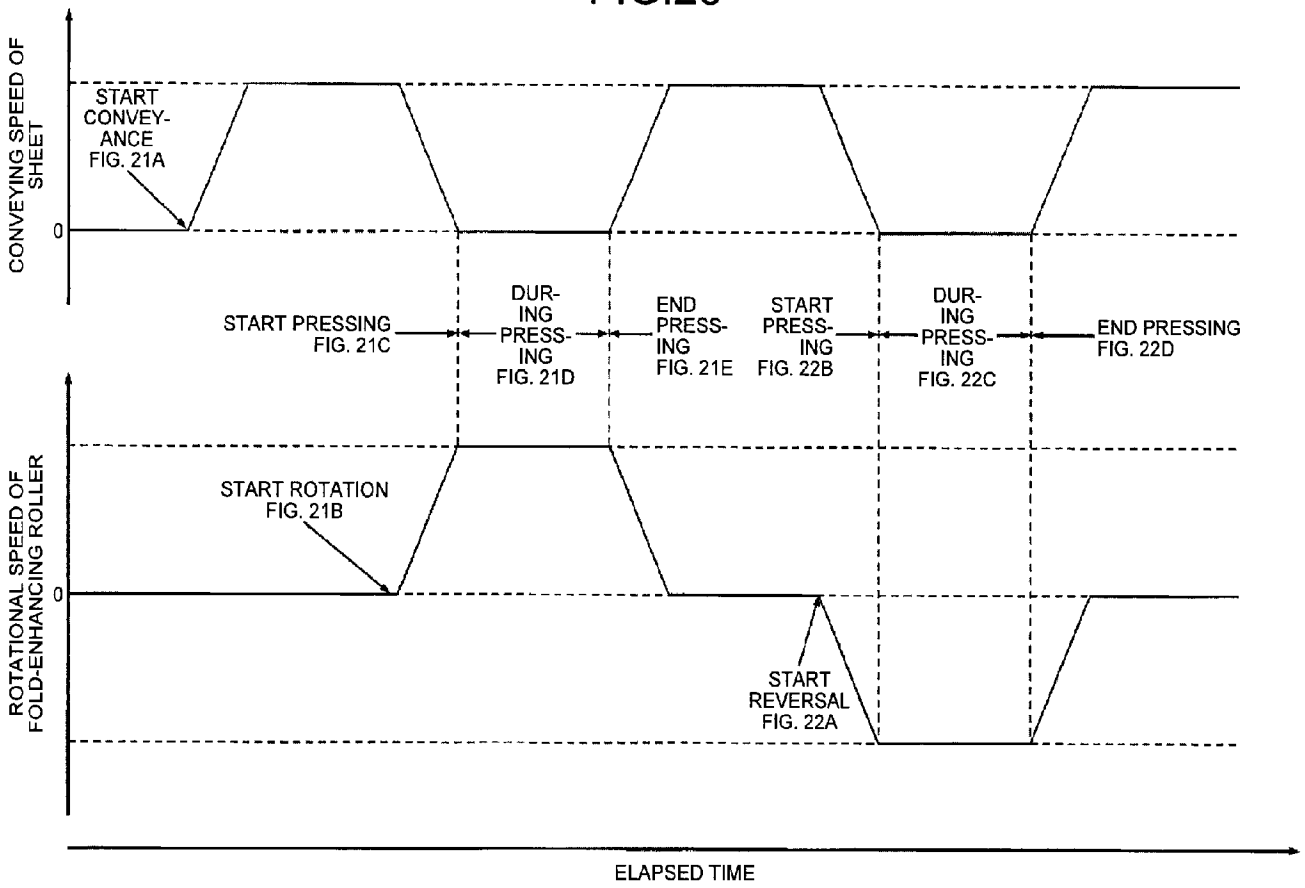
FIG. 23 is a diagram illustrating a temporal change in the conveying speed of a sheet and the rotational speed of the fold-enhancing roller when the fold-enhancing processing unit according to the embodiment performs fold-enhancing processing.

The following describes an operation example of fold-enhancing processing by the fold-enhancing processing unit 4 according to the embodiment with reference to FIGS. 21A to 23 in detail. FIGS. 21A to 22D are sectional views illustrating only a mechanism related to the fold-enhancing processing in the fold-enhancing processing unit 4 viewed from the main scanning direction when the fold-enhancing processing unit 4 according to the embodiment performs fold-enhancing processing. FIG. 23 is a diagram illustrating a temporal change in the conveying speed of a sheet 6 and the rotational speed of the fold-enhancing roller 410 when the fold-enhancing processing unit 4 according to the embodiment performs fold-enhancing processing. With reference to FIGS. 21A to 23, described is an example of performing fold-enhancing processing on the sheet 6 on which a Z-fold including a first fold 6*a* and a second fold 6*b* is formed. An operation of each operation part described below is controlled by the main control part 101 and the engine control part 102.

In the fold-enhancing processing unit 4 according to the embodiment, when the sheet 6 starts to be conveyed in the fold-enhancing processing unit 4 as illustrated in FIGS. 21A and 23, the fold-enhancing roller 410 calculates a timing when the fold-enhancing roller 410 abuts on the first fold 6*a* formed on the sheet 6, and starts rotating without waiting for a stop of the sheet 6, as illustrated in FIGS. 21B and 23. This configuration, in which the fold-enhancing processing unit 4 according to the embodiment starts the rotation of the fold-enhancing roller 410 without waiting for a stop of the sheet 6, shortens a time lag from when the fold-enhancing roller 410 starts rotating to when abutting on the sheet 6. Accordingly, the fold-enhancing processing unit 4 according to the embodiment can improve productivity.

In this process, in the fold-enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold-enhancing roller 410 to calculate the timing when the fold-enhancing roller 410 abuts on the first fold 6*a* formed on the sheet 6. Alternatively in this process, in the fold-enhancing processing unit 4, the main control part 101 and the engine control part 102 control each part based on the conveying speed of the sheet 6, the rotational speed of the fold-enhancing roller 410, and the sensor information input from the sensor 430 to calculate the timing when the fold-enhancing roller 410 abuts on the first fold 6*a* formed on the sheet 6.

As illustrated in FIGS. 21C and 23, the fold-enhancing processing unit 4 conveys the sheet 6 until the first fold 6*a* is positioned immediately below the fold-enhancing roller rotating shaft 411, before completely stopping conveying the sheet 6. When the fold-enhancing roller 410 starts to abut on the first fold 6*a* formed on the sheet 6, the fold-enhancing processing unit 4 starts to press the first fold 6*a*. As illustrated in FIGS. 21D and 23, the fold-enhancing processing unit 4 continues rotating the fold-enhancing roller 410 while stopping the sheet 6, to continue pressing the first fold 6*a* formed on the sheet 6.

Thereafter, as illustrated in FIGS. 21E and 23, the fold-enhancing processing unit 4 calculates a timing when the fold-enhancing roller 410 becomes separated from the sheet 6, and starts to convey the sheet 6 at the time when the fold-enhancing roller 410 becomes separated from the sheet 6 without waiting for a stop of the fold-enhancing roller 410. This configuration, in which the fold-enhancing processing unit 4 according to the embodiment starts to convey the sheet 6 at the time when the fold-enhancing roller 410 becomes separated from the sheet 6 without waiting for a stop of the fold-enhancing roller 410, shortens a time lag from when the fold-enhancing roller 410 becomes separated from the sheet 6 to when being completely stopped. Accordingly, the fold-enhancing processing unit 4 according to the embodiment can improve productivity.

In this process, in the fold-enhancing processing unit 4, the main control part 101 and the engine control part 102 control each part based on the rotational speed of the fold-enhancing roller 410 to calculate the timing when the fold-enhancing roller 410 becomes separated from the sheet 6.

Having conveyed the sheet 6 separated from the fold-enhancing roller 410, as illustrated in FIGS. 22A and 23, the fold-enhancing processing unit 4 calculates a timing when the fold-enhancing roller 410 abuts on the second fold 6*b* formed on the sheet 6, and starts to reverse the fold-enhancing roller 410 without waiting for a stop of the sheet 6. This configuration, in which the fold-enhancing processing unit 4 according to the embodiment starts to reverse the fold-enhancing roller 410 without waiting for a stop of the sheet 6, shortens a time lag from when the fold-enhancing roller 410 starts rotating to when abutting on the sheet 6 similarly to FIG. 21B. Accordingly, the fold-enhancing processing unit 4 according to the embodiment can improve productivity.

In this process, in the fold-enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold-enhancing roller 410 to calculate the timing when the fold-enhancing roller 410 abuts on the second fold 6*b* formed on the sheet 6. Alternatively in this process, in the fold-enhancing processing unit 4, the main control part 101 and the engine control part 102 control each part based on the conveying speed of the sheet 6, the rotational speed of the fold-enhancing roller 410, and the sensor information input from the sensor 430 to calculate the timing when the fold-enhancing roller 410 abuts on the second fold 6*b* formed on the sheet 6.

As illustrated in FIGS. 22B and 23, the fold-enhancing processing unit 4 conveys the sheet 6 until the first fold 6*b* is positioned immediately below the fold-enhancing roller rotating shaft 411, before completely stopping conveying the sheet 6. When the fold-enhancing roller 410 starts to abut on the first fold 6*b* formed on the sheet 6, the fold-enhancing processing unit 4 starts to press the first fold 6*a*. As illustrated in FIGS. 22C and 23, the fold-enhancing processing unit 4 continues rotating the fold-enhancing roller 410 while stopping the sheet 6, to continue pressing the first fold 6*a* formed on the sheet 6.

Thereafter, as illustrated in FIGS. 22D and 23, the fold-enhancing processing unit 4 calculates the timing when the fold-enhancing roller 410 becomes separated from the sheet 6, and starts to convey the sheet 6 at the time when the fold-enhancing roller 410 becomes separated from the sheet 6. This configuration, in which the fold-enhancing processing unit 4 according to the embodiment starts to convey the sheet 6 at the time when the fold-enhancing roller 410 becomes separated from the sheet 6 without waiting for a stop of the fold-enhancing roller 410, shortens a time lag from when the fold-enhancing roller 410 becomes separated from the sheet 6 to when being completely stopped similarly to FIG. 21E. Accordingly, the fold-enhancing processing unit 4 according to the embodiment can improve productivity.

In this process, in the fold-enhancing processing unit 4, the main control part 101 and the engine control part 102 control each part based on the rotational speed of the fold-enhancing roller 410 to calculate the timing when the fold-enhancing roller 410 becomes separated from the sheet 6.

The fold-enhancing processing unit 4 then conveys the sheet 6 separated from the fold-enhancing roller 410 to end the fold-enhancing processing.

If the fold-enhancing roller 410 rotates in a direction opposite to that in the example illustrated in FIGS. 21A to 23, the fold-enhancing roller 410 first collides against the sheet supporting plate 420 at the timing corresponding to FIG. 21C before abutting on the sheet 6. Accordingly, if the fold-enhancing roller 410 rotates in the direction opposite to that in the example illustrated in FIGS. 21A to 23, collision sound between the fold-enhancing roller 410 and the sheet supporting plate 420 is generated in the fold-enhancing processing unit 4.

On the other hand, in the example illustrated in FIGS. 21A to 23, the fold-enhancing roller 410 abuts only on the sheet 6, and indirectly collides against the sheet supporting plate 420 via the sheet 6. Accordingly, in the example illustrated in FIGS. 21A to 23, the sheet 6 functions as a buffer between the fold-enhancing roller 410 and the sheet supporting plate 420, so that the collision sound as described above can be suppressed. In particular, such an effect can be easily obtained as the number of folding processes of the sheet 6 increases. This is because the number of overlaps of the sheet 6 increases as the number of folding processes of the sheet 6 increases, so that the thickness of the sheet 6 increases thereby enhancing this buffer effect.

If the fold-enhancing roller 410 rotates in the direction opposite to that in the example illustrated in FIGS. 21A to 23, the fold-enhancing roller 410 first collides against the sheet supporting plate 420 at the timing corresponding to FIG. 21C before abutting on the sheet 6. In this case, the fold-enhancing roller 410 abuts on an opening part formed on an upper part of the first fold 6*a*. Accordingly, when the fold-enhancing roller 410 rotates in the direction opposite to that in the example illustrated in FIGS. 21A to 23, a folding wrinkle may be formed on the sheet 6. In particular, such a problem tends to be significantly caused as the number of folding processes of the sheet 6 increases. This is because the number of overlaps of the sheet increases as the number of folding processes of the sheet 6 increases, so that the thickness of the sheet increases.

On the other hand, in the example illustrated in FIGS. 21A to 23, the fold-enhancing roller 410 abuts on the sheet 6 from the opposite side of the opening part formed on the upper part of the first fold 6*a*. Accordingly, in the example illustrated in FIGS. 21A to 23, a folding wrinkle is not formed on the sheet 6 regardless of the number of folding processes of the sheet 6. Such an effect is also achieved at the timing corresponding to FIG. 22B.

In this way, the fold-enhancing processing unit 4 according to the embodiment can suppress the collision sound and prevent a folding wrinkle from being formed by changing the rotational direction of the fold-enhancing roller 410 depending on a paper type or the thickness of the sheet 6, and the shape, the folding method, the number of folding processes, the position of the fold, and the like of the folded sheet 6.

Figure 24A:
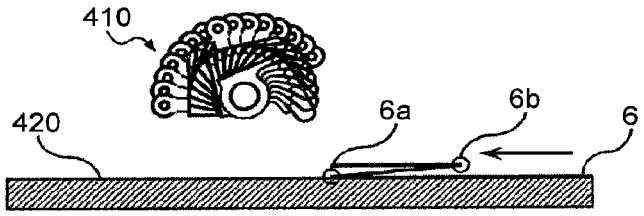
FIGS. 24A to 24F are sectional views illustrating only the mechanism related to fold-enhancing processing in the fold-enhancing processing unit viewed from the main scanning direction when the fold-enhancing processing unit according to the embodiment performs fold-enhancing processing.
Figure 24B:
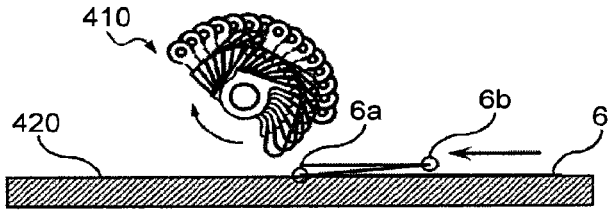
Figure 24C:
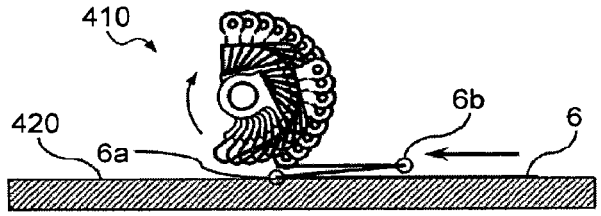
Figure 24D:
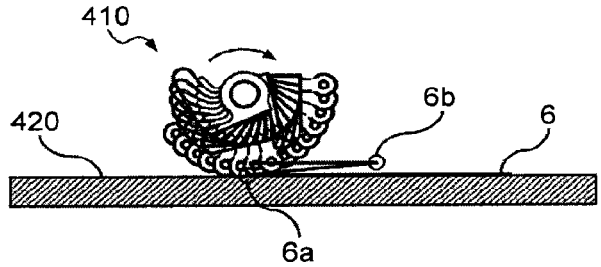
Figure 24E:
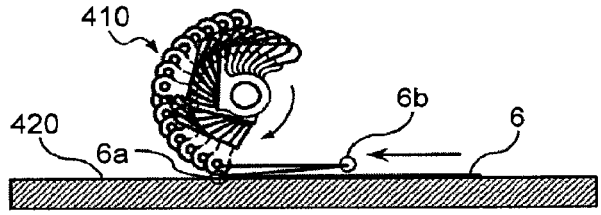
Figure 24F:
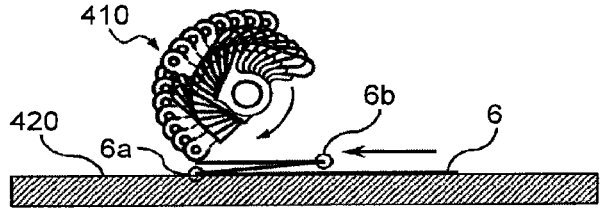
Figure 25A:
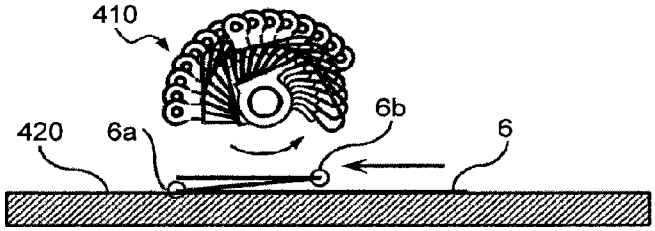
FIGS. 25A to 25E are sectional views illustrating only the mechanism related to fold-enhancing processing in the fold-enhancing processing unit viewed from the main scanning direction when the fold-enhancing processing unit according to the embodiment performs fold-enhancing processing.
Figure 25B:
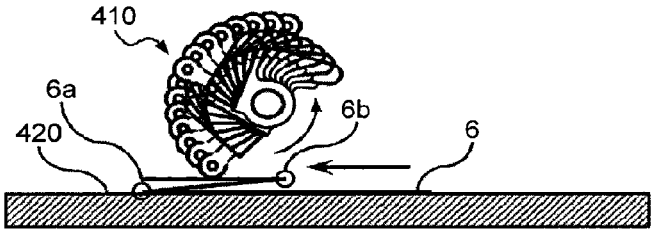
Figure 25C:
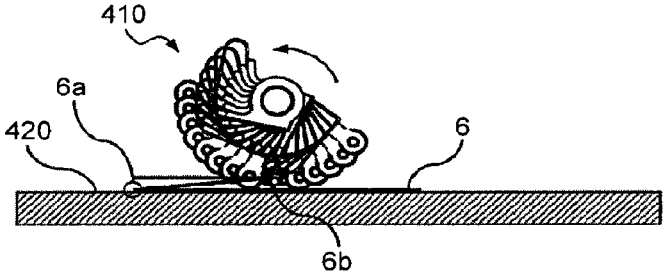
Figure 25D:
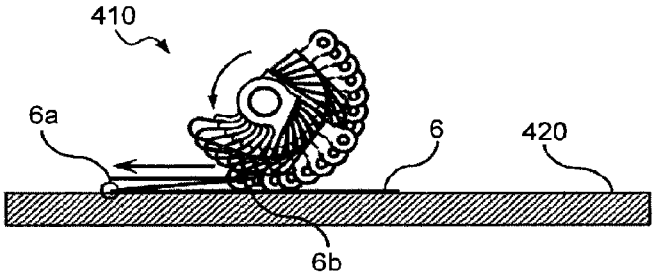
Figure 25E:
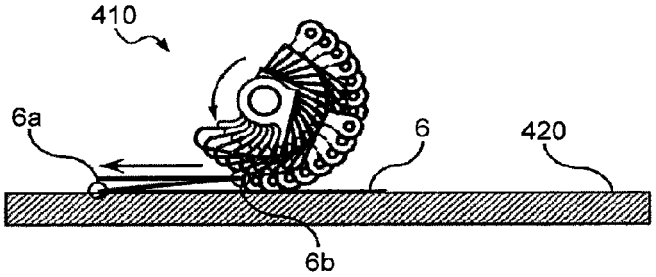
Figure 26:
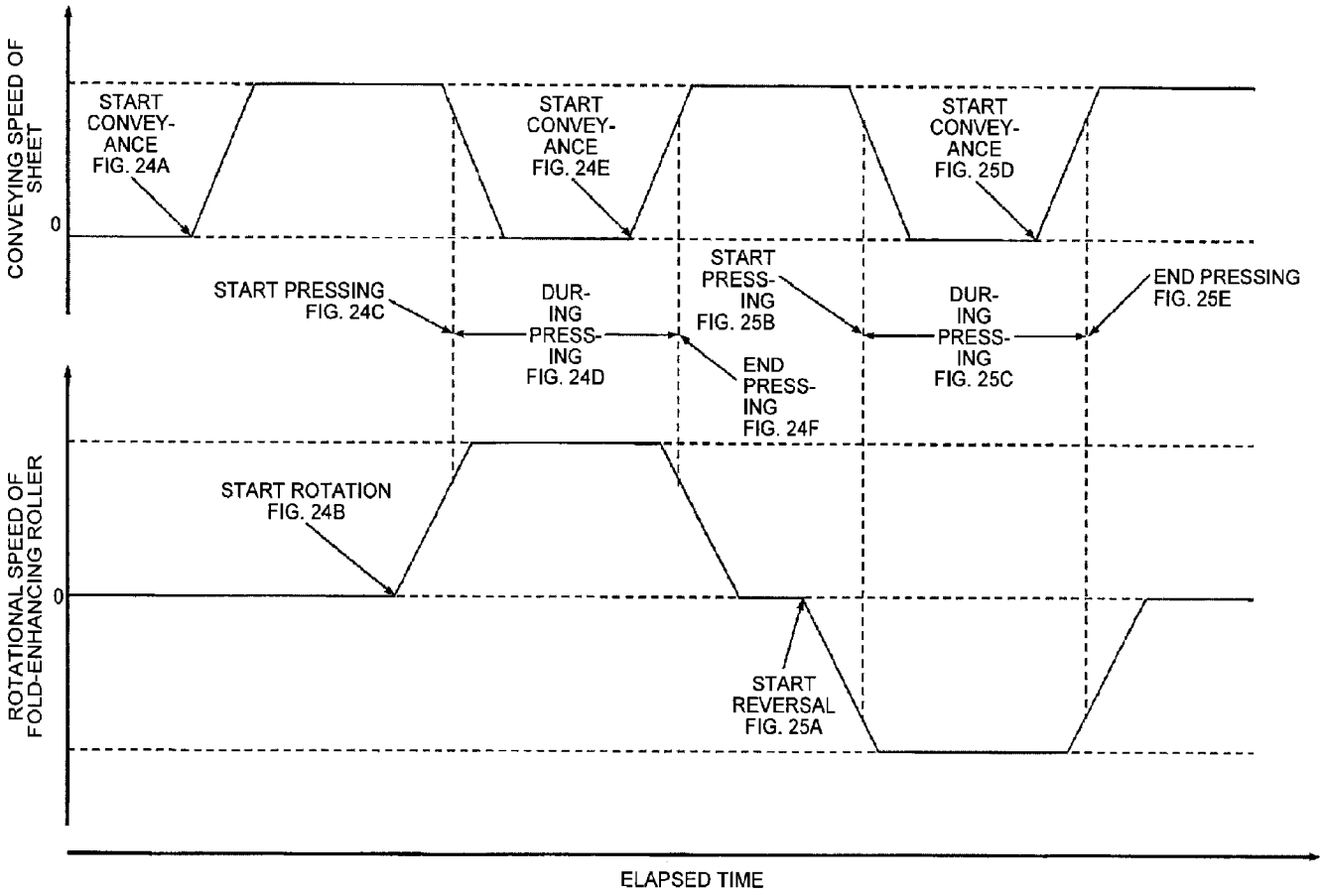
FIG. 26 is a diagram illustrating a temporal change in the conveying speed of the sheet and the rotational speed of the fold-enhancing roller when the fold-enhancing processing unit according to the embodiment performs fold-enhancing processing.

The following describes another operation example of fold-enhancing processing by the fold-enhancing processing unit 4 according to the embodiment with reference to FIGS. 24A to 26 in detail. FIGS. 24A to 25E are sectional views illustrating only the mechanism related to fold-enhancing processing in the fold-enhancing processing unit 4 viewed from the main scanning direction when the fold-enhancing processing unit 4 according to the embodiment performs fold-enhancing processing. FIG. 26 is a diagram illustrating a temporal change in the conveying speed of the sheet 6 and the rotational speed of the fold-enhancing roller 410 when the fold-enhancing processing unit 4 according to the embodiment performs fold-enhancing processing. With reference to FIGS. 24A to 26, described is an example of performing fold-enhancing processing on the sheet 6 on which a Z-fold including the first fold 6*a* and the second fold 6*b* is formed. An operation of each operation part described below is controlled by the main control part 101 and the engine control part 102.

As illustrated in FIGS. 24A and 26, when starting to convey the sheet 6, the fold-enhancing processing unit 4 according to the embodiment calculates the timing when the fold-enhancing roller 410 abuts on the first fold 6*a* formed on the sheet 6 as illustrated in FIGS. 24B and 26, and starts to rotate the fold-enhancing roller 410 without waiting for a stop of the sheet 6. This configuration, in which the fold-enhancing processing unit 4 according to the embodiment starts to rotate the fold-enhancing roller 410 without waiting for a stop of the sheet 6, shortens a time lag from when the fold-enhancing roller 410 starts rotating to when abutting on the sheet 6. Accordingly, the fold-enhancing processing unit 4 according to the embodiment can improve productivity.

In this process, in the fold-enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold-enhancing roller 410 to calculate the timing when the fold-enhancing roller 410 abuts on the first fold 6*a* formed on the sheet 6. Alternatively in this process, in the fold-enhancing processing unit 4, the main control part 101 and the engine control part 102 control each part based on the conveying speed of the sheet 6, the rotational speed of the fold-enhancing roller 410, and the sensor information input from the sensor 430 to calculate the timing when the fold-enhancing roller 410 abuts on the first fold 6*a* formed on the sheet 6.

As illustrated in FIGS. 24C and 26, the fold-enhancing processing unit 4 starts to press the first fold 6*a* when the fold-enhancing roller 410 starts to abut on the first fold 6*a* formed on the sheet 6. As illustrated in FIGS. 24D and 26, the fold-enhancing processing unit 4 conveys the sheet 6 until the first fold 6*a* is positioned immediately below the fold-enhancing roller rotating shaft 411, completely stops conveying the sheet 6, and continues rotating the fold-enhancing roller 410 to continue pressing the first fold 6*a* formed on the sheet 6.

Thereafter, as illustrated in FIGS. 24E and 26, the fold-enhancing processing unit 4 calculates the timing when the fold-enhancing roller 410 becomes separated from the sheet 6, and starts to convey the sheet 6 without waiting for a stop of the fold-enhancing roller 410. This configuration, in which the fold-enhancing processing unit 4 according to the embodiment starts to convey the sheet 6 without waiting for a stop of the fold-enhancing roller 410, shortens a time lag from when the fold-enhancing roller 410 becomes separated from the sheet 6 to when being completely stopped. Accordingly, the fold-enhancing processing unit 4 according to the embodiment can improve productivity.

In this process, in the fold-enhancing processing unit 4, the main control part 101 and the engine control part 102 control each part based on the rotational speed of the fold-enhancing roller 410 to calculate the timing when the fold-enhancing roller 410 becomes separated from the sheet 6.

As illustrated in FIGS. 24E and 26, the sheet 6 can start to be conveyed while being pressed, only when the sheet 6 is conveyed with a conveyance belt (not illustrated) that moves in the same direction as the rotational direction of the fold-enhancing roller 410 in synchronization with the rotation thereof. This is because the sheet 6 is pressed against the sheet supporting plate 420 when the fold-enhancing roller 410 presses the sheet 6, and thus the sheet 6 may be torn due to friction with the sheet supporting plate 420 without using the conveyance belt moving in the same direction as the rotational direction of the fold-enhancing roller 410.

As illustrated in FIGS. 24F and 26, having conveyed the sheet 6 separated from the fold-enhancing roller 410, the fold-enhancing processing unit 4 calculates the timing when the fold-enhancing roller 410 abuts on the second fold 6*b* formed on the sheet 6 as illustrated in FIGS. 25A and 26, and starts to reverse the fold-enhancing roller 410 without waiting for a stop of the sheet 6. This configuration, in which the fold-enhancing processing unit 4 according to the embodiment starts to reverse the fold-enhancing roller 410 without waiting for a stop of the sheet 6, shortens a time lag from when the fold-enhancing roller 410 starts rotating to when abutting on the sheet 6 similarly to FIG. 24B. Accordingly, the fold-enhancing processing unit 4 according to the embodiment can improve productivity.

In this process, in the fold-enhancing processing unit 4, the main control part 101 and the engine control part 102 control each part based on the folding information about the folding method in the folding processing unit 3, the sheet information about the size of the sheet 6, the conveying speed of the sheet 6, and the rotational speed of the fold-enhancing roller 410 to calculate the timing when the fold-enhancing roller 410 abuts on the second fold 6*b* formed on the sheet 6. Alternatively in this process, in the fold-enhancing processing unit 4, the main control part 101 and the engine control part 102 control each part based on the conveying speed of the sheet 6, the rotational speed of the fold-enhancing roller 410, and the sensor information input from the sensor 430 to calculate the timing when the fold-enhancing roller 410 abuts on the second fold 6*b* formed on the sheet 6.

As illustrated in FIGS. 25B and 26, the fold-enhancing processing unit 4 starts to press the second fold 6*b* when the fold-enhancing roller 410 starts to abut on the second fold 6*b* formed on the sheet 6. As illustrated in FIGS. 25C and 26, the fold-enhancing processing unit 4 conveys the sheet 6 until the second fold 6*b* is positioned immediately below the fold-enhancing roller rotating shaft 411, completely stops conveying the sheet 6, and continues rotating the fold-enhancing roller 410 to continue pressing the second fold 6*b* formed on the sheet 6.

Thereafter, as illustrated in FIGS. 25D and 26, the fold-enhancing processing unit 4 calculates the timing when the fold-enhancing roller 410 becomes separated from the sheet 6, and starts to convey the sheet 6 without waiting for a stop of the fold-enhancing roller 410. This configuration, in which the fold-enhancing processing unit 4 according to the embodiment starts to convey the sheet 6 without waiting for a stop of the fold-enhancing roller 410, shortens a time lag from when the fold-enhancing roller 410 becomes separated from the sheet 6 to when being completely stopped similarly to FIG. 24E. Accordingly, the fold-enhancing processing unit 4 according to the embodiment can improve productivity.

In this process, in the fold-enhancing processing unit 4, the main control part 101 and the engine control part 102 control each part based on the rotational speed of the fold-enhancing roller 410 to calculate the timing when the fold-enhancing roller 410 becomes separated from the sheet 6.

As illustrated in FIGS. 25D and 26, similarly to FIG. 24E, the sheet 6 can start to be conveyed while being pressed, only when the sheet 6 is conveyed with a conveyance belt (not illustrated) that moves in the same direction as the rotational direction of the fold-enhancing roller 410 in synchronization with the rotation thereof. This is because the sheet 6 is pressed against the sheet supporting plate 420 when the fold-enhancing roller 410 presses the sheet 6, and thus the sheet 6 may be torn due to friction with the sheet supporting plate 420 unless using the conveyance belt moving in the same direction as the rotational direction of the fold-enhancing roller 410.

As illustrated in FIGS. 25E and 26, the fold-enhancing processing unit 4 then conveys the sheet 6 separated from the fold-enhancing roller 410 to end the fold-enhancing processing. In this way, the fold-enhancing processing unit 4 according to the embodiment can start fold-enhancing processing even when the sheet is being conveyed, and can start to convey the sheet even when the fold-enhancing processing is not completed. Accordingly, the fold-enhancing processing unit 4 according to the embodiment can further improve productivity.

The following describes another method for suppressing a collision sound between the fold-enhancing roller 410 and the sheet supporting plate 420 with reference to FIGS. 27A to 31. FIGS. 27A to 31 each illustrate the method for suppressing the collision sound between the fold-enhancing roller 410 and the sheet supporting plate 420 in the fold-enhancing processing unit 4 according to the embodiment. An operation of each operation part described below is controlled by the main control part 101 and the engine control part 102.

Figure 27A:
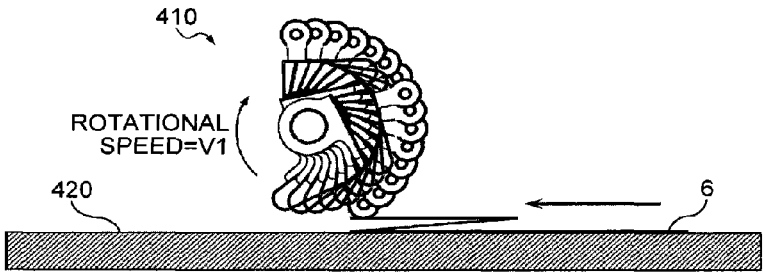
FIGS. 27A to 27C are diagrams for explaining a method for suppressing a collision sound between the fold-enhancing roller and a sheet supporting plate in the fold-enhancing processing unit according to the embodiment.
Figure 27B:
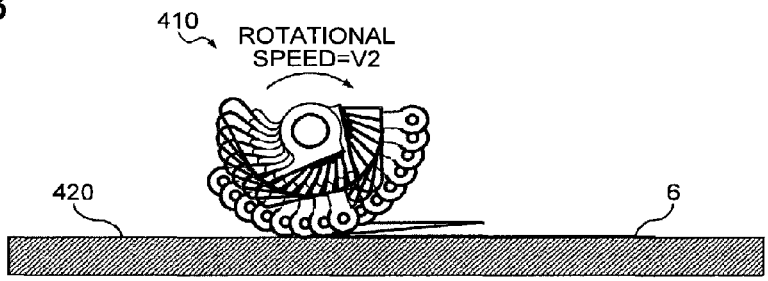
Figure 27C:
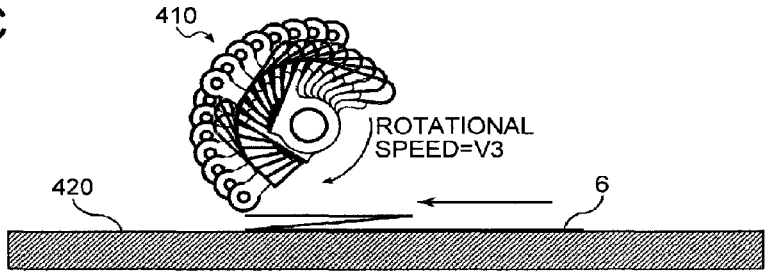

In the first method for suppressing the collision sound between the fold-enhancing roller 410 and the sheet supporting plate 420, the fold-enhancing processing unit 4 according to the embodiment changes the rotational speed of the fold-enhancing roller 410 depending on situations so that V1<V2 and V1<V3 are satisfied. Herein, V1 represents the rotational speed of the fold-enhancing roller 410 at the time when the fold-enhancing roller 410 abuts on the sheet 6 as illustrated in FIG. 27A, V2 represents the rotational speed of the fold-enhancing roller 410 when the fold-enhancing roller 410 presses the sheet 6 as illustrated in FIG. 27B, and V3 represents the rotational speed of the fold-enhancing roller 410 when the fold-enhancing roller 410 does not abut on the sheet 6 nor press the sheet 6 as illustrated in FIG. 27C. The fold-enhancing processing unit 4 according to the embodiment determines the state of the fold-enhancing roller 410 based on the rotation angle of the fold-enhancing roller rotating shaft 411.

In this way, the fold-enhancing processing unit 4 according to the embodiment causes the rotational speed of the fold-enhancing roller 410 at the time when the fold-enhancing roller 410 abuts on the sheet 6 to be lower than the rotational speed of the fold-enhancing roller 410 in the other situations. This configuration can suppress the collision sound between the fold-enhancing roller 410 and the sheet supporting plate 420.

By changing the rotational speed of the fold-enhancing roller 410 depending on situations so that V1<V3<V2, the fold-enhancing processing unit 4 according to the embodiment can improve productivity, suppress the collision sound, and achieve the fold-enhancing effect at the same time.

That is, the fold-enhancing processing unit 4 according to the embodiment controls the rotational speed V1 of the fold-enhancing roller 410 at the time when the fold-enhancing roller 410 abuts on the sheet 6 to be the lowest to suppress the collision sound between the fold-enhancing roller 410 and the sheet supporting plate 420. On the other hand, to improve productivity, the fold-enhancing processing unit 4 according to the embodiment controls the rotational speed V3 of the fold-enhancing roller 410 when the fold-enhancing roller 410 does not abut on the sheet 6 nor press the sheet 6 to be the highest.

The fold-enhancing processing unit 4 according to the embodiment controls the rotational speed V2 of the fold-enhancing roller 410 when the fold-enhancing roller 410 presses the sheet 6 to be between V1 and V3 to firmly press the fold without reducing productivity. In this way, by changing the rotational speed of the fold-enhancing roller 410 depending on situations so that V1<V3<V2, the fold-enhancing processing unit 4 according to the embodiment can improve productivity, suppress the collision sound, and achieve the fold-enhancing effect at the same time.

Figure 28A:
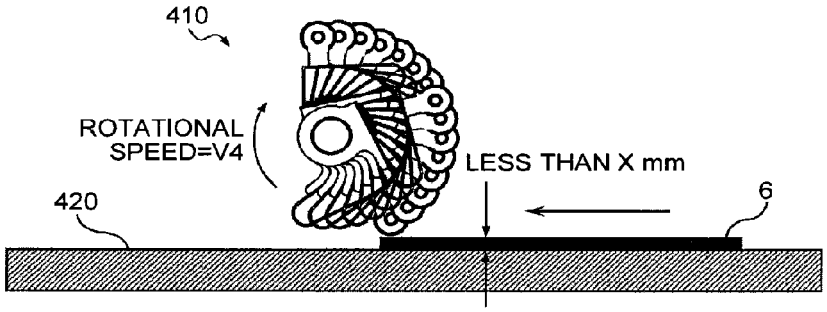
FIGS. 28A and 28B are diagrams for explaining a method for suppressing the collision sound between the fold-enhancing roller and the sheet supporting plate in the fold-enhancing processing unit according to the embodiment.
Figure 28B:
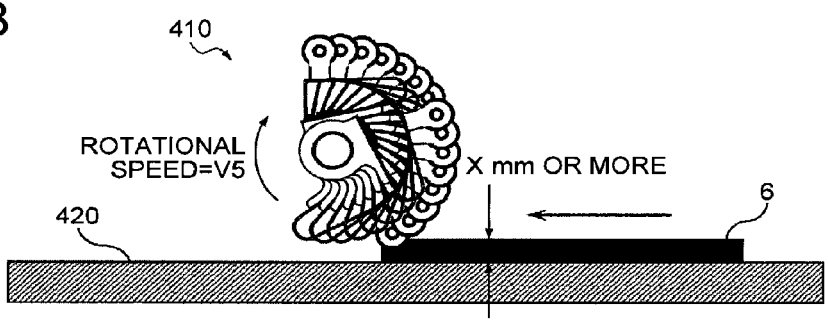

In the second method for suppressing the collision sound between the fold-enhancing roller 410 and the sheet supporting plate 420, the fold-enhancing processing unit 4 according to the embodiment changes the rotational speed of the fold-enhancing roller 410 at the time when the fold-enhancing roller 410 abuts on the sheet 6 depending on the thickness of the sheet 6 to be pressed so that V4<V5 is satisfied. Herein, V4 represents the rotational speed of the fold-enhancing roller 410 at the time when the fold-enhancing roller 410 abuts on the sheet 6 having a thickness less than X mm as illustrated in FIG. 28A, and V5 represents the rotational speed of the fold-enhancing roller 410 at the time when the fold-enhancing roller 410 abuts on the sheet 6 having a thickness equal to or larger than X mm as illustrated in FIG. 28B. The fold-enhancing processing unit 4 according to the embodiment acquires sheet information about the thickness of the sheet 6 through a user operation on the display panel 180 or with a sensor (not illustrated) for measuring the thickness of the sheet 6.

In this way, by changing the rotational speed of the fold-enhancing roller 410 at the time when the fold-enhancing roller 410 abuts on the sheet 6 depending on the thickness of the sheet 6 to be pressed, the fold-enhancing processing unit 4 according to the embodiment can suppress the collision sound between the fold-enhancing roller 410 and the sheet supporting plate 420.

That is, by controlling the rotational speed of the fold-enhancing roller 410 at the time when the fold-enhancing roller 410 abuts on the sheet 6 so that the rotational speed in pressing a thin sheet is lower than that in pressing a thick sheet, the fold-enhancing processing unit 4 according to the embodiment can suppress the collision sound between the fold-enhancing roller 410 and the sheet supporting plate 420. This is because a buffer effect of the thick sheet is larger than that of the thin sheet.

Figure 29A:
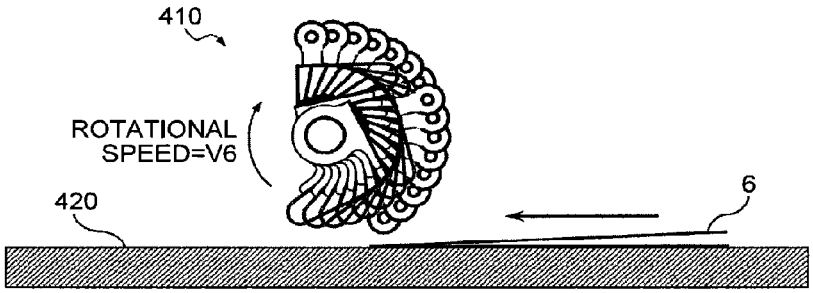
FIGS. 29A and 29B are diagrams for explaining a method for suppressing the collision sound between the fold-enhancing roller and the sheet supporting plate in the fold-enhancing processing unit according to the embodiment.
Figure 29B:
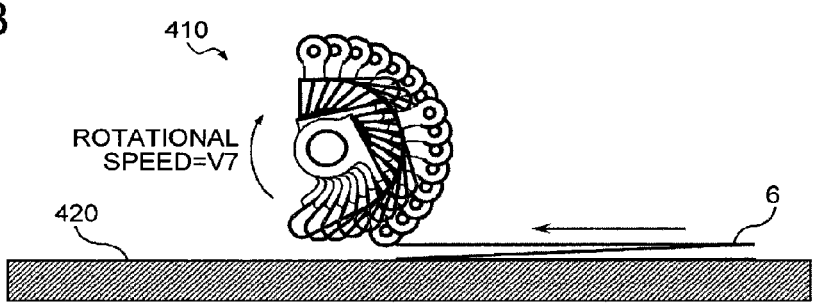

In the third method for suppressing the collision sound between the fold-enhancing roller 410 and the sheet supporting plate 420, the fold-enhancing processing unit 4 according to the embodiment changes the rotational speed of the fold-enhancing roller 410 at the time when the fold-enhancing roller 410 abuts on the sheet 6 depending on the number of folding processes of the sheet 6 to be pressed so that V6<V7 is satisfied. Herein, V6 represents the rotational speed of the fold-enhancing roller 410 at the time when the fold-enhancing roller 410 abuts on a two-folded sheet 6 as illustrated in FIG. 29A, and V7 represents the rotational speed of the fold-enhancing roller 410 at the time when the fold-enhancing roller 410 abuts on the three-folded sheet 6 as illustrated in FIG. 29B. The fold-enhancing processing unit 4 according to the embodiment acquires folding information about the number of folding processes of the sheet 6 from the folding processing unit 3.

In this way, by changing the rotational speed of the fold-enhancing roller 410 at the time when the fold-enhancing roller 410 abuts on the sheet 6 depending on the number of folding processes of the sheet 6 to be pressed, the fold-enhancing processing unit 4 according to the embodiment can suppress the collision sound between the fold-enhancing roller 410 and the sheet supporting plate 420.

That is, by controlling the rotational speed of the fold-enhancing roller 410 at the time when the fold-enhancing roller 410 abuts on the sheet 6 so that the rotational speed in pressing a sheet the number of folding processes of which is small is smaller than that in pressing a sheet the number of folding processes of which is large, the fold-enhancing processing unit 4 according to the embodiment can suppress the collision sound between the fold-enhancing roller 410 and the sheet supporting plate 420. This is because the number of overlaps of the sheet increases as the number of folding processes of the sheet increases, so that the thickness of the sheet increases, and thus a buffer effect is more enhanced than that of the sheet the number of folding processes of which is small.

All of the control processes of the rotational speed described above with reference to FIGS. 27A to 29B may be combined to be performed, or only part thereof may be performed. A setting of whether to control the rotational speed or a setting of which control process to be performed as illustrated in FIGS. 27A to 29B may be appropriately set by a user through an operation on the display panel 180. That is, in the embodiment, the display panel 180 functions as a rotational speed setting part. With such a configuration, the user can freely perform setting according to his/her preference by considering balance among improvement in productivity, suppression of the collision sound, and the fold-enhancing effect.

Figure 30:
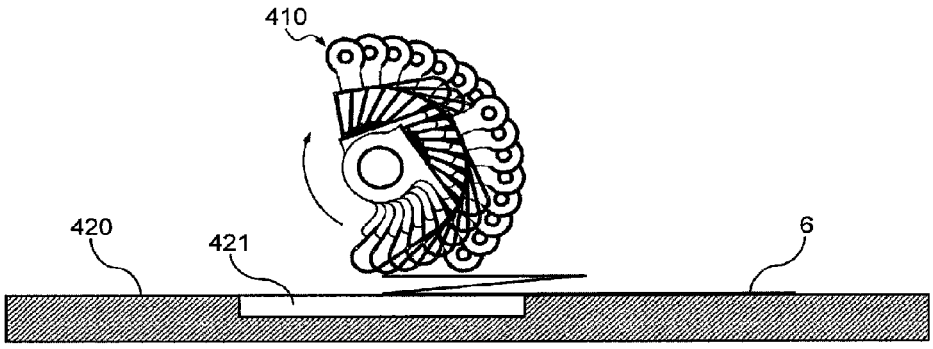
FIG. 30 is a diagram for explaining a method for suppressing the collision sound between the fold-enhancing roller and the sheet supporting plate in the fold-enhancing processing unit according to the embodiment.

In the fourth method for suppressing the collision sound between the fold-enhancing roller 410 and the sheet supporting plate 420, as illustrated in FIG. 30, a shock buffer 421 is provided on the sheet supporting plate 420 at a position where the fold-enhancing roller 410 collides. This configuration, in which the shock buffer 421 is provided on the sheet supporting plate 420 at a position where the fold-enhancing roller 410 collides, allows the shock buffer 421 to dampen the shock between the fold-enhancing roller 410 and the sheet supporting plate 420 and absorb the collision sound at that time, so that the collision sound can be suppressed. The shock buffer 421 is formed of, for example, a buffer such as rubber, a sponge, and plastic resin.

Figure 31:
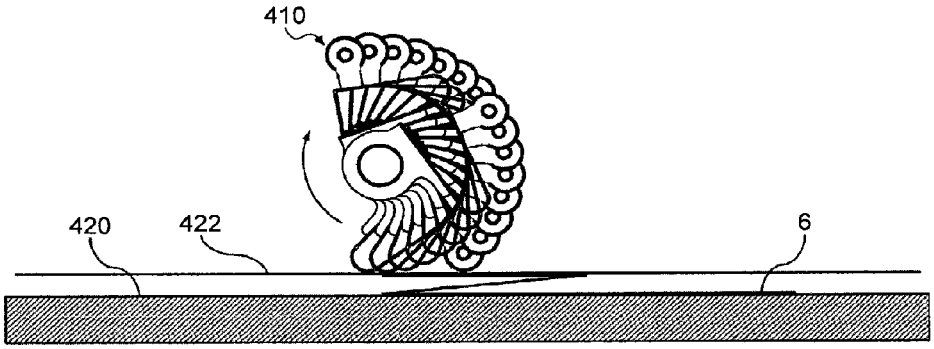
FIG. 31 is a diagram for explaining a method for suppressing the collision sound between the fold-enhancing roller and the sheet supporting plate in the fold-enhancing processing unit according to the embodiment.

In the fifth method for suppressing the collision sound between the fold-enhancing roller 410 and the sheet supporting plate 420, as illustrated in FIG. 31, a shock buffering sheet 422 is provided between the sheet 6 and the fold-enhancing roller 410. This configuration, in which the shock buffering sheet 422 is provided between the sheet 6 and the fold-enhancing roller 410, allows the shock buffering sheet 422 to dampen the shock between the fold-enhancing roller 410 and the sheet supporting plate 420 and absorbs the collision sound at that time, so that the collision sound can be suppressed. This configuration, in which the shock buffering sheet 422 is provided between the sheet 6 and the fold-enhancing roller 410, allows the fold-enhancing roller 410 to abut only on the shock buffering sheet 422 and prevents it from being directly brought into contact with the sheet 6, so that a folding wrinkle, a pressed mark, and the like can be prevented from being formed. The shock buffering sheet 422 is formed of a buffer such as rubber, a sponge, and plastic resin similarly to the shock buffer 421. That is, in the embodiment, the shock buffer 421 and the shock buffering sheet 422 function as a shock buffer.

In another method for suppressing the collision sound between the fold-enhancing roller 410 and the sheet supporting plate 420, the pressing roller 412*c* or the pressing rod 412*d* may be formed of a buffer such as rubber, a sponge, and plastic resin similarly to the shock buffer 421 and the shock buffering sheet 422.

Figure 32:
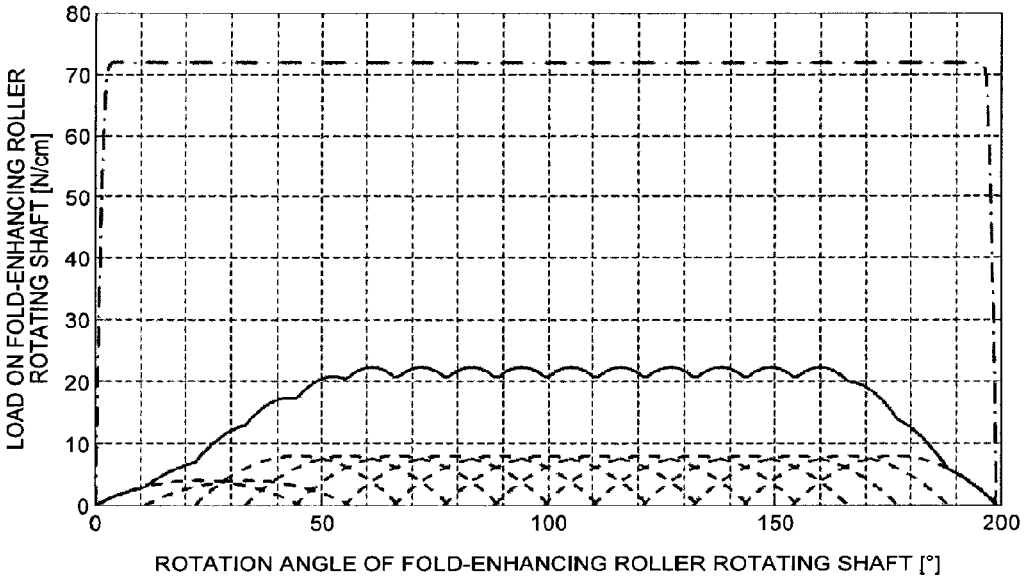
FIG. 32 is a graph illustrating a load on the fold-enhancing roller rotating shaft when the fold-enhancing processing unit according to the embodiment is in an fold-enhancing processing operation.

The following describes a load on the fold-enhancing roller rotating shaft 411 when the fold-enhancing processing unit 4 according to the embodiment is in the fold-enhancing processing operation with reference to FIG. 32. FIG. 32 is a graph illustrating the load on the fold-enhancing roller rotating shaft 411 when the fold-enhancing processing unit 4 according to the embodiment is in the fold-enhancing processing operation. In FIG. 32, a solid line represents the total load on the fold-enhancing roller rotating shaft 411 in the configuration of the fold-enhancing roller 410 illustrated in FIGS. 17 to 19.

Each dashed line in FIG. 32 represents the load on the fold-enhancing roller rotating shaft 411 when it is assumed that each set of the pressing force transmitting parts 412 included in the fold-enhancing roller 410 illustrated in FIGS. 17 to 19 independently presses the sheet 6. The dashed lines in FIG. 32 represent, sequentially from the left, the first set, the second set, the third set, and the fifteenth set of the pressing force transmitting parts 412 in the fold-enhancing roller 410 illustrated in FIGS. 17 to 19.

In the fold-enhancing roller 410 illustrated in FIGS. 17 to 19, the first set of the pressing force transmitting part 412 includes only one pressing force transmitting part 412 unlike the second to the fifteenth sets thereof each including two pressing force transmitting parts 412. Accordingly, the load on the fold-enhancing roller rotating shaft 411 when the first set of the pressing force transmitting part 412 is assumed to independently press the sheet 6 is half of the load when another set of the pressing force transmitting parts 412 is assumed to independently press the sheet 6.

An alternate long and short dash line in FIG. 32 represents the load on the fold-enhancing roller rotating shaft when the conventional fold-enhancing processing unit is in the fold-enhancing processing operation.

As represented with a dashed line in FIG. 32, the load on the fold-enhancing roller rotating shaft 411 per set when each set of the pressing force transmitting parts 412 included in the fold-enhancing roller 410 illustrated in FIGS. 17 to 19 is assumed to independently press the sheet 6, is smaller than the load on the fold-enhancing roller rotating shaft in the conventional fold-enhancing processing unit.

As represented with the dashed line in FIG. 32, the total load on the fold-enhancing roller rotating shaft 411 in the configuration of the fold-enhancing roller 410 illustrated in FIGS. 17 to 19 is also smaller than that of the fold-enhancing roller rotating shaft in the conventional fold-enhancing processing unit. This is because, as illustrated in FIGS. 11 to 13, FIGS. 14 to 16, and FIGS. 17 to 19, respective sets of the pressing force transmitting parts 412 included in the fold-enhancing roller 410 according to the embodiment are configured to sequentially press the sheet 6 at different timings in the main scanning direction.

Accordingly, the fold-enhancing processing unit 4 according to the embodiment can achieve an fold-enhancing effect equivalent to or larger than that of the fold-enhancing roller in the conventional fold-enhancing processing unit, with pressing force smaller than that of the fold-enhancing roller in the conventional fold-enhancing processing unit, and can reduce the load on the fold-enhancing roller rotating shaft 411. That is, the fold-enhancing processing unit 4 according to the embodiment can apply sufficient pressing force to the fold while reducing the load on the fold-enhancing roller rotating shaft 411.

Figure 33:
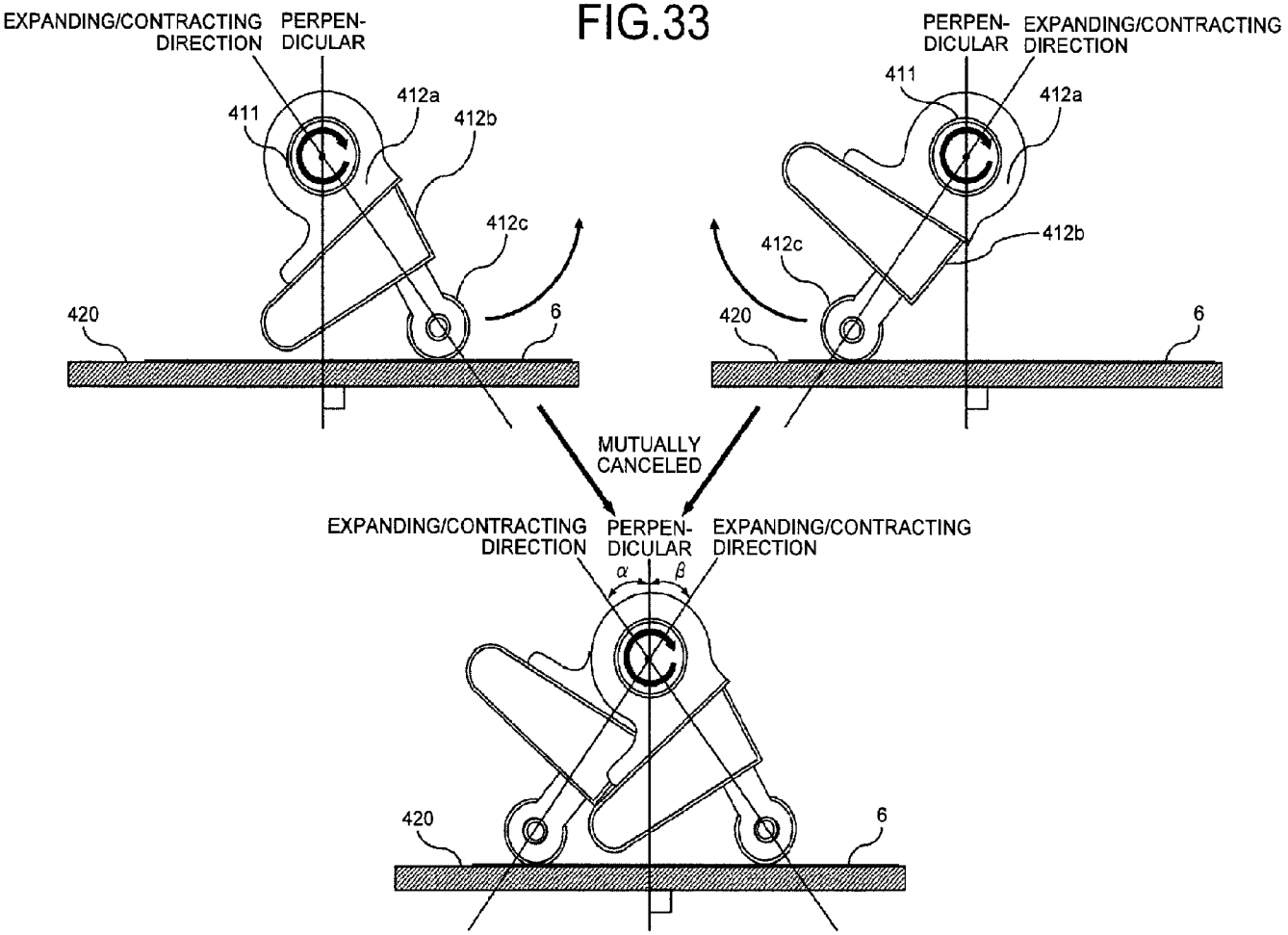
FIG. 33 is a diagram for explaining a rotational moment applied to the fold-enhancing roller rotating shaft when the fold-enhancing processing unit according to the embodiment is in the fold-enhancing processing operation.

The following describes load torque on the fold-enhancing roller driving motor 471 when the fold-enhancing processing unit 4 according to the embodiment is in the fold-enhancing processing operation with reference to FIG. 33. FIG. 33 is a diagram for explaining a rotational moment applied to the fold-enhancing roller rotating shaft 411 when the fold-enhancing processing unit 4 according to the embodiment is in the fold-enhancing processing operation.

As illustrated in FIG. 33, when the fold-enhancing processing unit 4 according to the embodiment is in the fold-enhancing processing operation, the rotational moment is generated in a direction opposite to the rotational direction of the fold-enhancing roller 410 from the time when the pressing roller 412*c* of the pressing force transmitting part 412 starts to abut on the sheet 6 until the expanding/contracting direction of the elastic body 412*b* becomes parallel to a perpendicular extending from the fold-enhancing roller rotating shaft 411 to the sheet supporting plate 420. On the other hand, as illustrated in FIG. 33, when the fold-enhancing processing unit 4 according to the embodiment is in the fold-enhancing processing operation, the rotational moment is generated in the same direction as the rotational direction of the fold-enhancing roller 410 from the time when the expanding/contracting direction of the elastic body 412*b* becomes parallel to the perpendicular until the pressing roller 412*c* of the pressing force transmitting part 412 becomes separated from the sheet 6.

Accordingly, when each set of the pressing force transmitting parts 412 included in the fold-enhancing roller 410 according to the embodiment is assumed to independently press the sheet 6, the rotational moment thereof is the load torque on the fold-enhancing roller driving motor 471.

However, the fold-enhancing roller 410 according to the embodiment is configured as illustrated in FIGS. 11 to 13, FIGS. 14 to 16, and FIGS. 17 to 19, so that the rotational moment caused by a certain set of the pressing force transmitting parts 412 is generated in the direction opposite to the rotational moment caused by another set of the pressing force transmitting parts 412 as illustrated in FIG. 33. Accordingly, their rotational moments are mutually canceled, and the total rotational moment is reduced. This configuration allows the image forming apparatus 1 according to the embodiment to reduce the load torque on the fold-enhancing roller driving motor 471 in the fold-enhancing processing operation. Accordingly, the fold-enhancing processing unit 4 according to the embodiment can apply sufficient pressing force to the fold while reducing the load on the fold-enhancing roller rotating shaft 411.

In particular, the rotational moment caused by the certain set of the pressing force transmitting parts 412 and the rotational moment caused by another set of the pressing force transmitting parts 412 are completely canceled by each other, and thus the total rotational moment thereof becomes 0, when $\alpha$ is equal to $\beta$. Herein, as illustrated in FIG. 33, $\alpha$ represents an angle between the perpendicular and the expanding/contracting direction of the elastic body 412*b* of the certain set of the pressing force transmitting parts 412, and $\beta$ represents an angle between the perpendicular and the expanding/contracting direction of the elastic body 412*b* of the other set of the pressing force transmitting parts 412.

The force to be canceled is only force in the rotational direction about the fold-enhancing roller rotating shaft 411. Force in the vertically downward direction from the fold-enhancing roller rotating shaft 411, that is, pressing force on the sheet supporting plate 420 caused by the elastic force of the elastic body 412*b* is not affected. Accordingly, the fold-enhancing processing unit 4 according to the embodiment can apply sufficient pressing force to the fold while reducing the load on the fold-enhancing roller rotating shaft 411.

Figure 34:
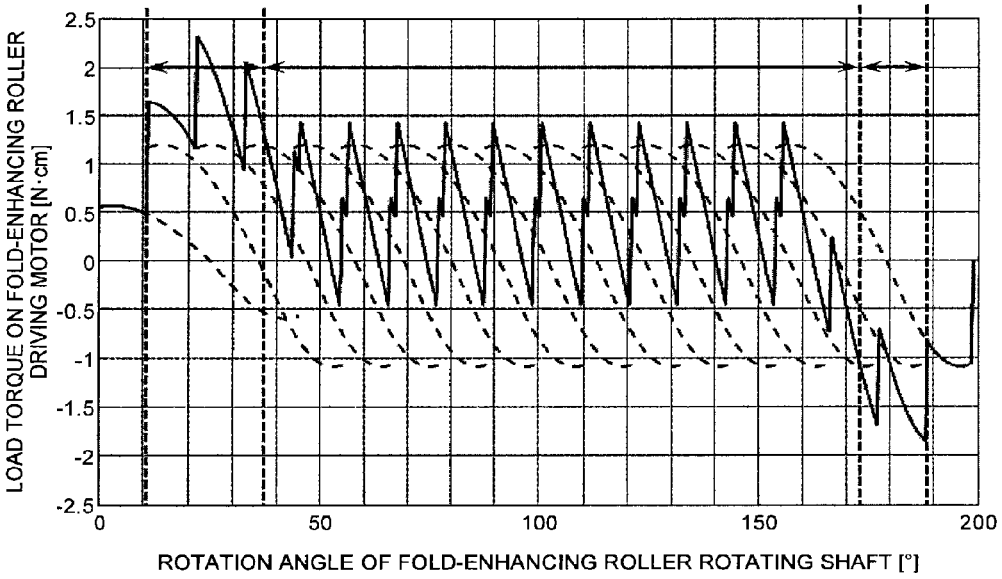
FIG. 34 is a graph illustrating load torque on an fold-enhancing roller driving motor when the fold-enhancing processing unit according to the embodiment is in the fold-enhancing processing operation.

FIG. 34 illustrates a change in the load torque on the fold-enhancing roller driving motor 471 when the fold-enhancing processing unit 4 according to the embodiment is in the fold-enhancing processing operation. FIG. 34 is a graph illustrating the load torque on the fold-enhancing roller driving motor 471 when the fold-enhancing processing unit 4 according to the embodiment is in the fold-enhancing processing operation. In FIG. 34, a solid line represents the total load torque on the fold-enhancing roller driving motor 471 when the fold-enhancing roller rotating shaft 411 in the configuration of the fold-enhancing roller 410 illustrated in FIGS. 17 to 19 is rotated.

Each dotted line in FIG. 34 represents the load torque on the fold-enhancing roller driving motor 471 when it is assumed that each set of the pressing force transmitting parts 412 included in the fold-enhancing roller 410 illustrated in FIGS. 17 to 19 independently presses the sheet 6. The dotted lines in FIG. 34 represent, sequentially from the left, the first set, the second set, the third set, . . . , and the fifteenth set of the pressing force transmitting parts 412 in the fold-enhancing roller 410 illustrated in FIGS. 17 to 19.

In the fold-enhancing roller 410 illustrated in FIGS. 17 to 19, the first set of the pressing force transmitting part 412 includes only one pressing force transmitting part 412 unlike the second to the fifteenth sets thereof each including two pressing force transmitting parts 412. Accordingly, the load torque on the fold-enhancing roller driving motor 471 when the first set of the pressing force transmitting part 412 is assumed to independently press the sheet 6 is half of the load torque when another set of the pressing force transmitting parts 412 is assumed to independently press the sheet 6.

As illustrated in FIG. 34, when the rotation angle of the fold-enhancing roller rotating shaft 411 is around 38° to 173°, the absolute value of the load torque on the fold-enhancing roller driving motor 471 when the fold-enhancing processing unit 4 according to the embodiment is in the fold-enhancing processing operation is smaller than that in a case in which each set of the pressing force transmitting parts 412 is assumed to independently press the sheet 6. This is because, as described above, the rotational moment caused by a certain set of the pressing force transmitting parts 412 and the rotational moment caused by the other set of the pressing force transmitting parts 412 are mutually canceled. Accordingly, the fold-enhancing processing unit 4 according to the embodiment can apply sufficient pressing force to the fold while reducing the load on the fold-enhancing roller rotating shaft 411.

However, as illustrated in FIG. 34, when the rotation angle of the fold-enhancing roller rotating shaft 411 is around 11° to 38°, the absolute value of the load torque on the fold-enhancing roller driving motor 471 is larger than that in a case in which each set of the pressing force transmitting parts 412 is assumed to independently press the sheet 6. This is because a rotational moment is caused in the same direction by all of the pressing force transmitting parts 412 abutting on the sheet 6 from when the first set of the pressing force transmitting parts 412 starts to abut on the sheet 6 to when being rotated by a certain angle (about 38°).

Figure 35:
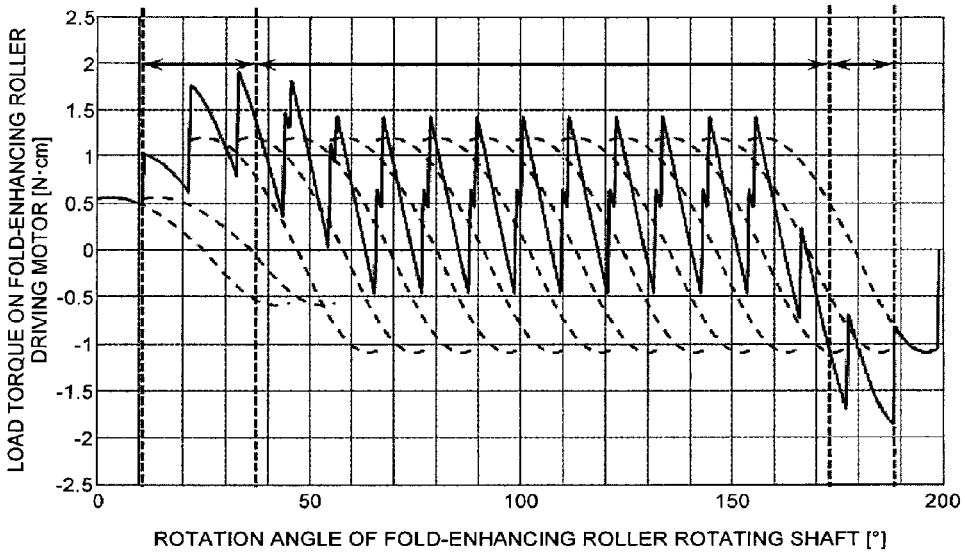
FIG. 35 is a graph illustrating the load torque on the fold-enhancing roller driving motor when the fold-enhancing processing unit according to the embodiment is in the fold-enhancing processing operation.

As illustrated in FIG. 35, reducing the elastic force of the elastic body 412*b* of the second set of the pressing force transmitting parts 412, or the number of the pressing force transmitting parts 412 in the second set, can reduce the load torque on the fold-enhancing roller driving motor 471 in the rotation angle range of about 11° to about 38°. FIG. 35 is a graph illustrating the load torque on the fold-enhancing roller driving motor 471 when the fold-enhancing processing unit 4 according to the embodiment is in the fold-enhancing processing operation. However, with such a configuration, the pressing force of the second set of the pressing force transmitting parts 412 is smaller than the pressing force of another set of the pressing force transmitting parts 412, so that the fold-enhancing effect is lowered for a portion corresponding to the second set of the pressing force transmitting parts 412.

As illustrated in FIG. 34, when the rotation angle of the fold-enhancing roller rotating shaft 411 is around 173° to 189°, the absolute value of the load torque on the fold-enhancing roller driving motor 471 is larger than that in a case in which each set of the pressing force transmitting parts 412 is assumed to independently press the sheet 6. This is because the fold-enhancing roller illustrated in FIGS. 17 to 19 includes fifteen sets of the pressing force transmitting parts 412, and the number of sets of the pressing force transmitting parts 412 for canceling the rotational moment with each other is reduced for the thirteenth and following sets of the pressing force transmitting parts 412 as compared with the first to twelfth sets of the pressing force transmitting parts 412.

Figure 36:
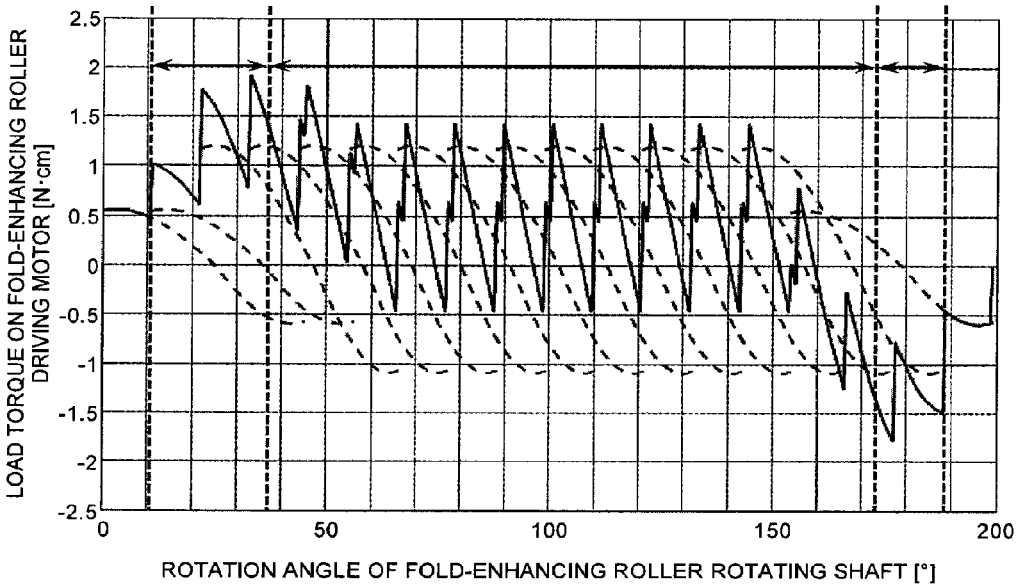
FIG. 36 is a graph illustrating the load torque on the fold-enhancing roller driving motor when the fold-enhancing processing unit according to the embodiment is in the fold-enhancing processing operation.

As illustrated in FIG. 36, reducing the elastic force of the elastic body 412*b* of the fifteenth set of the pressing force transmitting parts 412 is reduced, or the number of the pressing force transmitting parts 412 in the fifteenth set, can reduce the load torque on the fold-enhancing roller driving motor 471 in the rotation angle range of about 173° to about 189°. Alternatively, as illustrated in FIG. 37, reducing the elastic force of the elastic body 412*b* of the fourteenth and fifteenth sets of the pressing force transmitting parts 412, or the number of the pressing force transmitting parts 412 in the fourteenth and fifteenth sets, can reduce the load torque on the fold-enhancing roller driving motor 471 in the rotation angle range of about 173° to about 189°.

Figure 37:
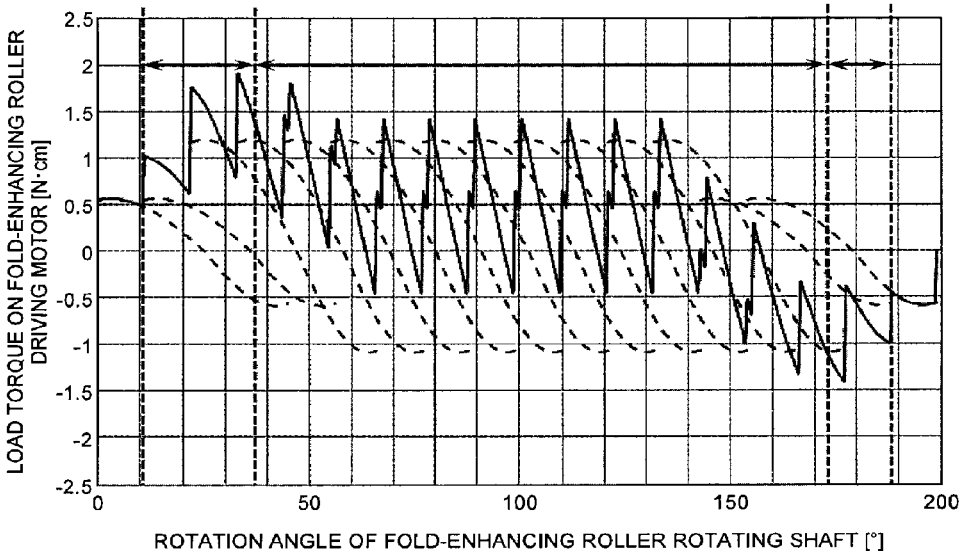
FIG. 37 is a graph illustrating the load torque on the fold-enhancing roller driving motor when the fold-enhancing processing unit according to the embodiment is in the fold-enhancing processing operation.

FIGS. 36 and 37 are graphs illustrating the load torque on the fold-enhancing roller driving motor 471 when the fold-enhancing processing unit 4 according to the embodiment is in the fold-enhancing processing operation. However, with such a configuration, the pressing force of the fifteenth set or of the fourteenth and fifteenth sets of the pressing force transmitting parts 412 is smaller than the pressing force of another set of the pressing force transmitting parts 412, so that the fold-enhancing effect is lowered for a portion corresponding to the fifteenth set or to the fourteenth and fifteenth sets of the pressing force transmitting parts 412.

Figure 38:
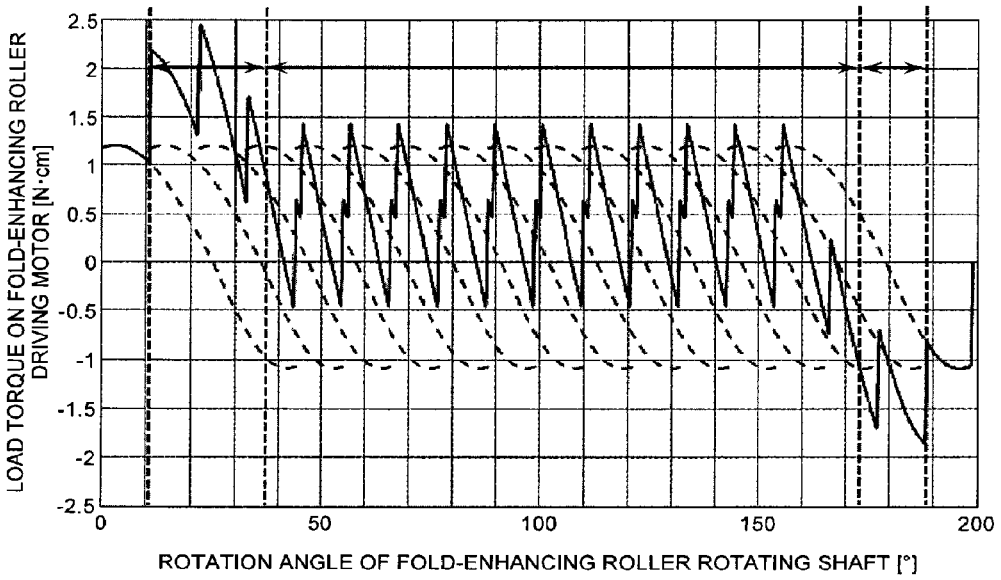
FIG. 38 is a graph illustrating the load torque on the fold-enhancing roller driving motor when the fold-enhancing processing unit according to the embodiment is in the fold-enhancing processing operation.

When the first set is assumed to include two pressing force transmitting parts 412, a graph illustrated in FIG. 38 is obtained. FIG. 38 is a graph illustrating the load torque on the fold-enhancing roller driving motor 471 when the fold-enhancing processing unit 4 according to the embodiment is in the fold-enhancing processing operation.

Figure 39:
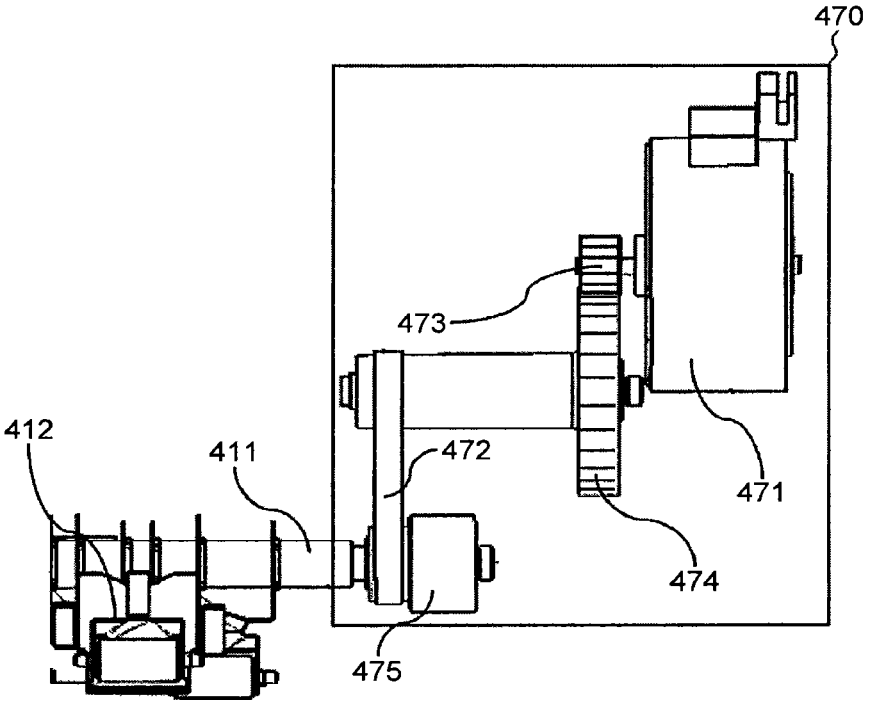
FIG. 39 is a diagram of an fold-enhancing roller driving device according to the embodiment viewed from the main scanning direction.
Figure 40:
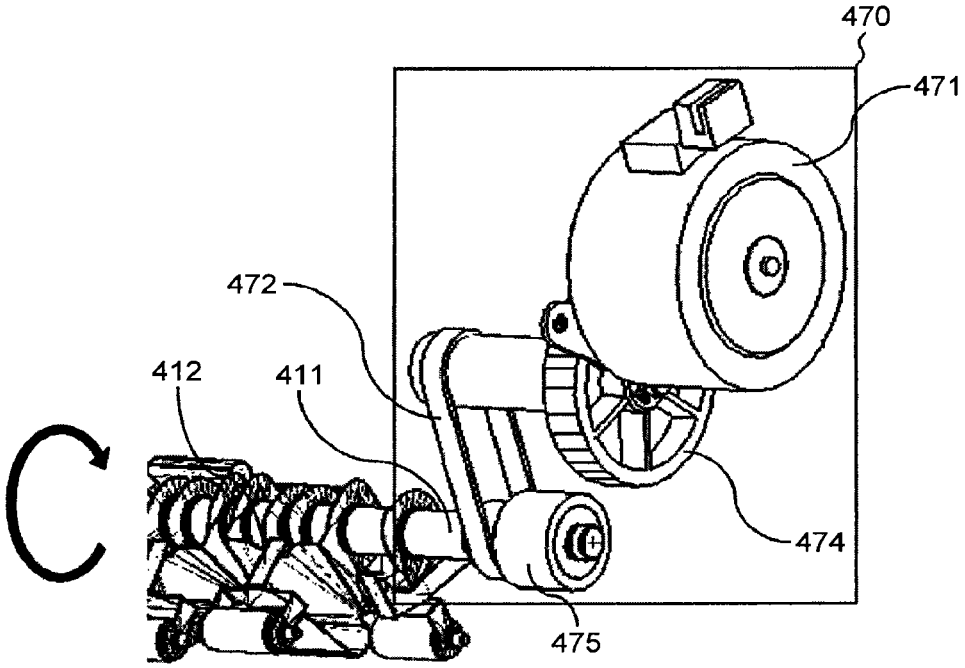
FIG. 40 is a perspective view of the fold-enhancing roller driving device according to the embodiment.

The following describes the structure of the fold-enhancing roller driving device 470 according to the embodiment with reference to FIGS. 39 and 40. FIG. 39 is a diagram of the fold-enhancing roller driving device 470 according to the embodiment viewed from the main scanning direction. FIG. 40 is a perspective view of the fold-enhancing roller driving device 470 according to the embodiment.

As illustrated in FIGS. 39 and 40, the fold-enhancing roller driving device 470 according to the embodiment is arranged at one end in the main scanning direction of the fold-enhancing roller 410, and includes the fold-enhancing roller driving motor 471, the timing belt 472, a reverse gear 473, an fold-enhancing roller rotating gear pulley 474, and an fold-enhancing roller rotating pulley 475.

The fold-enhancing roller driving motor 471 is a motor for rotating the reverse gear 473. The fold-enhancing roller rotating gear pulley 474 is a pulley including a gear meshed with the reverse gear 473, and rotates in a direction opposite to the rotational direction of the reverse gear 473 when the reverse gear 473 rotates. The timing belt 472 is an endless belt for transmitting the rotation of the fold-enhancing roller rotating gear pulley 474 to the fold-enhancing roller rotating pulley 475. The fold-enhancing roller rotating pulley 475 is coupled to the fold-enhancing roller rotating shaft 411, and is rotated in the same direction as the rotational direction of the fold-enhancing roller rotating gear pulley 474 by the timing belt 472. Accordingly, the fold-enhancing roller rotating shaft 411 is rotated in the rotational direction of the fold-enhancing roller rotating pulley 475.

To rotate the fold-enhancing roller 410 in the arrow direction illustrated in FIG. 40, the fold-enhancing roller driving device 470 configured as described above first rotates the fold-enhancing roller driving motor 471 in a direction opposite to the arrow illustrated in FIG. 40 under control of the engine control part 102 to rotate the reverse gear 473 in the direction opposite to the arrow direction illustrated in FIG. 40. This rotation rotates the fold-enhancing roller rotating gear pulley 474 in the same direction as the arrow illustrated in FIG. 40, and transmits the rotation to the fold-enhancing roller rotating pulley 475 via the timing belt 472.

When the fold-enhancing roller rotating pulley 475 rotates, the fold-enhancing roller rotating shaft 411 is rotated being interlocked therewith, so that the fold-enhancing roller 410 is rotated in the arrow direction illustrated in FIG. 40. To rotate the fold-enhancing roller 410 in the direction opposite to the arrow illustrated in FIG. 40, the fold-enhancing roller driving device 470 reversely rotates each of these components.

As described above, in the fold-enhancing processing, the fold-enhancing processing unit 4 according to the embodiment can successively press the fold formed on the sheet with the pressing force transmitting parts 412 in the main scanning direction by rotating the fold-enhancing roller 410 configured as illustrated in FIGS. 8 to 10, FIGS. 11 to 13, FIGS. 14 to 16, and FIGS. 17 to 19 about the fold-enhancing roller rotating shaft 411 as a rotation axis.

Accordingly, the fold-enhancing processing unit 4 according to the embodiment can intensively apply the pressing force of each pressing force transmitting part 412 to the entire fold in a short time. Thus, the fold-enhancing processing unit 4 according to the embodiment can apply sufficient pressing force to the fold without reducing productivity while reducing the load on the fold-enhancing roller rotating shaft 411. Accordingly, a small, low-cost, highly productive fold-enhancing device can be provided.

The embodiment describes an example in which the fold-enhancing processing unit 4 rotates the fold-enhancing roller 410 once in one direction to press one fold once in a specific direction. Alternatively, the fold-enhancing processing unit 4 may be configured to rotate the fold-enhancing roller 410 multiple times in one direction to press one fold multiple times in a specific direction, or to rotate the fold-enhancing roller 410 in both directions to press one fold multiple times in both of the sheet conveying direction and the opposite direction thereto. Such a configuration allows the fold-enhancing processing unit 4 according to the embodiment to provide a greater fold-enhancing effect.

The structure of the fold-enhancing roller 410 according to the embodiment is not limited to that illustrated in FIGS. 8 to 10, FIGS. 11 to 13, FIGS. 14 to 16, and FIGS. 17 to 19. The same effect can be obtained when the fold-enhancing roller 410 has such a configuration that each pressing force transmitting part 412 is arranged around the fold-enhancing roller rotating shaft 411 in the main scanning direction in accordance with its positional relation with respect to the sheet supporting plate 420, which changes with the rotation of the fold-enhancing roller rotating shaft 411, so that its elastic body 412*b* expands or contracts accordingly when the pressing force transmitting part 412 receives a stress from the sheet supporting plate 420 at a timing at least different from any other pressing force transmitting part 412.

The embodiment describes the configuration in which the image forming apparatus 1 includes the image forming unit 2, the folding processing unit 3, the fold-enhancing processing unit 4, and the scanner unit 5. Alternatively, each of these units may be configured as an independent device, and the devices may be coupled to each other to configure the image forming system.

Second Embodiment

As described above with reference to FIGS. 39 and 40, the first embodiment describes the configuration in which the fold-enhancing roller 410 can rotate in both of the clockwise direction and the counterclockwise direction about the fold-enhancing roller rotating shaft 411 as a rotation axis. In this case, as described above with reference to FIGS. 21A to 23, the fold-enhancing processing unit 4 can press the fold formed on the sheet in both directions along the sub-scanning direction.

On the other hand, the present embodiment describes a configuration in which the fold-enhancing roller 410 can rotate in only one of the clockwise direction and the counterclockwise direction about the fold-enhancing roller rotating shaft 411 as a rotation axis. In this case, although the fold-enhancing processing unit 4 can press the fold formed on the sheet only in one direction along the sub-scanning direction, it is possible to utilize, for another driving system, the driving force of the fold-enhancing roller driving motor 471 for rotating the fold-enhancing roller 410 in a direction opposite to its rotatable direction. Details will be described below. Components denoted by the same reference numerals as those in the first embodiment represent the same or corresponding components, and detailed description thereof will not be repeated.

Figure 41:
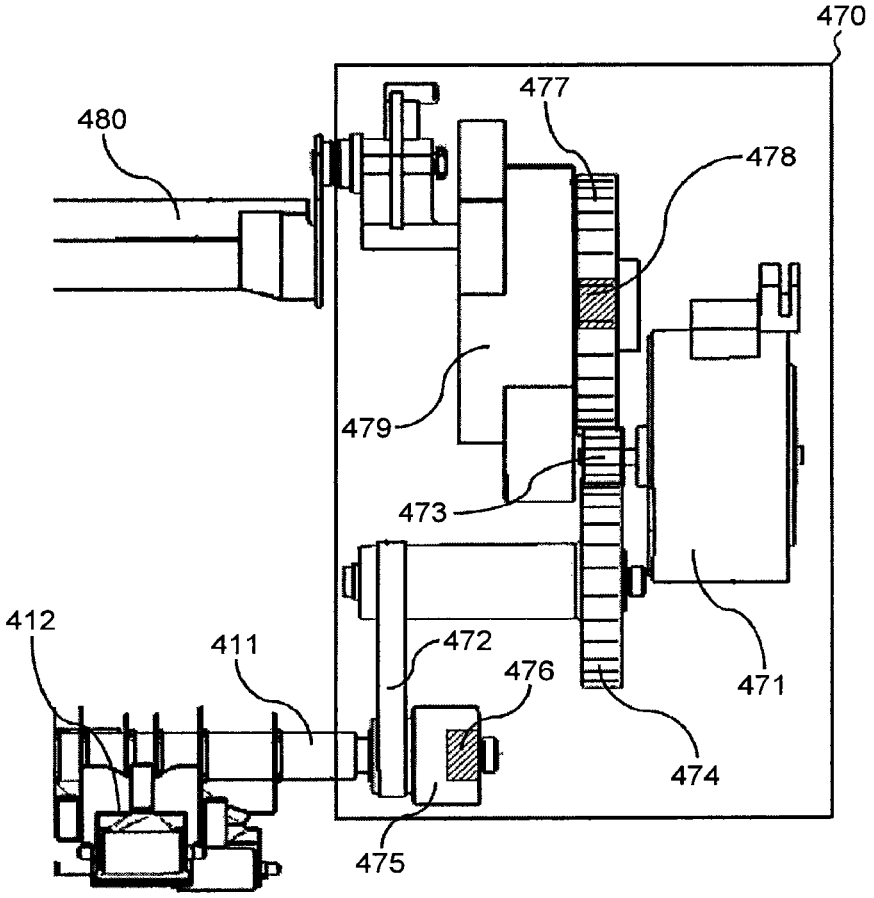
FIG. 41 is a diagram of the fold-enhancing roller driving device according to the embodiment viewed from the main scanning direction.
Figure 42:
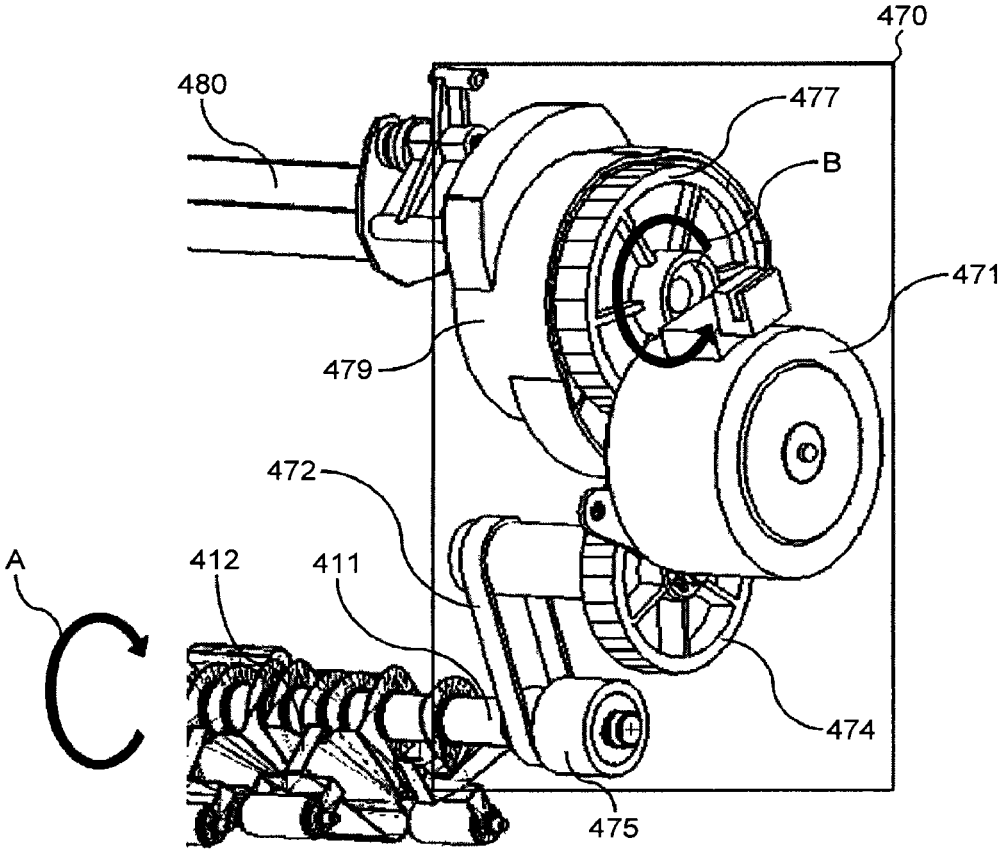
FIG. 42 is a perspective view of the fold-enhancing roller driving device according to the embodiment.

First, the following describes the structure of the fold-enhancing roller driving device 470 according to the embodiment with reference to FIGS. 41 and 42. FIG. 41 is a diagram of the fold-enhancing roller driving device 470 according to the embodiment viewed from the main scanning direction. FIG. 42 is a perspective view of the fold-enhancing roller driving device 470 according to the embodiment.

As illustrated in FIGS. 41 and 42, the fold-enhancing roller driving device 470 according to the embodiment includes a one-way clutch 476, a reverse rotation gear 477, a one-way clutch 478, and a reverse rotation cam 479 in addition to the structures illustrated in FIGS. 39 and 40.

The one-way clutch 476 is arranged inside the fold-enhancing roller rotating pulley 475 and configured as follows. Only when the fold-enhancing roller rotating pulley 475 rotates in a specific direction, the one-way clutch 476 rotates the fold-enhancing roller rotating shaft 411 in the same direction. When the fold-enhancing roller rotating pulley 475 rotates in a direction opposite to the specific direction, the one-way clutch 476 idles and does not rotate the fold-enhancing roller rotating shaft 411. That is, in the embodiment, the one-way clutch 476 functions as a driving force blocking part.

The one-way clutch 476 according to the embodiment is configured as follows. Only when the fold-enhancing roller rotating pulley 475 rotates in the arrow A direction illustrated in FIG. 42, the one-way clutch 476 rotates the fold-enhancing roller rotating shaft 411 in the same direction. When the fold-enhancing roller rotating pulley 475 rotates in a direction opposite to the arrow A direction illustrated in FIG. 42, the one-way clutch 476 idles.

The reverse rotation gear 477 is meshed with the reverse gear 473 and rotates in a direction opposite to the rotational direction of the reverse gear 473, that is, in the same direction as the fold-enhancing roller rotating gear pulley 474, when the reverse gear 473 rotates. The one-way clutch 478 is arranged inside the reverse rotation gear 477 and configured as follows. Similarly to the one-way clutch 476, only when the reverse rotation gear 477 rotates in a specific direction, the one-way clutch 478 rotates the reverse rotation cam 479 in the same direction. When the reverse rotation gear 477 rotates in a direction opposite to the specific direction, the one-way clutch 478 idles and does not rotate the reverse rotation cam 479.

The one-way clutch 478 according to the embodiment is configured as follows. Only when the reverse rotation gear 477 rotates in the arrow B direction illustrated in FIG. 42, the one-way clutch 478 rotates the reverse rotation cam 479 in the same direction. When the reverse rotation gear 477 rotates in a direction opposite to the arrow B direction illustrated in FIG. 42, the one-way clutch 478 idles.

The one-way clutch 476 and the one-way clutch 478 configured as described above allow only one of the fold-enhancing roller rotating pulley 475 and the reverse rotation cam 479 to rotate when the fold-enhancing roller driving motor 471 rotates. The rotational directions of the fold-enhancing roller rotating pulley 475 and the reverse rotation cam 479 are opposite to each other.

The reverse rotation cam 479 includes a curved surface whose distance to the rotation axis of the reverse rotation gear 477 is not constant across the surface. A portion of the curved surface whose distance to the rotation axis of the reverse rotation gear 477 is long is coupled to a reverse rotation drive transmitting part 480 for transmitting the rotational motion of the reverse rotation cam 479 to a driving system other than the fold-enhancing roller 410.

To rotate the fold-enhancing roller 410 in the arrow A direction illustrated in FIG. 42, the fold-enhancing roller driving device 470 configured as described above first rotates the fold-enhancing roller driving motor 471 in a direction opposite to the arrow A illustrated in FIG. 42 under control of the engine control part 102, thereby rotating the reverse gear 473 in the direction opposite to the arrow A direction illustrated in FIG. 42. Accordingly, the fold-enhancing roller rotating gear pulley 474 is rotated in the same direction as the arrow A illustrated in FIG. 42, and transmits the rotation to the fold-enhancing roller rotating pulley 475 via the timing belt 472.

When the fold-enhancing roller rotating pulley 475 rotates, the fold-enhancing roller rotating shaft 411 is rotated being interlocked therewith, and the fold-enhancing roller 410 is rotated in the direction illustrated in FIG. 40. In this process, the reverse rotation gear 477 does not rotate due to the function of the one-way clutch 478.

On the other hand, to utilize the driving force of the fold-enhancing roller driving motor 471 for another driving system, the fold-enhancing roller driving device 470 configured as described above first rotates the fold-enhancing roller driving motor 471 in the direction opposite to the arrow B illustrated in FIG. 42 under control of the engine control part 102 to rotate the reverse rotation gear 477 in a direction opposite to the arrow B direction illustrated in FIG. 42.

Accordingly, the reverse rotation cam 479 is rotated in the same direction as the arrow B illustrated in FIG. 42, and transmits the rotational motion thereof to a driving system other than the fold-enhancing roller 410 via the reverse rotation drive transmitting part 480. In this process, the fold-enhancing roller rotating pulley 475 does not rotate due to the function of the one-way clutch 476. That is, in the embodiment, the reverse rotation drive transmitting part 480 functions as a drive transmitting part to another driving unit.

Such a configuration allows the fold-enhancing processing unit 4 according to the embodiment to utilize the driving force of the fold-enhancing roller driving motor 471 for rotating the fold-enhancing roller 410 in the direction opposite to its rotatable direction for another driving system.

When the fold-enhancing roller driving device 470 is configured as described above, the fold-enhancing processing unit 4 first stops the rotation of the fold-enhancing roller driving motor 471 to stop the rotation of the fold-enhancing roller 410. However, the fold-enhancing roller 410 continues rotating in the same direction for a while by a rotational moment caused by its own inertial force due to the function of the one-way clutch 476. This is because, when the rotation of the fold-enhancing roller driving motor 471 is stopped, the rotational moment caused by the inertial force cannot be canceled by any force acting in a direction opposite to the rotational direction of the fold-enhancing roller 410, due to the function of the one-way clutch 476.

Accordingly, in the fold-enhancing processing unit 4 according to the embodiment, when the fold-enhancing roller 410 is ordered to rotate by a certain angle θ and stop at the rotation angle θ, the fold-enhancing roller 410 will actually rotate by more than the predetermined angle θ before stopping, so that an accurate rotation angle of the fold-enhancing roller 410 cannot be known.

For this reason, the fold-enhancing roller driving device 470 configured as described above needs a stopping device for accurately stopping the fold-enhancing roller 410 at the predetermined angle θ after rotation to the rotation angle θ. Thus, the fold-enhancing processing unit 4 according to the embodiment includes a stopping device 490 for stopping the fold-enhancing roller 410 at a certain position. That is, in the embodiment, the stopping device 490 functions as a rotation stopping part.

Figure 43:
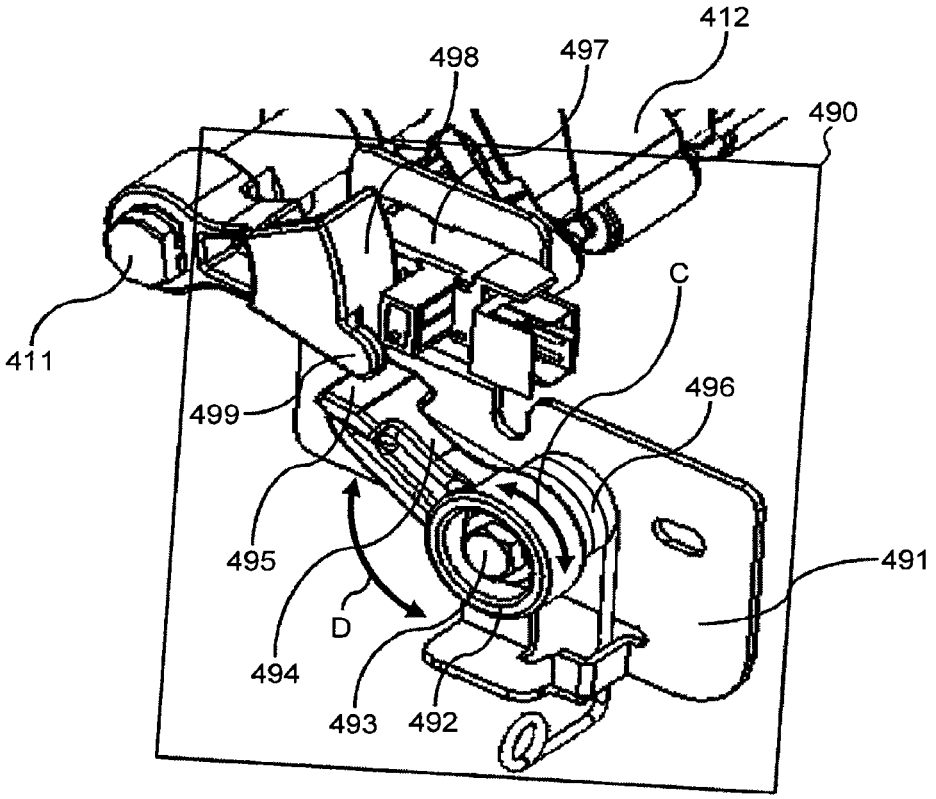
FIG. 43 is a perspective view of a stopping device according to the embodiment.
Figure 44:
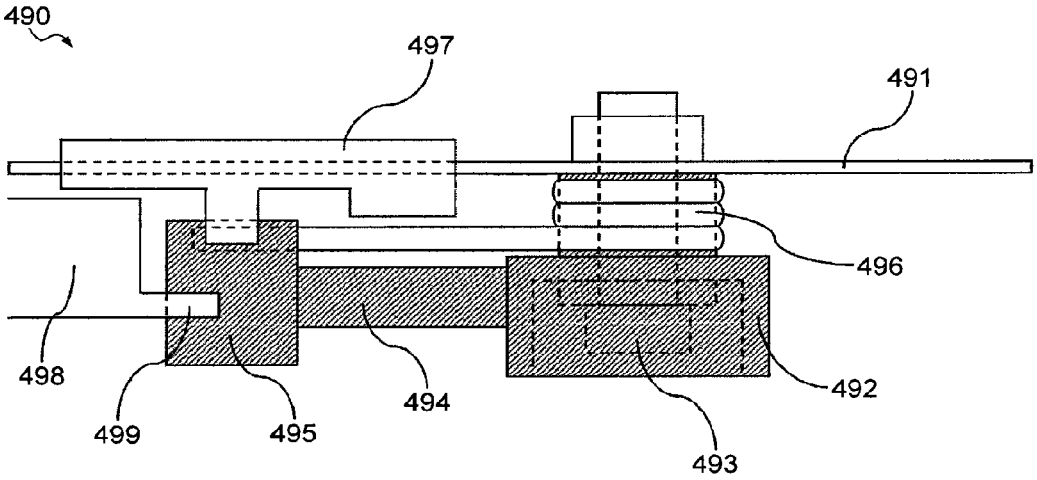
FIG. 44 is a transparent view of the stopping device according to the embodiment viewed from a direction perpendicular to a plane extending in the main scanning direction and the sub-scanning direction.
Figure 45:
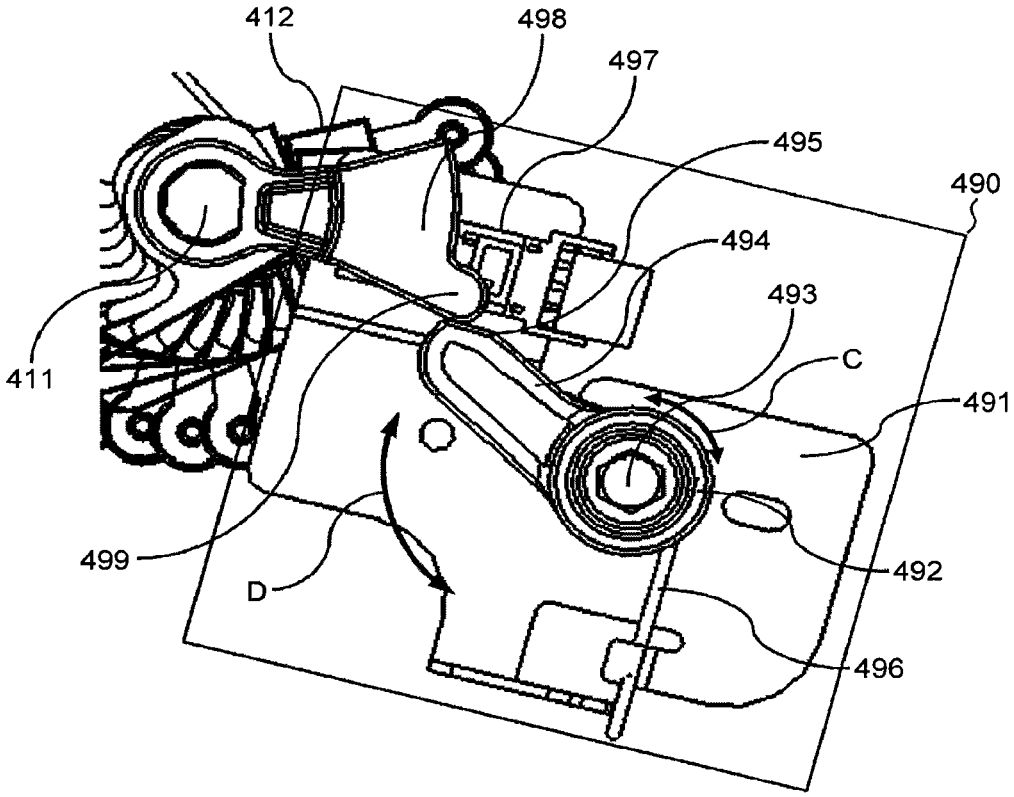
FIG. 45 is a diagram of the stopping device according to the embodiment viewed from the main scanning direction.

The following describes the structure of the stopping device 490 according to the embodiment with reference to FIG. 43 to FIG. 45. FIG. 43 is a perspective view of the stopping device 490 according to the embodiment. FIG. 44 is a transparent view of the stopping device 490 according to the embodiment viewed from a direction perpendicular to a plane extending in the main scanning direction and the sub-scanning direction. FIG. 45 is a diagram of the stopping device 490 according to the embodiment viewed from the main scanning direction.

As illustrated in FIG. 43 to FIG. 45, the stopping device 490 according to the embodiment is provided on a side opposite to the fold-enhancing roller driving device 470 in the main scanning direction of the fold-enhancing roller 410, and includes a stopping device fixing part 491, a rotation part 492, a rotation screw 493, a coupling part 494, a rotation stopping part 495, a torsion spring 496, a sensor 497, a sensor blocking part 498, and a rotation stopping action part 499.

The stopping device fixing part 491 is a fixing part for fixing the stopping device 490 to the fold-enhancing processing unit 4. The rotation part 492 is fixed to the stopping device fixing part 491 with the rotation screw 493 so as to be rotatable in the arrow C direction illustrated in FIGS. 43 and 45 about the rotation screw 493 as a rotation axis. The rotation screw 493 serving as the rotation axis of the rotation part 492 fixes the rotation part 492 to the stopping device fixing part 491 so that the rotation part 492 is rotatable in the arrow C direction illustrated in FIGS. 43 and 45. The coupling part 494 couples the rotation part 492 with the rotation stopping part 495. The rotation stopping part 495 is coupled to the rotation part 492 through the coupling part 494 so as to be rotatable in the arrow D direction illustrated in FIGS. 43 and 45 about the rotation screw 493 as a rotation axis.

The torsion spring 496 is attached to the periphery of a portion of the rotation part 492, which is attached to the stopping device fixing part 491 with the rotation screw 493. One side of the torsion spring 496 is fixed to the stopping device fixing part 491, and the other side thereof is fixed to the rotation stopping part 495. Such a configuration applies elastic force of the torsion spring 496 to block the rotation of the rotation stopping part 495 about the rotation screw 493 as a rotation axis, so that the rotation stopping part 495 can be returned to an original position. The elastic force of the torsion spring 496 according to the embodiment is larger than the inertial force of the fold-enhancing roller 410.

The sensor 497 includes an infrared ray emitting part that emits infrared rays and an infrared ray receiving part that receives the infrared rays. When the infrared rays emitted from the infrared ray emitting part to the infrared ray receiving part are blocked by the sensor blocking part 498, the sensor 497 notifies the engine control part 102 of that blockage. The sensor blocking part 498 is fixed to the fold-enhancing roller rotating shaft 411 to be rotatable with the fold-enhancing roller 410. When the fold-enhancing roller 410 is rotated by a certain angle θ, the sensor blocking part 498 blocks the infrared rays emitted from the infrared ray emitting part to the infrared ray receiving part in the sensor 497. Such a configuration allows the fold-enhancing processing unit 4 according to the embodiment to detect, when the sensor blocking part 498 blocks the sensor 497 as described above, that the fold-enhancing roller 410 is rotated by the certain angle θ, and to perform, at this moment, control for stopping the fold-enhancing roller 410, that is, control for stopping the rotation of the fold-enhancing roller driving motor 471.

The rotation stopping action part 499 is arranged at a distal end of the sensor blocking part 498, and configured to contact the rotation stopping part 495 when the fold-enhancing roller 410 is rotated by the certain angle θ.

When the fold-enhancing roller 410 is rotated by the certain angle θ and the rotation of the fold-enhancing roller driving motor 471 is stopped to stop the fold-enhancing roller 410 at the rotation angle θ, the fold-enhancing processing unit 4 according to the embodiment including the stopping device 490 configured as described above can cancel the rotational moment caused by inertial force of the fold-enhancing roller 410 by force acting in the opposite direction thereof.

Accordingly, when the fold-enhancing roller driving device 470 is configured as illustrated in FIGS. 41 and 42, and the fold-enhancing roller 410 is ordered to rotate by the certain angle θ and stop at the rotation angle θ, the fold-enhancing processing unit 4 according to the embodiment can prevent the fold-enhancing roller 410 from rotating in the same direction for a while after the rotation of the fold-enhancing roller driving motor 471 is stopped.

That is, the fold-enhancing processing unit 4 according to the embodiment prevents the fold-enhancing roller 410 from rotating by more than a certain angle θ before stopping when the fold-enhancing roller 410 is ordered to rotate by the certain angle θ and stop at the rotation angle θ. Accordingly, when the fold-enhancing roller driving device 470 is configured as illustrated in FIGS. 41 and 42, the fold-enhancing processing unit 4 according to the embodiment can accurately stop the fold-enhancing roller 410 at the certain angle θ after rotating it by the rotation angle θ, so that the accurate rotation angle of the fold-enhancing roller 410 can be known all the time.

Third Embodiment

In the fold-enhancing roller 410 according to the first embodiment, as illustrated in FIGS. 8 to 10, FIGS. 11 to 13, FIGS. 14 to 16, and FIGS. 17 to 19, the pressing force transmitting parts 412 are arranged at regular intervals in the main scanning direction around the fold-enhancing roller rotating shaft 411 with certain angle differences from each other in the rotational direction of the fold-enhancing roller rotating shaft 411.

Accordingly, the fold-enhancing roller 410 according to the first embodiment can successively press the fold formed on the sheet with the pressing force transmitting parts 412 in the main scanning direction by rotating about the fold-enhancing roller rotating shaft 411 as a rotation axis.

Accordingly, the fold-enhancing roller 410 according to the first embodiment can intensively apply the pressing force of each pressing force transmitting part 412 to the entire fold in a short time. Thus, the fold-enhancing roller 410 according to the first embodiment can apply sufficient pressing force to the fold without reducing productivity while reducing the load on the fold-enhancing roller rotating shaft 411. Accordingly, a small, low-cost, highly productive fold-enhancing device can be provided.

On the other hand, the fold-enhancing roller 410 according to the embodiment has such a configuration that the projecting pressing force transmitting parts 412 are arranged in a spiral manner around the fold-enhancing roller rotating shaft 411 with a certain angle difference θ from the fold-enhancing roller rotating shaft 411 on a surface of a pressing force transmitting roller 413 serving as a cylindrical rotating body rotatable about the fold-enhancing roller rotating shaft 411 as a rotation axis.

Thus, the fold-enhancing roller 410 according to the embodiment can successively press the fold formed on the sheet 6 in one direction, that is, the main scanning direction by rotating about the fold-enhancing roller rotating shaft 411 as a rotation axis.

Accordingly, similarly to the first embodiment, the fold-enhancing roller 410 according to the embodiment can intensively apply the pressing force of the pressing force transmitting part 412 to the entire fold in a short time with a simple configuration. Thus, the fold-enhancing roller 410 according to the embodiment can apply sufficient pressing force to the fold without reducing productivity while reducing the load on the fold-enhancing roller rotating shaft 411 with a simple configuration. Accordingly, a small, low-cost, highly productive fold-enhancing device can be provided with a simple configuration.

Details will be described below. Components denoted by the same reference numerals as those in the first embodiment represent the same or corresponding components, and detailed description thereof will not be repeated.

Figure 46:
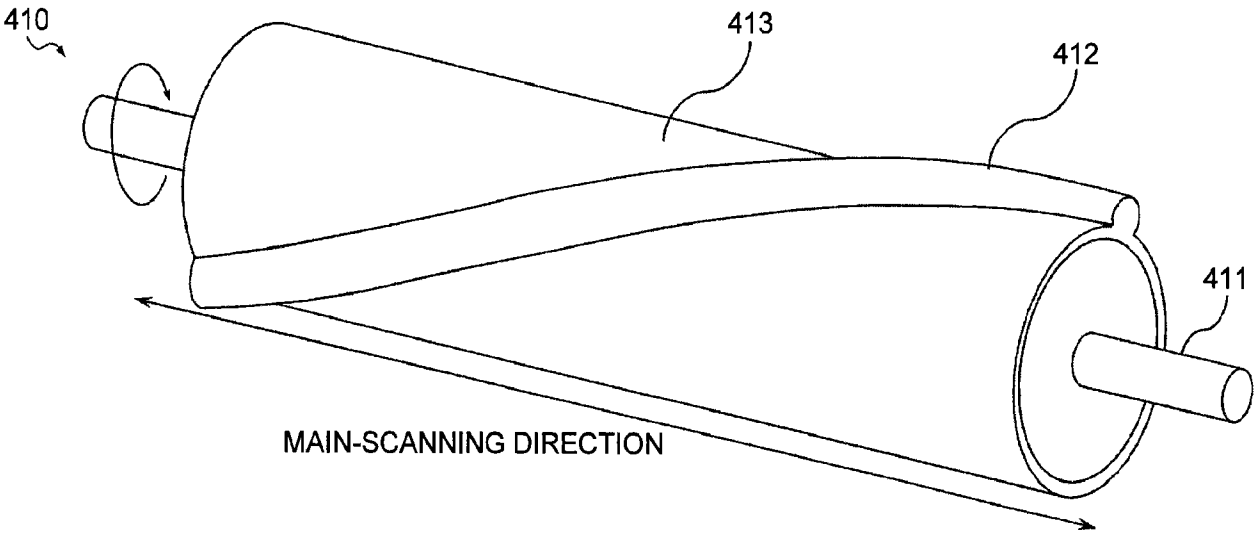
FIG. 46 is a perspective view of the fold-enhancing roller according to the embodiment viewed from the obliquely upward side of the main scanning direction.
Figure 47:
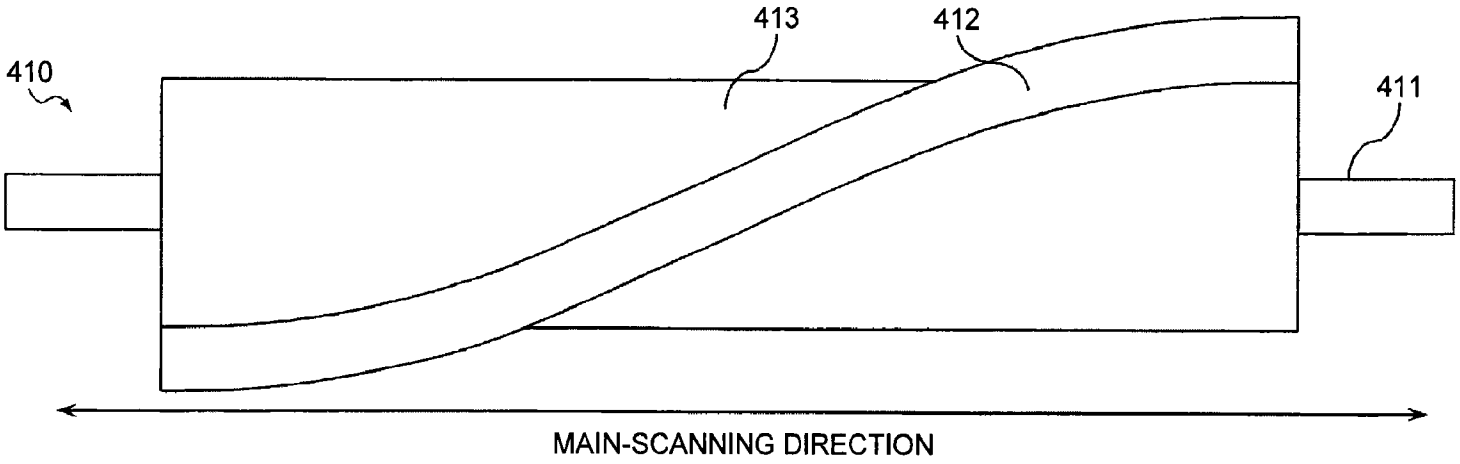
FIG. 47 is a front view of the fold-enhancing roller according to the embodiment viewed from the sub-scanning direction.
Figure 48:
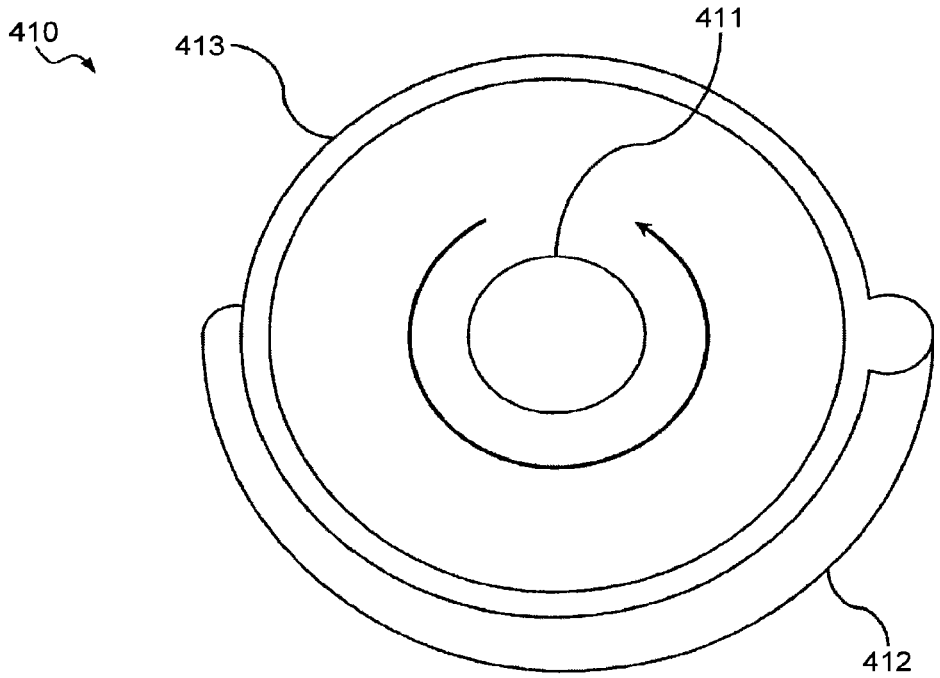
FIG. 48 is a side view of the fold-enhancing roller according to the embodiment viewed from the main scanning direction.
Figure 49:
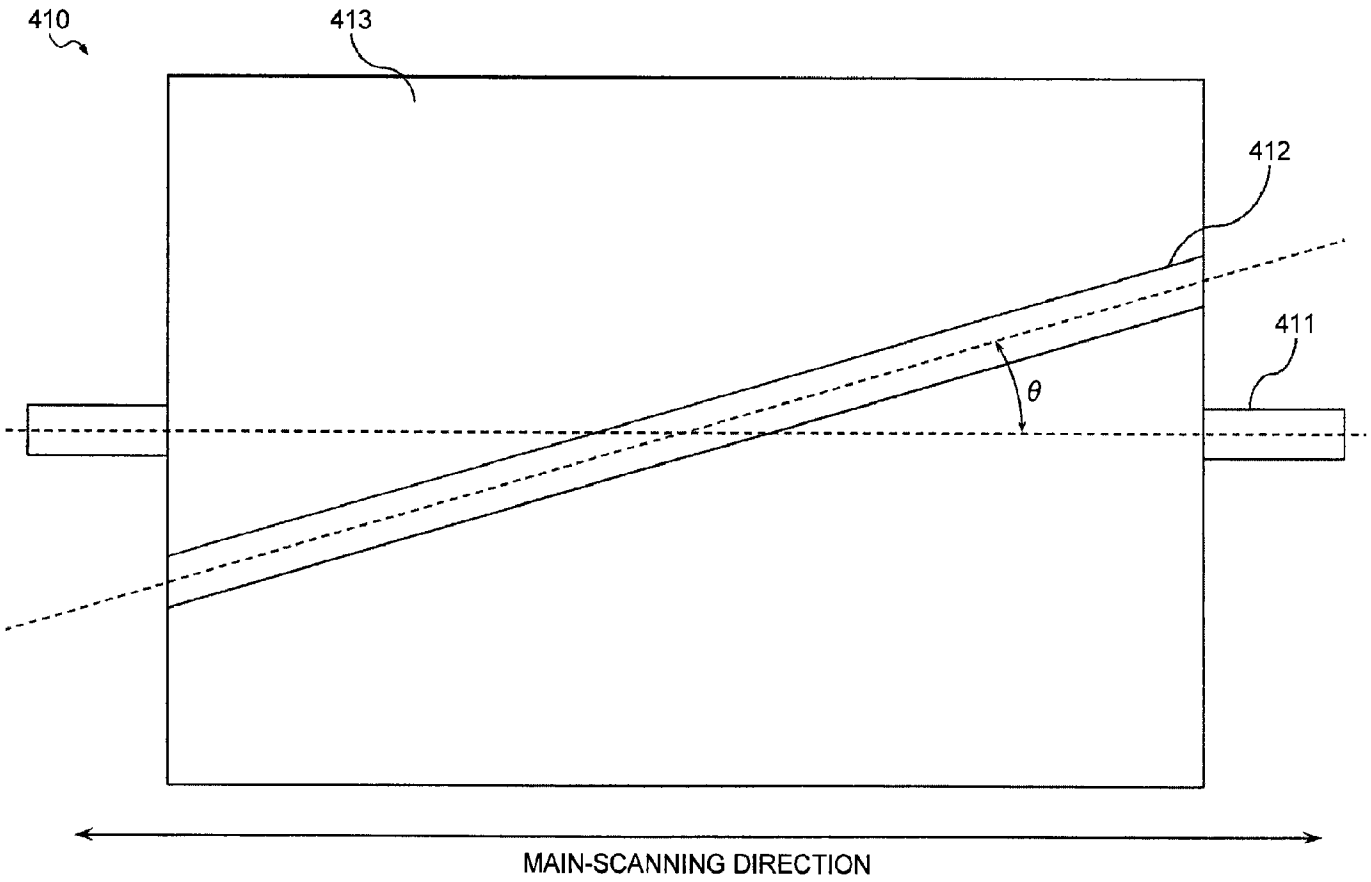
FIG. 49 is an exploded view of the fold-enhancing roller according to the embodiment.

First, the following describes a first example of the structure of the fold-enhancing roller 410 according to the embodiment with reference to FIGS. 46 to 49. FIG. 46 is a perspective view of the fold-enhancing roller 410 according to the embodiment viewed from the obliquely upward side of the main scanning direction. FIG. 47 is a front view of the fold-enhancing roller 410 according to the embodiment viewed from the sub-scanning direction. FIG. 48 is a side view of the fold-enhancing roller 410 according to the embodiment viewed from the main scanning direction. FIG. 49 is an exploded view of the fold-enhancing roller 410 according to the embodiment.

In the first example of the structure, as illustrated in FIGS. 46 to 49, the fold-enhancing roller 410 according to the embodiment has such a configuration that the projecting pressing force transmitting parts 412 are arranged on the surface of the pressing force transmitting roller 413 with a certain angle difference θ from the fold-enhancing roller rotating shaft 411. As a result, the pressing force transmitting parts 412 are arranged in a spiral manner along the fold-enhancing roller rotating shaft 411.

The pressing force transmitting roller 413 is a cylindrical rotational body rotatable about, as an rotation axis, the fold-enhancing roller rotating shaft 411 rotating about an axis in the main scanning direction. The fold-enhancing roller 410 according to the embodiment thus configured allows only part of the pressing force transmitting parts 412 to contact the fold formed on the sheet 6.

Accordingly, the fold-enhancing roller 410 according to the embodiment can successively press the fold formed on the sheet 6 in one direction, that is, the main scanning direction by rotating about the fold-enhancing roller rotating shaft 411 as a rotation axis.

Accordingly, the fold-enhancing processing unit 4 according to the embodiment can intensively apply the pressing force to the entire fold in a short time. Thus, the image forming apparatus according to the embodiment can apply sufficient pressing force to the fold without reducing productivity while reducing the load on the fold-enhancing roller rotating shaft 411 with a simple configuration. Accordingly, the fold-enhancing processing unit 4 according to the embodiment can provide a small, low-cost, highly productive fold-enhancing device with a simple configuration.

Figure 50:
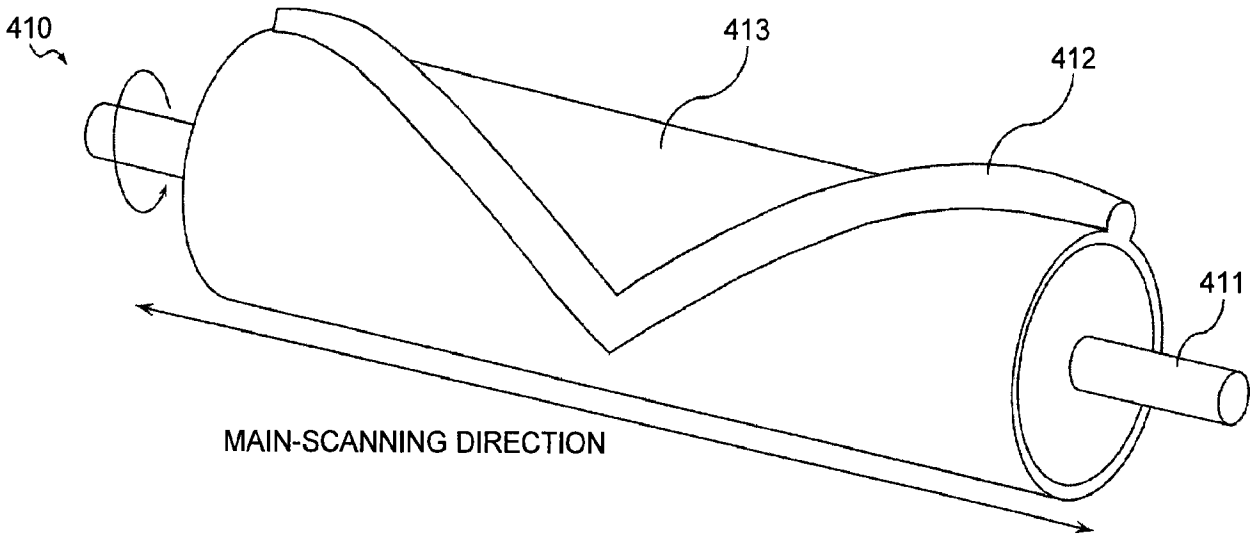
FIG. 50 is a perspective view of the fold-enhancing roller according to the embodiment viewed from the obliquely upward side of the main scanning direction.
Figure 51:
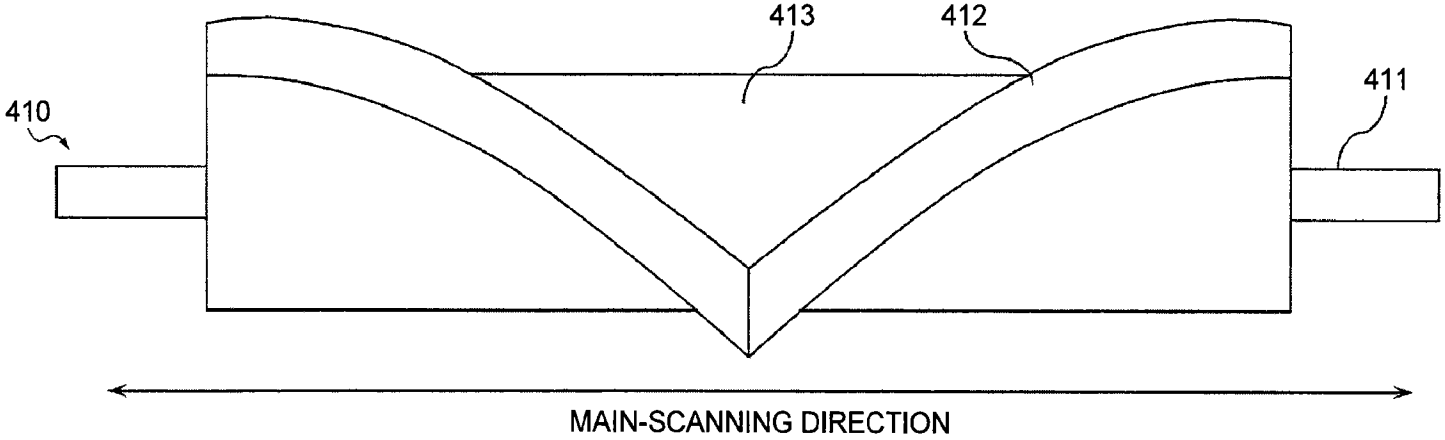
FIG. 51 is a front view of the fold-enhancing roller according to the embodiment viewed from the sub-scanning direction.
Figure 52:
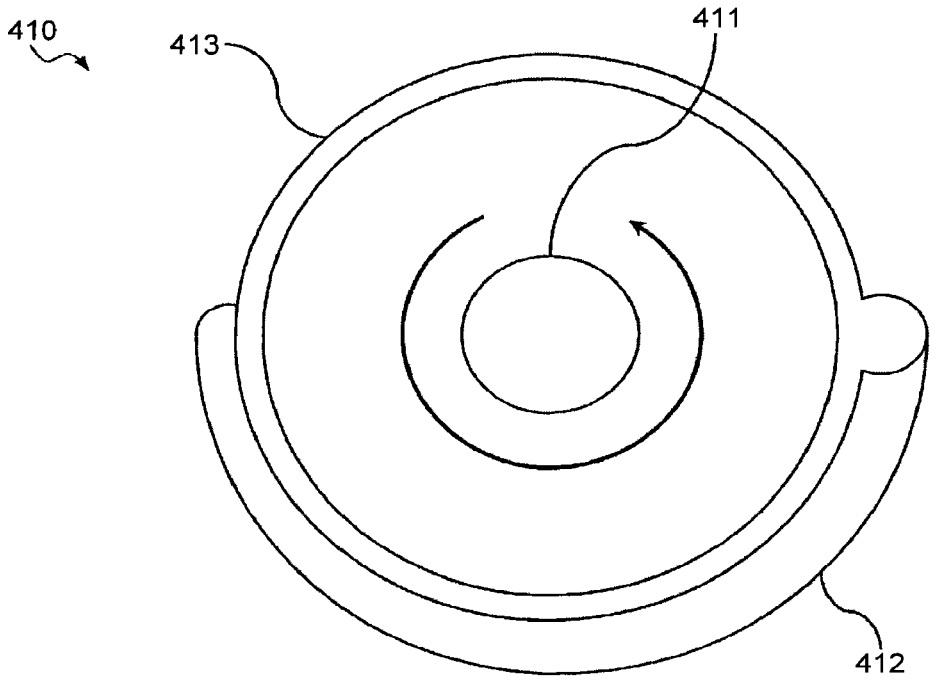
FIG. 52 is a side view of the fold-enhancing roller according to the embodiment viewed from the main scanning direction.
Figure 53:
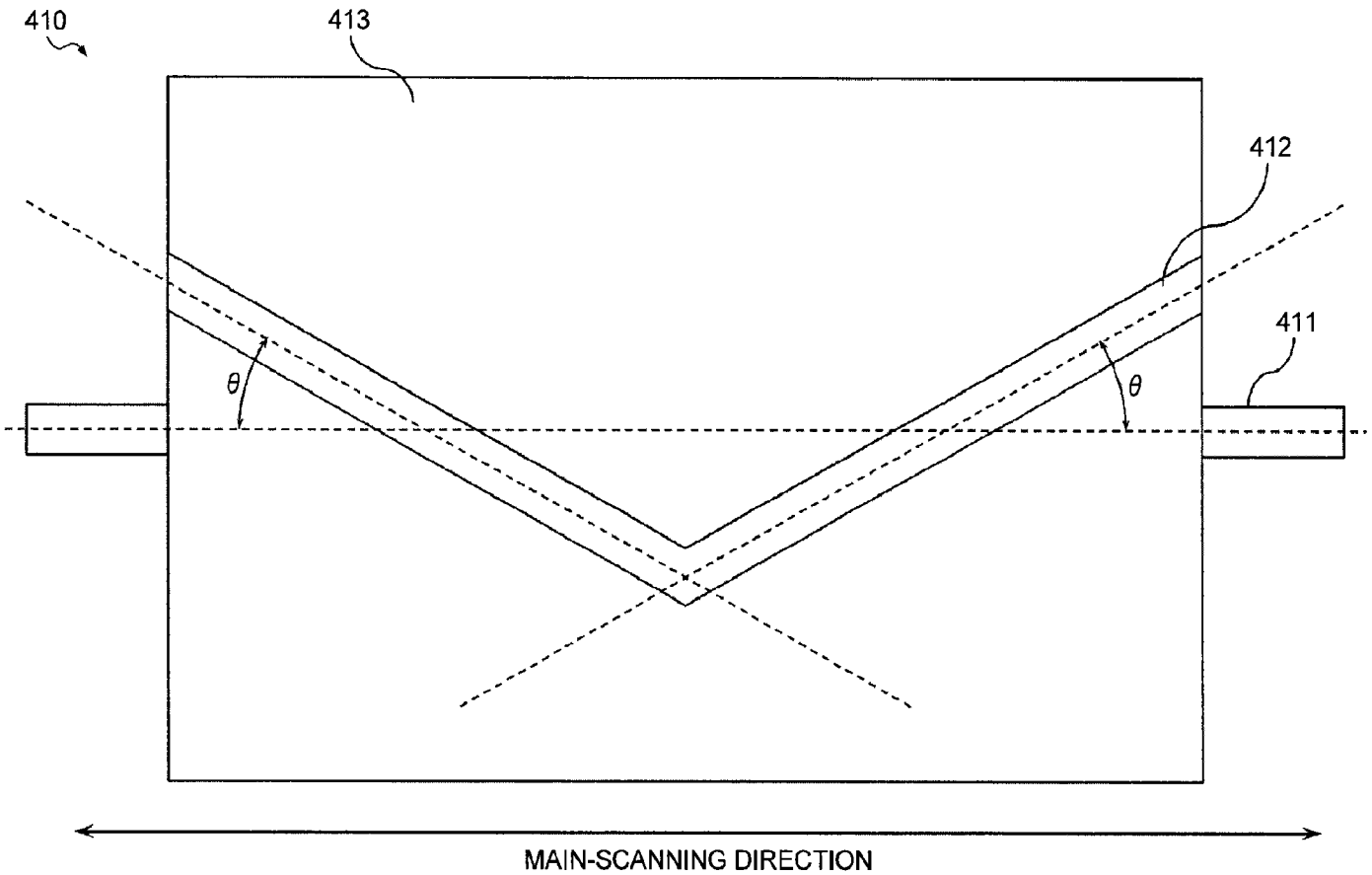
FIG. 53 is an exploded view of the fold-enhancing roller according to the embodiment.

The following describes a second example of the structure of the fold-enhancing roller 410 according to the embodiment with reference to FIGS. 50 to 53. FIG. 50 is a perspective view of the fold-enhancing roller 410 according to the embodiment viewed from the obliquely upward side of the main scanning direction. FIG. 51 is a front view of the fold-enhancing roller 410 according to the embodiment viewed from the sub-scanning direction. FIG. 52 is a side view of the fold-enhancing roller 410 according to the embodiment viewed from the main scanning direction. FIG. 53 is an exploded view of the fold-enhancing roller 410 according to the embodiment.

In the second example of the structure, as illustrated in FIGS. 50 to 53, the fold-enhancing roller 410 according to the embodiment has such a configuration that the projecting pressing force transmitting parts 412 are arranged on a peripheral surface of the pressing force transmitting roller 413 with a certain angle difference θ from the fold-enhancing roller rotating shaft 411, and arranged to be a symmetrical V-shape with respect to the center in the main scanning direction of the fold-enhancing roller 410. The fold-enhancing roller 410 according to the embodiment thus configured allows two points of the pressing force transmitting part 412 to contact the fold formed on the sheet 6 at the same time.

Accordingly, the fold-enhancing roller 410 according to the embodiment can successively press the fold formed on the sheet 6 in both directions along the main scanning direction by rotating about the fold-enhancing roller rotating shaft 411 as a rotation axis.

Accordingly, although the pressing force is reduced as compared with the structure illustrated in FIGS. 50 to 53, the fold-enhancing processing unit 4 according to the embodiment can intensively apply the pressing force to the entire fold in a shorter time with a simple configuration. Thus, the image forming apparatus according to the embodiment can apply sufficient pressing force to the fold while improving productivity and reducing the load on the fold-enhancing roller rotating shaft 411 with a simple configuration. Accordingly, the fold-enhancing processing unit 4 according to the embodiment can provide a small, low-cost, highly productive fold-enhancing device with a simple configuration.

Figure 54:
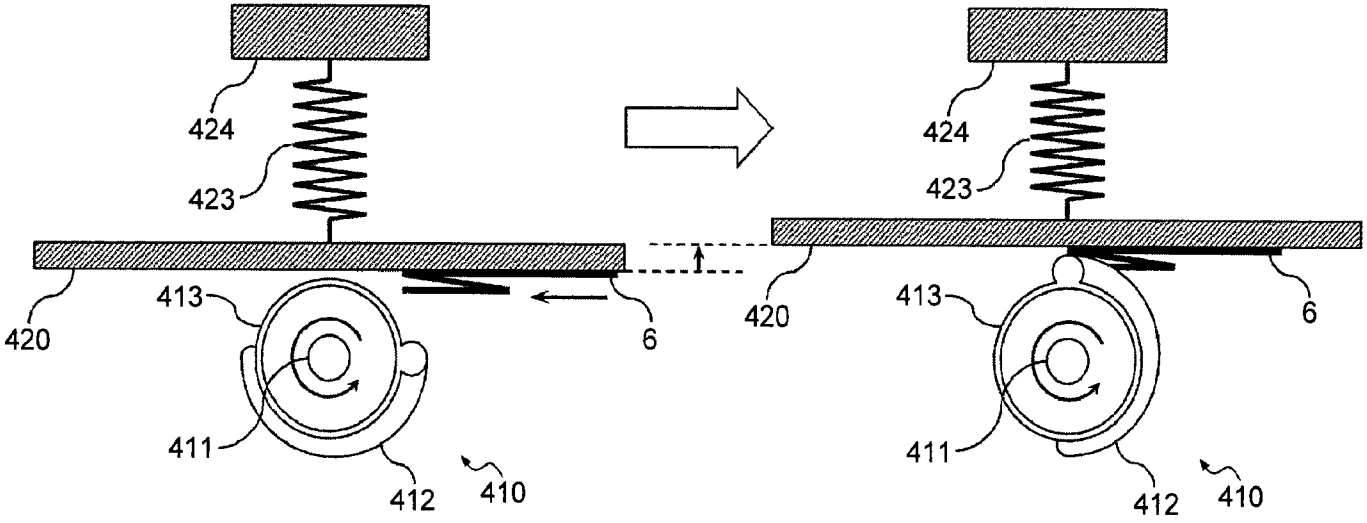
FIG. 54 is a side view of the sheet supporting plate according to the embodiment viewed from the main scanning direction.

The following describes an example of the structure of the sheet supporting plate 420 according to the embodiment with reference to FIG. 54. FIG. 54 is a side view of the sheet supporting plate 420 according to the embodiment viewed from the main scanning direction.

As illustrated in FIG. 54, the sheet supporting plate 420 according to the embodiment has such a configuration that an elastic body 423 that expands or contracts in a direction in which the pressing force of the fold-enhancing roller 410 acts is attached between the sheet supporting plate 420 and a fixing member 424 fixed inside the fold-enhancing processing unit 4. That is, in the embodiment, the elastic body 423 functions as a pressing part. FIG. 54 illustrates an example in which the elastic body 423 is a compression spring. Alternatively, the elastic body 423 may be an elastic material such as a leaf spring, rubber, a sponge, and plastic resin.

As illustrated in FIG. 54, in the fold-enhancing processing, the elastic body 423 is compressed by being pressed by the pressing force transmitting part 412 via the sheet 6, so that the sheet supporting plate 420 according to the embodiment moves in a direction in which the pressing force of the fold-enhancing roller 410 acts. Due to the elastic force of the elastic body 423 at this point, the fold-enhancing roller 410 according to the embodiment presses the fold formed on the sheet 6.

As described above, the fold-enhancing roller 410 according to the embodiment has such a configuration that the projecting pressing force transmitting parts 412 are arranged in a spiral manner around the fold-enhancing roller rotating shaft 411 with a certain angle difference from the fold-enhancing roller rotating shaft 411 on the surface of the cylindrical pressing force transmitting roller 413 about the fold-enhancing roller rotating shaft 411 as a rotation axis.

Thus, the fold-enhancing roller 410 according to the embodiment can successively press the fold formed on the sheet 6 in one direction, that is, the main scanning direction by rotating about the fold-enhancing roller rotating shaft 411 as a rotation axis.

Accordingly, the fold-enhancing roller 410 according to the embodiment can intensively apply the pressing force of the pressing force transmitting part 412 to the entire fold in a short time with a simple configuration. Thus, the fold-enhancing roller 410 according to the embodiment can apply sufficient pressing force to the fold without reducing productivity while reducing the load on the fold-enhancing roller rotating shaft 411 with a simple configuration. Accordingly, a small, low-cost, highly productive fold-enhancing device can be provided with a simple configuration.

As described above with reference to FIG. 54, the embodiment describes an example in which the fold formed on the sheet 6 is pressed with the elastic force generated when the elastic body 423 is compressed. Alternatively, the pressing force transmitting part 412 may be configured as an elastic body that expands or contracts in the direction in which the pressing force of the fold-enhancing roller 410 acts, and the fold formed on the sheet 6 may be pressed with the elastic force generated when the elastic body is compressed.

The embodiment exemplifies the fold-enhancing processing unit 4 including the fold-enhancing roller 410 configured as illustrated in FIGS. 46 to 49 and FIGS. 50 to 53, and the elastic body 423 and the fixing member 424 configured as illustrated in FIG. 54. Alternatively, the fold-enhancing processing unit 4 may include the fold-enhancing roller 410 configured as illustrated in FIGS. 8 to 10, FIGS. 11 to 13, FIGS. 14 to 16, and FIGS. 17 to 19, and the elastic body 423 and the fixing member 424 configured as illustrated in FIG. 54.

Fourth Embodiment

Next, the following describes another configuration of the fold-enhancing roller 410 for each example.

FIRST EXAMPLE

Figure 55A:
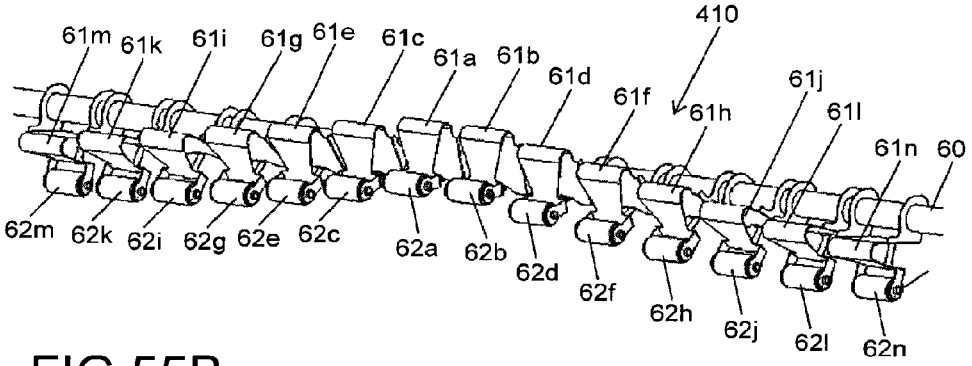
FIGS. 55A to 55C are diagrams illustrating the configuration of the fold-enhancing roller according to a first example.
Figure 55B:
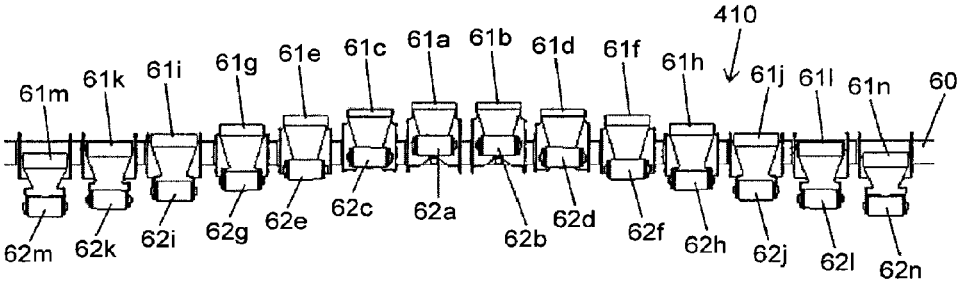
Figure 55C:
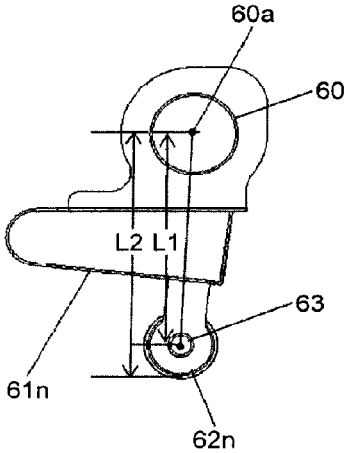

FIGS. 55A to 55C are diagrams illustrating the configuration of the fold-enhancing roller according to a first example. FIG. 55A is a perspective view, and FIG. 55B is a front view thereof. In FIGS. 55A to 55C, the fold-enhancing roller 410 includes a shaft 60, elastic members 61, and pressing members 62. A plurality of elastic members 61*a* to 61*n* are arranged on the shaft 60, and a plurality of pressing members 62*a* to 62*n* are provided to respective distal ends of the elastic members 61*a* to 61*n*. When the pressing members 62*a* to 62*n* contact a sheet bundle 39 or a second conveyance guide plate 55 facing thereto, the elastic members 61*a* to 61*n* are elastically deformed to generate pressing force in the respective pressing members 62*a* to 62*n*. In the embodiment, the pressing members 62*a* to 62*n* are arranged in a direction (hereinafter, referred to as a width direction) orthogonal to the sheet conveying direction while angles thereof are varied along the rotational direction to cover the entire area in the width direction of the sheet bundle 39. The reference numeral 61 collectively indicates the elastic members, and the reference numeral 62 collectively indicates the pressing members.

In FIG. 55, the two adjacent pressing members 62*a* and 62*b* at the center part are attached to the shaft 60 in the same phase, and the two pressing members 62*c* and 62*d* adjacent thereto are attached to the shaft 60 in the same phase shifted from the pressing members 62*a* and 62*b* toward the downstream side of the rotational direction by an angle α, for example. Similarly, the pressing members 62*e* and 62*f* adjacent to the pressing members 62*c* and 62*d* are attached to the shaft 60 in the same phase shifted from the 62*c* and 62*d* toward the downstream side of the rotational direction by the angle α, and the pressing members 62*g* and 62*h* adjacent to the pressing members 62*e* and 62*f* are attached to the shaft 60 in the same phase shifted from the pressing members 62*e* and 62*f* toward the downstream side of the rotational direction by the angle α. Accordingly, the other pairs of pressing members 62*i* and 62*j*, 62*k* and 62*l*, and 62*m* and 62*n* are respectively attached in an axis direction of the shaft 60 in the same phase shifted from each other toward the downstream side of the rotational direction by the angle α.

Accordingly, when the shaft 60 is rotated, the entire area in the width direction of the sheet bundle 39 can be successively pressurized toward the outside while being shifted by the angle α. The angle α herein means a preset angle (refer to FIG. 56) shifted so that the pressing members 62 can pressurize the fold from the center part toward the outside as the shaft 60 is rotated.

FIG. 55C is a side view of the pressing member denoted by the reference numeral 62*n* in FIG. 55A. As illustrated in FIG. 55C, in the example, the pressing member 62*n* is a rotating body such as a roller. A rotating shaft 63 is provided to the elastic member 61*n* attached to the shaft 60, and the pressing member 62*n* is rotatably supported by the rotating shaft 63. The pressing member 62*n* as the rotating body presses a folded part 39*a* of the sheet bundle 39 by rolling thereon, so that misalignment between the pressing member 62*n* and the sheet surface at a contact portion becomes the minimum when they contact each other. This configuration can prevent a wrinkle from being generated, and improve folding quality. The same applies to the other pressing members 62*a* to 62*m*. The elastic members 61*a* to 61*n* may be a metal leaf spring or an elastic synthetic resin material. The pressing members 62*a* to 62*n* may not be rotating bodies and may be attached to the elastic members 61*a* to 61*n* not to be rotated. In this case, a synthetic resin material having a low frictional coefficient may be used, for example.

In this example, rollers made of synthetic resin materials having the same diameter are used as the pressing members

61*a* to 61*n*. The distance L1 from the center 60*a* of the shaft 60 to the center 63*a* of the rotating shaft 63 is set to be the same for all the pressing members 61*a* to 61*n* (refer to FIG. 55C). Thus, the distance L2 from the center 60*a* of the shaft 60 to the outermost circumference of each of the pressing members 61*a* to 61*n* is the same for all of the pressing members 61*a* to 61*n*, and the pressing members 61*a* to 61*n* are positioned on the trajectory of the same circular arc about the center 60*a*. Accordingly, the pressing members 61*a* to 61*n* can fold-enhance the folded part (fold) 39*a* with substantially the same pressing force (pressurizing force). A rigid roller is appropriate, but an elastic roller can also be used. In this case, the modulus of elasticity (rigidity) of a material of the roller is selected considering the modulus of elasticity of the elastic member 61.

FIGS. 56A to 56D are operation explanatory schematic diagrams illustrating the fold-enhancing operation by the fold-enhancing roller 410 according to the first example viewed from a side. FIGS. 57A to 57F are explanatory schematic diagrams illustrating the displacement of a pressed position in the fold-enhancing operation viewed from the top.

Figure 56A:
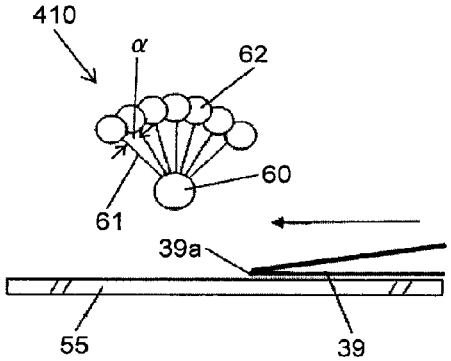
FIGS. 56A to 56D are operation explanatory schematic diagrams illustrating an fold-enhancing operation by the fold-enhancing roller according to the first example viewed from a side.
Figure 56B:
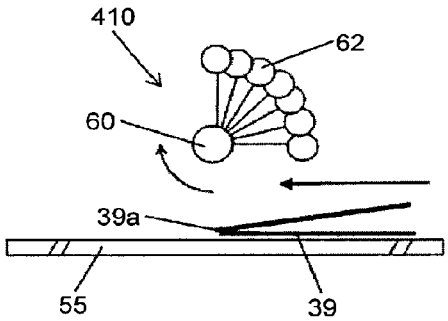
Figure 56C:
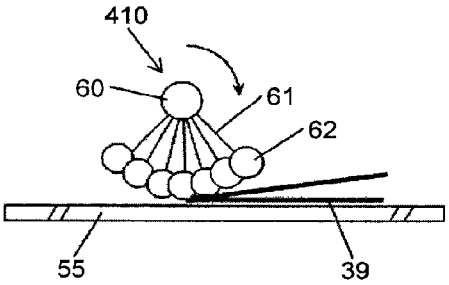

As illustrated in FIGS. 56A to 56D, the sheet bundle 39 folded in the center by a pair of center folding rollers 47 and 48 is conveyed by a pair of folded part conveyance rollers 49 and 50 to an fold-enhancing roller part 51 (FIG. 56A). When the sheet bundle 39 is conveyed to an fold-enhancing position below the fold-enhancing roller part 51, the sheet bundle 39 is stopped, and the shaft 60 of the fold-enhancing roller part 51 starts rotating (FIG. 56B). According to the rotation, the pressing members 62*a* and 62*b* arranged at the center part first pressurize (presses) the folded part 39*a* of the sheet bundle 39, and the pressing members 62*c* to 62*n* successively pressurize the folded part 39*a* from the inside to the outside according to the rotation of the shaft 60 (FIG. 56C). When this pressurizing operation, in other words, the fold-enhancing operation has been performed up to the outermost pressing members 62*m* and 62*n*, the folded part 39*a* is fold-enhanced over the entire area in the width direction of the sheet bundle 39.

Figure 56D:
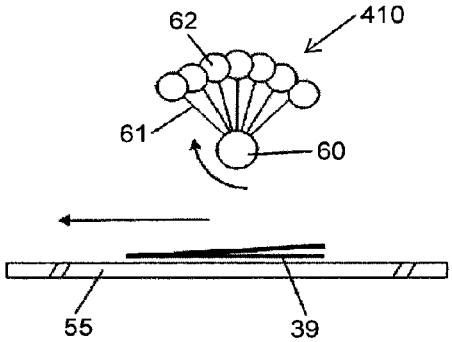
Figure 57A:
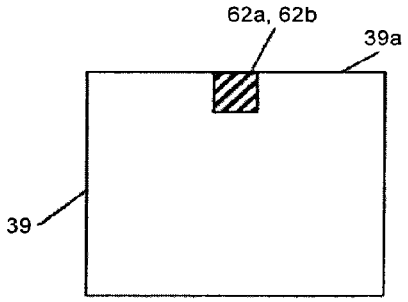
FIGS. 57A to 57F are explanatory schematic diagrams illustrating the displacement of a pressed position in the fold-enhancing operation by the fold-enhancing roller according to the first example viewed from the top.
Figure 57B:
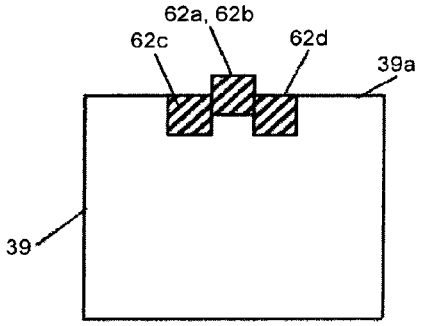
Figure 57C:
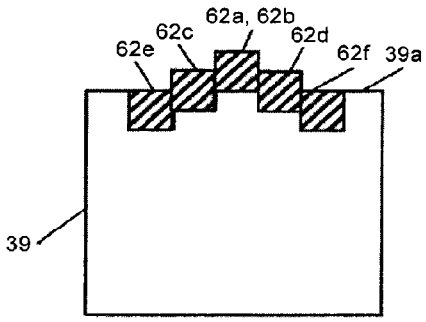
Figure 57D:
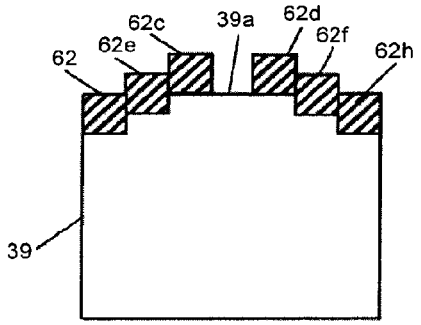
Figure 57E:
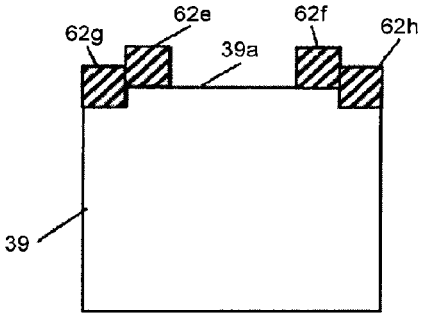
Figure 57F:
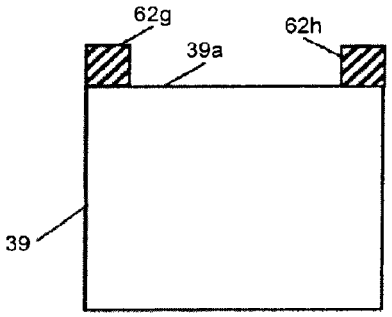

When the pressurizing operation (fold-enhancing operation) is ended across the entire width of the sheet bundle 39, the pressing members 62 of the fold-enhancing roller part 51 become separated from the sheet bundle 39, and the sheet bundle 39 is conveyed by the pair of conveyance rollers 49 and 50 (FIG. 56D). The sheet bundle 39 is passed from the pair of folded part conveyance rollers 49 and 50 to a pair of folded part paper ejection rollers 52 and 53 on a later stage to be ejected onto a paper ejection tray 46.

FIG. 57 illustrates a change in a pressurizing state at this point. As described above, the pressing members 62 pressurize the folded part 39*a* of the sheet bundle 39 from the center part toward the outside. That is, the pressing members 62*a* and 62*b* at the center part first press the center part in the width direction of the sheet bundle 39 (FIG. 57A). As the shaft 60 rotates, the pressurizing operation is successively performed toward the outside from the outer adjacent pressing members 62*c*, 62*d*, . . . to the outermost pressing members 62*m* and 62*n* (FIGS. 57B to 57F). The pressing members 62 that have completed the pressurizing operation successively become separated from the fold 39*a* to release the pressurization (FIGS. 57D to 57F) in the order of the pressurization. Although FIG. 57 illustrates only the pressing members 62*a* to 62*h* as the pressing members 62, all of the pressing members 62 denoted by the reference numerals 62*a* to 62*n* perform the pressurizing operation and a pressurization releasing operation as the shaft 60 rotates. Obviously, the number of pressing members 62 that actually contribute to the pressurizing operation varies depending on the sheet size of the sheet bundle 39 and the dimension of the pressing member 62 in the sheet width direction.

The fold-enhancing operation illustrated in FIG. 56 is performed on the sheet bundle 39 folded in the center. Another folding type of a sheet or a sheet bundle includes, for example, Z-folding. The Z-folding includes two folded part, that is, a first folded part 39*b* at the ½ position in the length direction of the sheet and a second folded part 39*c* at the ¼ position thereof. This example can be applied to such a case in which a plurality of folded parts are present in the conveying direction. In this case, a Z-folding mechanism is known in the art, and the description thereof is omitted herein.

Figure 58A:
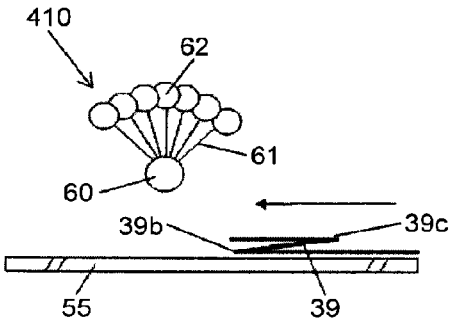
FIGS. 58A to 58F are operation explanatory diagrams illustrating an operation in a case of performing fold-enhancing processing on a Z-folded sheet bundle in the first example.
Figure 58B:
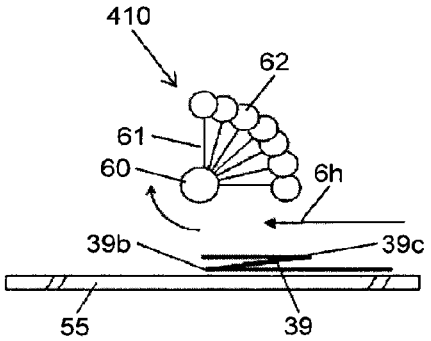
Figure 58C:
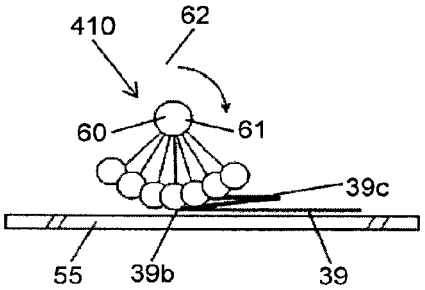
Figure 58D:
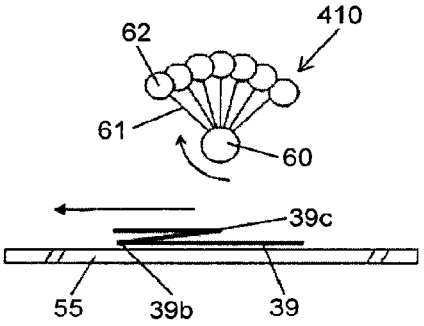
Figure 58E:
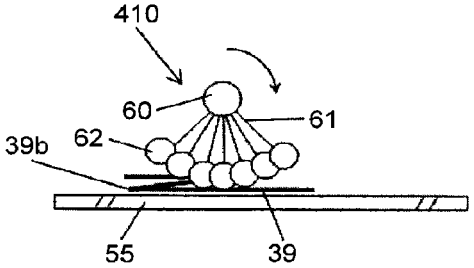
Figure 58F:
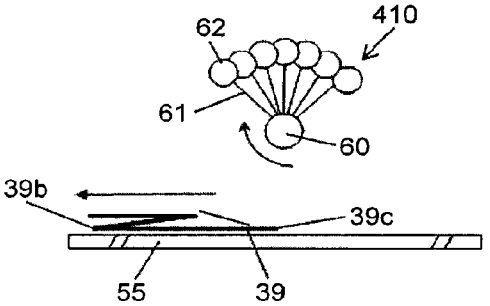

FIGS. 58A to 58F are operation explanatory diagrams illustrating an operation in a case of performing fold-enhancing processing on a Z-folded sheet bundle 39, and correspond to FIGS. 56A to 56D. In the example illustrated in FIGS. 58A to 58F, the pressurizing operation described with reference to FIGS. 56A to 56D is independently performed on the first folded part 39*b* and the second folded part 39*c*. That is, operations illustrated in FIGS. 58A to 58C are the same as those in FIGS. 56A to 56C. After the entire area in the width direction of the first folded part 39*b* of the sheet bundle 39 is pressurized, the sheet bundle 39 is conveyed again by the pair of folded part conveyance rollers 49 and 50 (FIG. 58D). When the second folded part 39*c* of the sheet bundle 39 is conveyed to the fold-enhancing position below the fold-enhancing roller 410, the sheet bundle 39 is stopped, and the fold-enhancing roller 410 performs the same operation as the pressurizing operation on the first folded part 39*b* again. That is, the second folded part 39*c* is successively pressurized from the center part toward the outside (FIG. 58E). After the pressurization operation is ended across the entire area in the width direction of the second folded part 39*c* of the sheet bundle 39, the sheet bundle 39 is conveyed toward the pair of folded part paper ejection rollers 52 and 53 on a later stage by the pair of folded part conveyance rollers 49 and 50 (FIG. 58F).

Figure 59A:
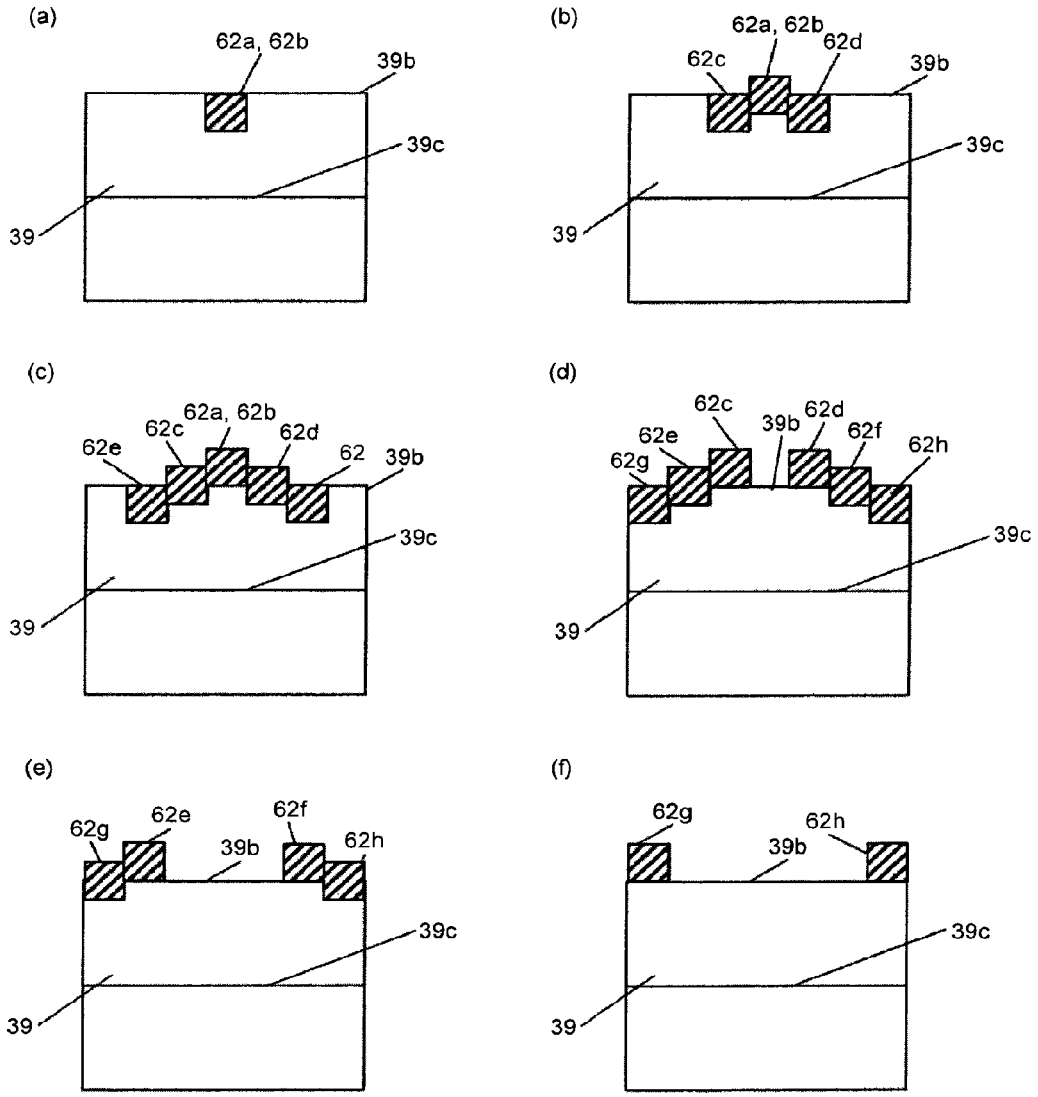
FIG. 59A is an explanatory schematic diagram illustrating the displacement of the pressed position when fold-enhancing processing is performed on a first folded part of the Z-folded sheet bundle in the first example viewed from the top.
Figure 59B:
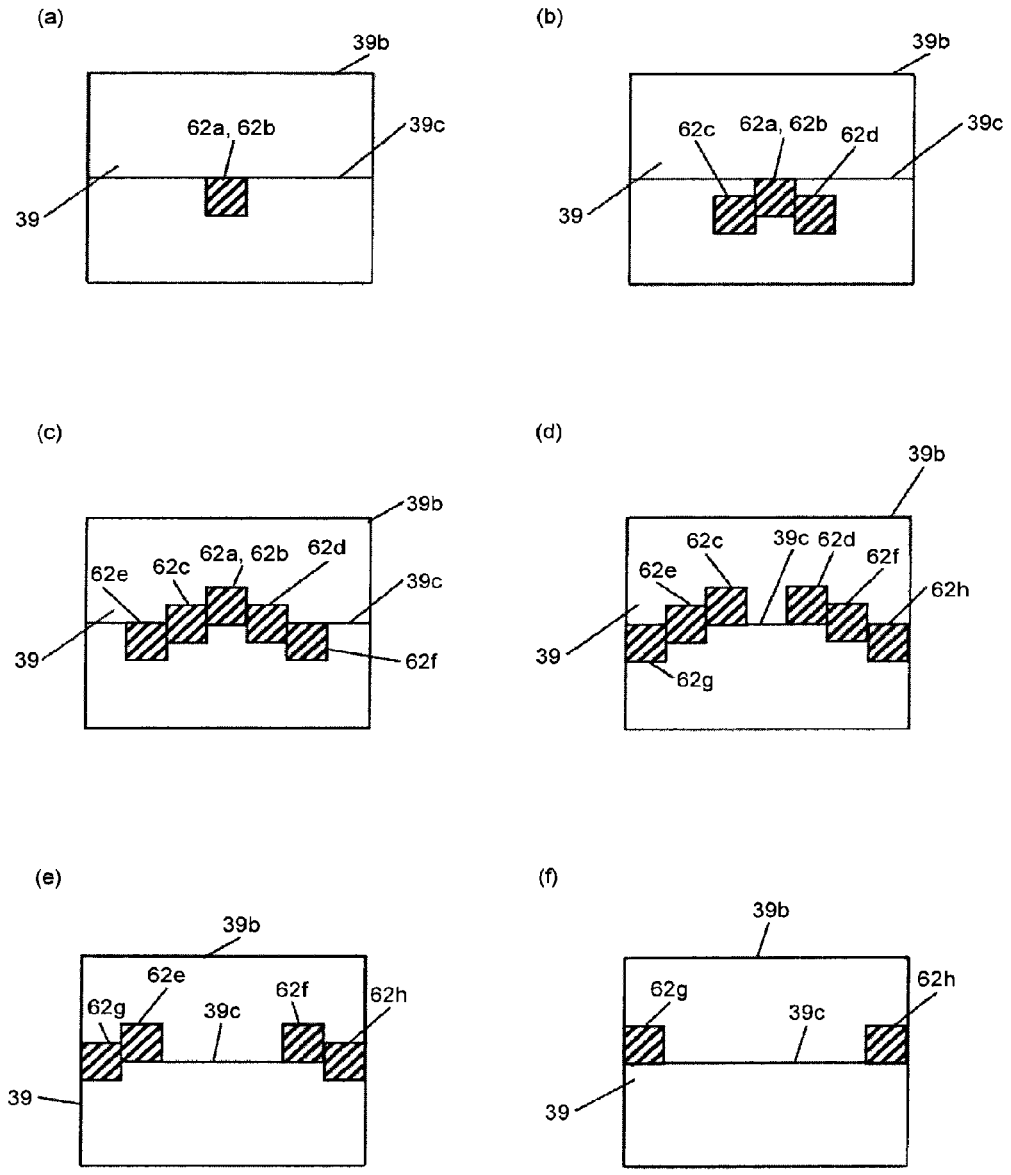
FIG. 59B is an explanatory schematic diagram illustrating the displacement of the pressed position when fold-enhancing processing is performed on a second folded part of the Z-folded sheet bundle in the first example viewed from the top.

FIGS. 59A and 59B illustrate a change in the pressurizing state in this process. The operation in FIG. 59A is the same as that illustrated in FIG. 57, in which the pressed position successively moves toward the outside from the pressing members 62*a* and 62*b* to the pressing members 62*m* and 62*n*, the entire area in the width direction of the first folded part 39*b* is pressurized, and the folded part is fold-enhanced. This operation corresponds to FIGS. 58A to 58D. FIG. 59B is a diagram illustrating a change in the pressurizing state in pressurizing the second folded part 39*c*. Also in the case of FIG. 59B, when the second folded part 39*c* of the sheet bundle 39 is conveyed to the fold-enhancing position below the fold-enhancing roller 410, the same operation as that on the first folded part 39*b* is repeated. When the entire area in the width direction of the second folded part 39*c* is pressurized ((a) to (f) in FIG. 59B) and the pressurizing operation is ended, the sheet bundle 39 is conveyed to the folded part paper ejection rollers 52 and 53 by the pair of folded part conveyance rollers 49 and 50, and the fold-enhancing operation is ended.

With such a configuration and operation, a plurality of sets of fold-enhancing rollers 410 are not necessarily provided for fold-enhancing, so that the size of the apparatus can be reduced and a space can be saved. The sheet bundle 39 is successively pressurized from the center part toward the outside, so that distortion generated in the folded part 39*a*, the first folded part 39*b*, and the second folded part 39*c* due to the pressurization can be dissipated to both ends of the sheet bundle 39. As a result, a folding height can be made small while preventing a wrinkle from being generated in the folded parts 39*a*, 39*b*, and 39*c* of the sheet bundle 39.

Although the sheet bundle 39 is described in the first example, the same description applies to a case of one sheet.

SECOND EXAMPLE

Figure 60A:
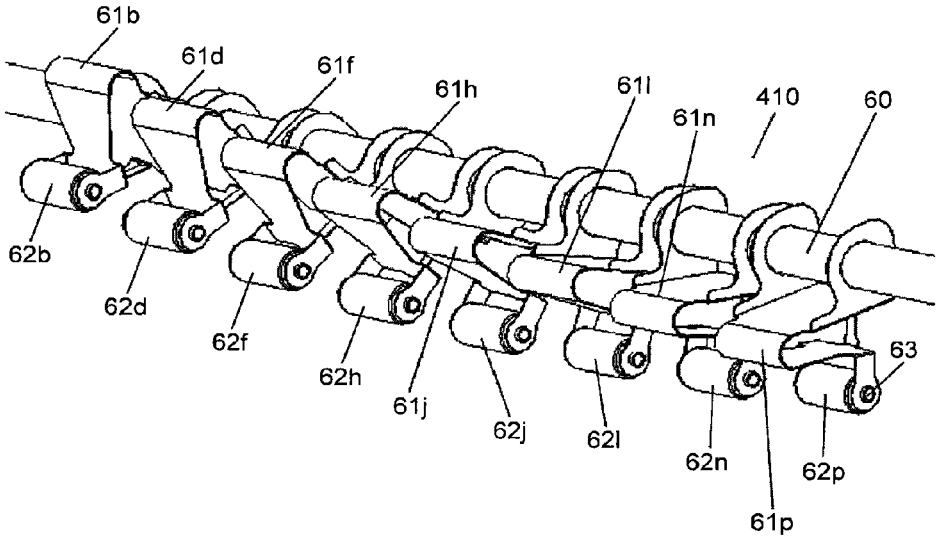
FIGS. 60A and 60B are diagrams illustrating the configuration of a pressing roller part according to a second example.
Figure 60B:
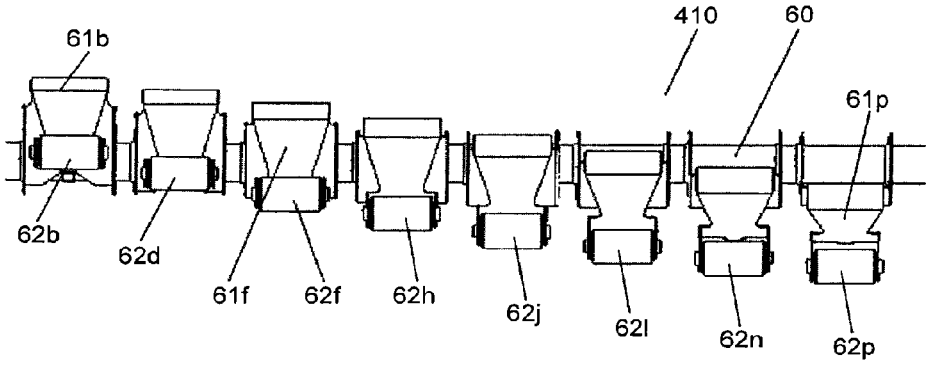

FIGS. 60A and 60B are diagrams illustrating the configuration of the fold-enhancing roller 410 according to a second example. FIG. 60A is a perspective view thereof, and FIG. 60B is a front view thereof. In the first example, the fold-enhancing roller 410 is configured to successively pressurize the sheet bundle 39 from the center part toward both outer ends. In contrast, in the second example, the fold-enhancing roller 410 is configured to successively change a pressurizing position from one end toward the other end in the width direction of the sheet bundle 39. Specifically, as illustrated in FIG. 55, the fold-enhancing roller 410 includes the pressing members 62 arranged on one side of the center part in the first example. That is, in the second example, the fold-enhancing roller 410 has such a configuration that a plurality of pressing members 62*b*, 62*d*, 62*f*, 62*h*, 62*j*, 621, 62*n*, and 62*p* are arranged side by side with the pressing member 62*b* at the center part and are shifted from each other toward the near side in FIG. 55A by the angle α. The other parts are the same as those in the first example.

With such a configuration, a line of the pressing members 62*b* to 62*p* is rotated about the shaft 60 when the shaft 60 is rotated, and the entire area in the width direction of the sheet bundle 39 can be successively pressurized from one end toward the other end. The pressing operation is performed as illustrated in FIGS. 56 and 58 in the first example. FIG. 61 illustrates a change in the pressurizing state in this process.

Figure 61A:
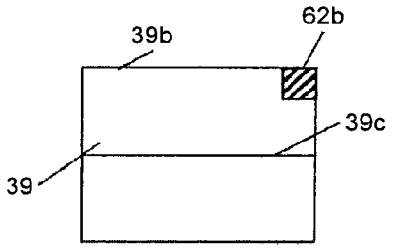
Figure 61B:
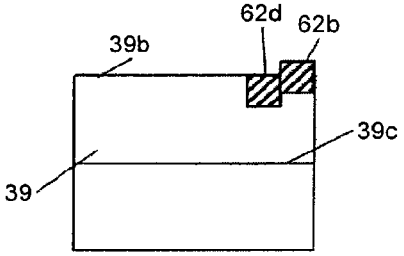
Figure 61C:
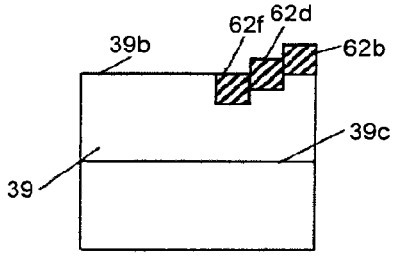
Figure 61D:
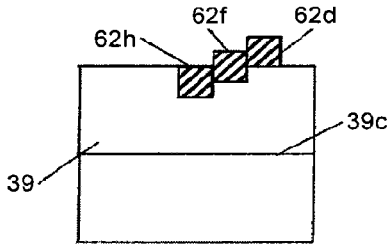
Figure 61E:
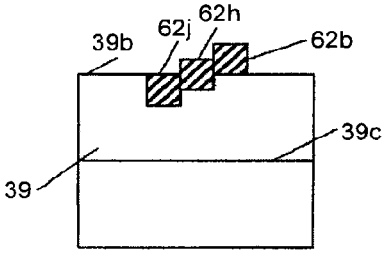
Figure 61F:
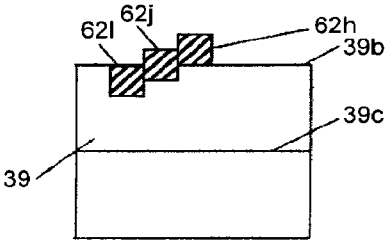
Figure 61G:
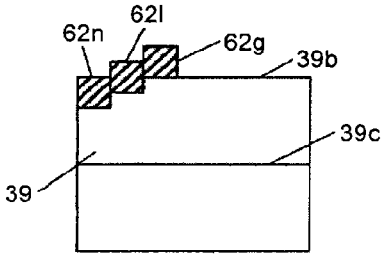
Figure 61H:
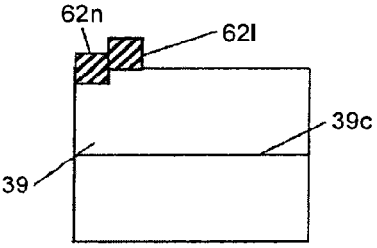
Figure 61I:
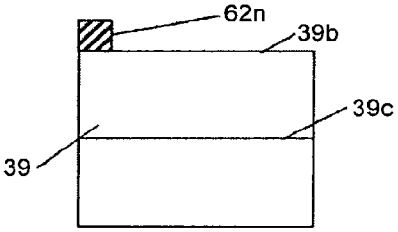

The change in the pressurizing state according to the second example illustrated in FIGS. 61A to 61I is equivalent to the change when the operation illustrated in FIG. 57 is performed on the entire width of the sheet bundle 39 with a half of the pressing members 62 in the first example. FIG. 61A illustrates a pressing start state with the pressing member 62*b*, and the pressing members are successively shifted from this state, and the pressing members 63*d*, 63*f*, . . . pressurize the entire area in the width direction of the folded part 39*a* of the sheet bundle 39. Such a configuration allows the entire area in the width direction of the sheet bundle 39 to be fold-enhanced in a reliable manner for the folded part 39*a* of the two-folded sheet bundle 39, or for the first folded part 39*b* and the second folded part 39*c* of the Z-folded sheet bundle 39. In a case of Z-folding, similarly to FIGS. 59A and 59B, the sheet bundle 39 is stopped and a similar fold-enhancing operation is performed on the first folded part 39*b* and the second folded part 39*c*.

According to the second example, the fold-enhancing roller 410 successively pressurizes the sheet bundle 39 from one end toward the other end, so that distortion generated in the folded part of the sheet bundle 39 can be dissipated from one end toward the other end. As a result, the folding height can be reduced while a wrinkle is prevented from being generated in the folded part 39*a* or the first and second folded parts 39*b* and 39*c* of the sheet bundle 39.

Other parts that are not specifically described herein are the same as those in the first example, and the description thereof will not be repeated.

THIRD EXAMPLE

Figure 62:
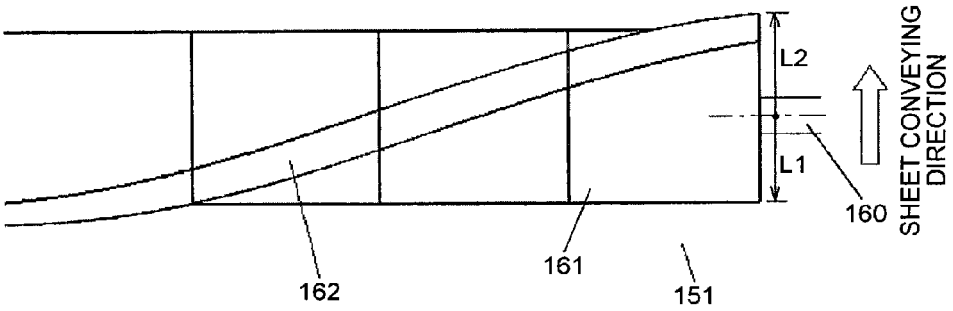
FIG. 62 is a main part front view illustrating the configuration of the fold-enhancing roller according to a third example.
Figure 63:
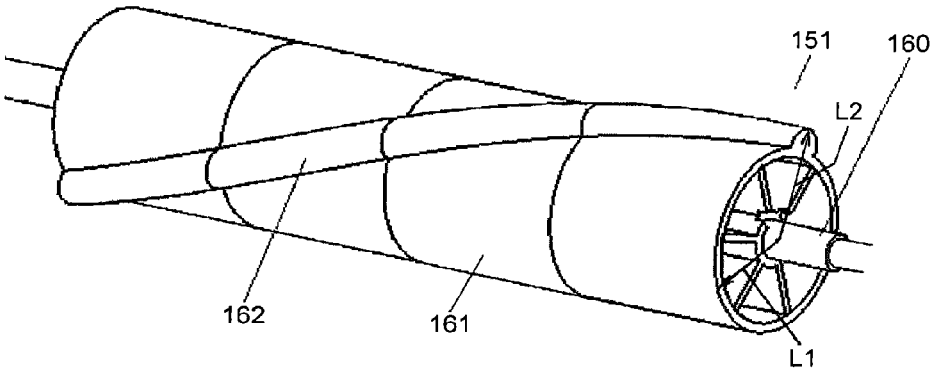
FIG. 63 is a perspective view illustrating the configuration of the fold-enhancing roller according to the third example.

FIG. 62 is a main part front view illustrating the configuration of the fold-enhancing roller according to a third example, and FIG. 63 is a perspective view thereof.

In the third example, the elastic member 61*n* illustrated in FIG. 55C in the first example is replaced with a cylindrical member 161, and the line of the pressing members 62*n* including a plurality of pressing members illustrated in FIG. 60 in the second example is replaced with a single pressing projection 162 having a projecting cross section to be integrally arranged on the surface of the cylindrical member 161. That is, the pressing projection 162 is integrally formed in a spiral manner as a projecting member on the surface of the cylindrical member 161 rotatable about a shaft 160. As illustrated in FIG. 63, the elastic projection 162 is integrally formed in a spiral manner such that an upper half of a rod-like member having a circular cross section (elastic member having a projecting cross section) is wound around the surface of the cylindrical member 161. The pressing member 62 in the first and second examples corresponds to the pressing projection 162 in the third example, the elastic member 61 corresponds to the cylindrical member 161, the shaft 60 corresponds to the shaft 160, and the fold-enhancing roller 410 corresponds to an fold-enhancing roller 151.

Figure 64A:
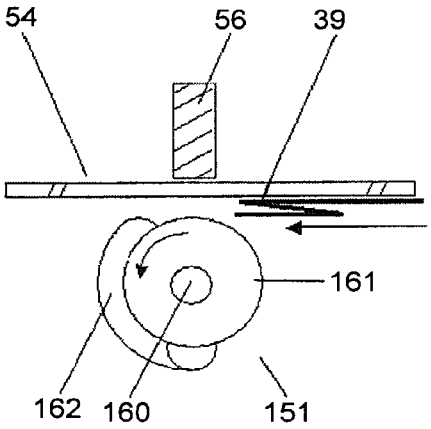
FIGS. 64A and 64B are explanatory diagrams for explaining an fold-enhancing function of the fold-enhancing roller according to the third example.
Figure 64B:
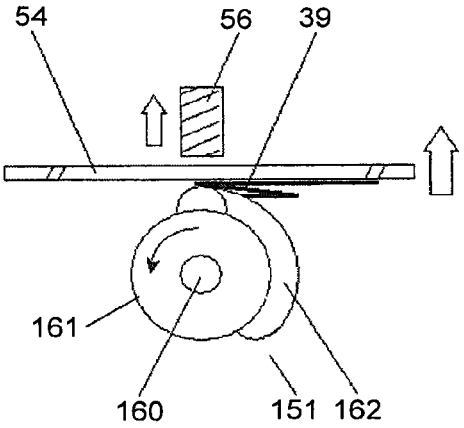

FIGS. 64A and 64B are explanatory diagrams for explaining an fold-enhancing function of the fold-enhancing roller according to the third example. In this example, as illustrated in FIGS. 64A and 64B, a compression spring 56 serving as an elastic member is arranged, for example, on a side of a first conveyance guide plate 54 opposite to the side on which the cylindrical member 161 is arranged. FIG. 64A illustrates a state in which the fold-enhancing operation is not performed. In this state, the pressing projection 162 is not in contact with the first conveyance guide plate 54. For example, when the Z-folded sheet bundle 39 is conveyed in this state, the fold-enhancing roller 151 is rotated in accordance with a timing when the sheet bundle 39 is stopped, and the pressing projection 162 contacts the first conveyance guide plate 54. When the pressing projection 162 contacts the first conveyance guide plate 54, the compression spring 56 is compressed to be (elastically) deformed, and the folded part of the sheet bundle 39 is pressurized by the first conveyance guide plate 54 and the compression spring 56.

The pressing projection 162 extends in a spiral manner in a direction orthogonal to the conveying direction, and can successively pressurize the entire area in the width direction of the sheet bundle 39 when the shaft 160 is rotated. This pressurization is equivalent to the operation of successively pressing by the pressing member 62*n* according to the second example illustrated in FIG. 60. In place of the compression spring 56, a known member having an elastic function can be used, for example, an elastic member having the elastic function different from the compression spring 56 such as a leaf spring and a torsion coil spring. In FIG. 64, the sheet bundle 39 is conveyed on a lower surface side of the first conveyance guide plate 54. The second conveyance guide plate 55 is arranged below the first conveyance guide plate 54, and the Z-folded sheet bundle 39 is moved in a space formed between the first and second conveyance guide plates 54 and 55. This space is a conveying path.

For example, the configuration of the third example corresponds to that of the first example (FIG. 55C), so that a dimensional relation is set so that the distance from the axis of the shaft 160 to a cylindrical surface of the cylindrical member 161 is L1, and the distance from the axis to the most projecting portion of the pressing projection 162 is L2.

FIGS. 65A to 65F are operation explanatory diagrams illustrating an operation for fold-enhancing the Z-folded sheet bundle 39 by the fold-enhancing roller 151 according to the third example.

Figure 65A:
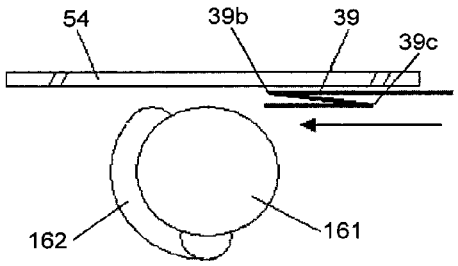
FIGS. 65A to 65F are operation explanatory diagrams illustrating an operation for fold-enhancing the Z-folded sheet by the fold-enhancing roller according to the third example.
Figure 65B:
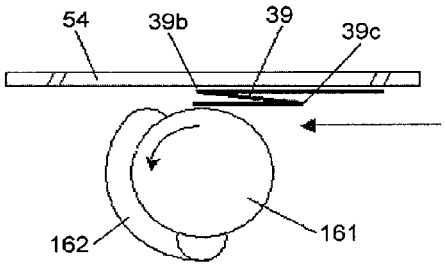
Figure 65C:
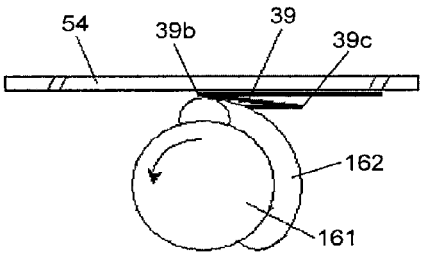
Figure 65D:
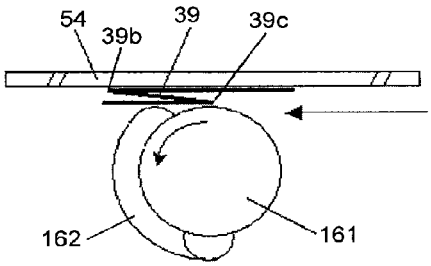

As illustrated in FIG. 65A, the sheet bundle 39 that has been Z-folded by a folding processing device (not illustrated) on the upstream side of the conveying direction is conveyed along the conveying path between the first and second conveyance guide plates 54 and 55. The sheet bundle 39 is stopped when the first folded part 38*b* of the sheet bundle 39 is conveyed to the vicinity of the fold-enhancing roller 151, and the fold-enhancing roller 151 starts rotating as illustrated in FIG. 65B. When the fold-enhancing roller 151 is rotated, as illustrated in FIG. 65C, the pressing projection 162 successively pressurizes the vicinity of the first folded part 39*b* of the sheet bundle 39 in a direction orthogonal to the conveying direction. After the entire area in the width direction of the first folded part 39*b* of the sheet bundle 39 is pressurized, as illustrated in FIG. 65D, the sheet bundle 39 is conveyed again with a conveyance roller (not illustrated).

Figure 65E:
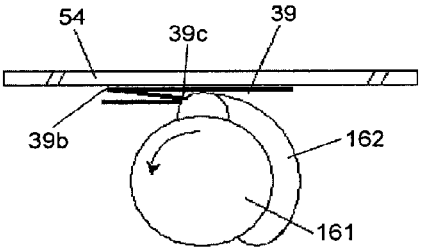
Figure 65F:
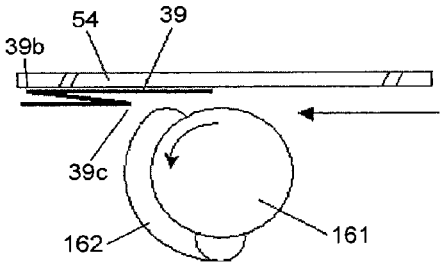

When the second folded part 39*c* of the sheet bundle 39 is conveyed to the vicinity of the cylindrical member 161 of the fold-enhancing roller 151, the sheet bundle 39 is stopped. As illustrated in FIG. 65E, the pressing projection 162 then successively pressurizes the second folded part 39*c* of the sheet bundle 39 similarly to the first folded part 39*b*. As illustrated in FIG. 65F, when the pressurizing operation on the entire area in the width direction of the second folded part 39*c* of the sheet bundle 39 is ended, the sheet bundle 39 is conveyed by a conveyance roller (not illustrated) to be ejected onto the paper ejection tray 46, for example. In this way, also in the third example, the fold-enhancing operation is performed on the first and second folded parts 39*b* and 39*c* of the Z-folded sheet bundle 39.

Figure 66:
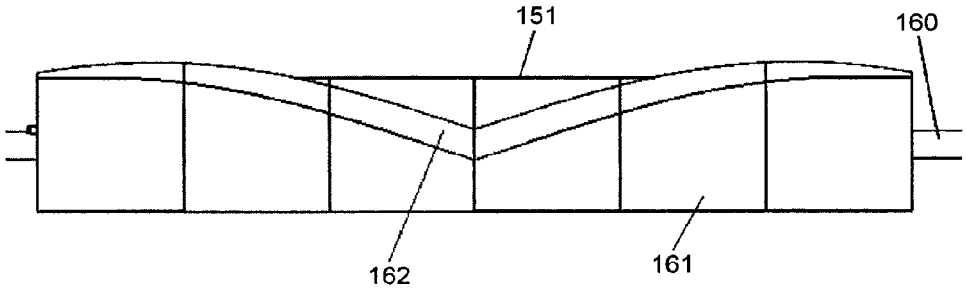
FIG. 66 is a front view of the fold-enhancing roller corresponding to the first example in the third example.
Figure 67:
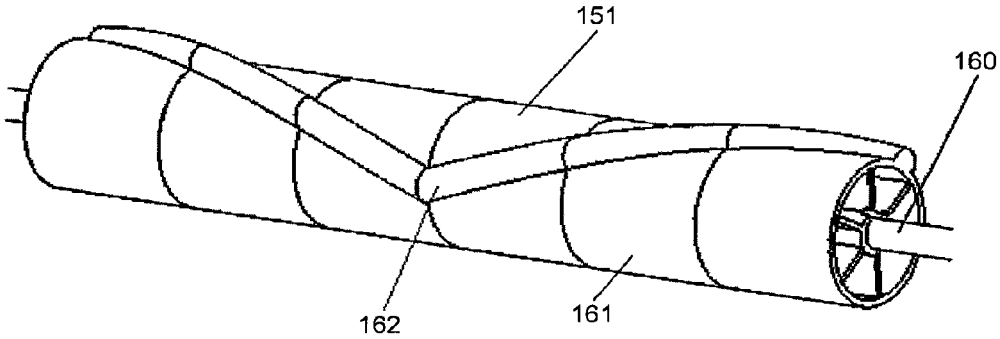
FIG. 67 is a perspective view of the fold-enhancing roller corresponding to the first example in the third example.

FIGS. 66 and 67 are a front view and a perspective view, respectively, of the fold-enhancing roller 151 corresponding to the first example in the third example. The pressing projection 162 is continuously arranged in a spiral manner on an outer circumference of the cylindrical member 161 on the same axis. Accordingly, as the shaft 160 rotates, the pressing projection 162 is successively brought into contact with the first conveyance guide plate 54 with any of the arrangement illustrated in FIGS. 62 and 63 and the arrangement illustrated in FIGS. 66 and 67. In the example illustrated in FIGS. 62 and 63, the pressing projection 162 is in contact with the sheet bundle 39 at one point at a time. In the example illustrated in FIGS. 66 and 67, the pressing projection 162 is in contact with the sheet bundle 39 at two points at a time.

In the example illustrated in FIGS. 62 and 63, the pressing projection 162 is in contact with the sheet bundle 39 at one point at a time, so that the load torque on the motor that drives the fold-enhancing roller 151 can be reduced. As a result, the size of the motor can be reduced, and a driving system can be simply configured. In the example illustrated in FIGS. 66 and 67, the pressing projection 162 is in contact with the sheet bundle 39 at two points (a plurality of points) of the fold at the same time, so that the pressurizing force can be increased. That is, although the load torque on the motor is increased as compared with the former example, productivity can be improved.

With the configuration illustrated in FIGS. 62 and 63, the pressing projection 162 successively and continuously contacts the folded part 39*a* or the first and second folded parts 39*b* and 39*c* of the sheet bundle 39, and pressurizes the sheet bundle 39 from one end toward the other end. This configuration can prevent a wrinkle from being generated in the sheet bundle 39. With the configuration illustrated in FIGS. 66 and 67, the pressing projection 162 successively and continuously contacts the folded part 39*a* or the first and second folded parts 39*b* and 39*c* of the sheet bundle 39, and pressurizes the sheet bundle 39 from the center part toward one end and the other end of the sheet bundle 39. This configuration can prevent a wrinkle from being generated in the sheet bundle 39 similarly to the configuration illustrated in FIGS. 62 and 63.

In each of FIGS. 11, 12, 14, 15, 17, and 18, it is seen that the projections are disposed such that a sheet entering a space between the support and the roller initially contacts to press the sheet by only a central region of the roller without contacting edge regions of the roller.

An embodiment can provide a small, low-cost, highly productive sheet processing device for pressing a sheet.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing device, comprising:

a support; and a roller disposed to press a folded sheet against the support, the roller including a plurality of projections disposed in a plurality of rows, each of the plurality of rows extending along a length of the roller, wherein each of the rows is non-linear, wherein when the roller is configured such that only one of the rows contacts the folded sheet at any time.

2. The sheet processing device according to claim 1, wherein the plurality of projections are disposed in a plurality of positions in a circumferential direction of the roller.

3. The sheet processing device according to claim 2, wherein the plurality of projections are disposed at regular intervals in the circumferential direction of the roller.

4. The sheet processing device according to claim 1, wherein the plurality of projections are disposed in a plurality of positions in an axial direction of the roller.

5. The sheet processing device according to claim 4, wherein the plurality of projections are disposed at regular intervals in the axial direction of the roller.

6. The sheet processing device according to claim 1, wherein the roller is configured to press and fold the sheet against the support while rotating.

7. An image forming system comprising:

an image forming apparatus configured to perform image formation output on the sheet;

a folding processing device configured to perform folding processing on the sheet on which the image is formed by the image forming apparatus, to form a fold on the sheet; and the sheet processing device according claim 1, configured to press the fold formed by the folding processing device.

8. The sheet processing device according to claim 1, wherein:

the plurality of projections elastically compress and contract along a radial direction of the roller.

9. The sheet processing device according to claim 1, wherein:

the projections are disposed such that a sheet entering a space between the support and the roller initially contacts to fold a central region of the roller without contacting edge regions of the roller, and subsequently contacts to fold outer regions on two sides of the central region.

10. The sheet processing device according to claim 1, wherein:

the support surface is a flat surface.

11. The sheet processing device according to claim 1, wherein:

the support surface is non-rotatable.

12. The sheet processing device according to claim 1, wherein:

each of the projections includes a rotating body that rotates about a corresponding axis.

13. The sheet processing device according to claim 1, wherein:

each of the plurality of rows is disposed such that as the roller rotates, all portions, corresponding to a size of the sheet, of one of the plurality of rows contact the sheet before another of the plurality of rows contacts the sheet.

14. The sheet processing device according to claim 1, wherein:

each row extends from one end of the roller to another end of the roller.

15. A sheet processing device, comprising:

a support; and a roller disposed to press the sheet against the support, the roller including a plurality of projections disposed along a length of the roller, the projections disposed such that a sheet entering a space between the support and the roller initially contacts to press the sheet by only a central region of the roller without contacting edge regions of the roller, and subsequently contacts to press the sheet by the edge regions on two sides of the central region.

16. The sheet processing device according to claim 15, wherein the plurality of projections are disposed in a plurality of positions in a circumferential direction of the roller.

17. The sheet processing device according to claim 16, wherein the plurality of projections are disposed at regular intervals in the circumferential direction of the roller.

18. The sheet processing device according to claim 15, wherein the plurality of projections are disposed in a plurality of positions in the axial direction of the roller.

19. The sheet processing device according to claim 18, wherein the plurality of projections are disposed at regular intervals in the axial direction of the roller.

20. The sheet processing device according to claim 15, wherein the roller is configured to press and fold the sheet against the support while rotating.

21. An image forming system comprising:

an image forming apparatus configured to perform image formation output on the sheet;

a folding processing device configured to perform folding processing on the sheet on which the image is formed by the image forming apparatus, to form the fold on the sheet; and the sheet processing device according claim 15, configured to press the fold formed by the folding processing device.

22. The sheet processing device according to claim 15, wherein:

the plurality of projections elastically compress and contract along a radial direction of the roller.

23. The sheet processing device according to claim 15, wherein:

the support surface is a flat surface.

24. The sheet processing device according to claim 15, wherein:

the support surface is non-rotatable.

* * * * *